US007228086B2

(12) United States Patent
Kawaguchi et al.

(10) Patent No.: US 7,228,086 B2
(45) Date of Patent: Jun. 5, 2007

(54) ELECTROPHOTOGRAPHIC IMAGE FORMING APPARATUS HAVING PROCESS CARTRIDGE WITH ELECTRICAL CONTACTS

(75) Inventors: Hideshi Kawaguchi, Numazu (JP); Takeshi Kubota, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 11/007,464

(22) Filed: Dec. 9, 2004

(65) Prior Publication Data

US 2005/0135831 A1 Jun. 23, 2005

(30) Foreign Application Priority Data

Dec. 9, 2003 (JP) ..... 2003-411063
Dec. 6, 2004 (JP) ..... 2004-352495

(51) Int. Cl.
*G03G 15/00* (2006.01)
*G03G 21/18* (2006.01)

(52) U.S. Cl. ..... 399/90; 399/111

(58) Field of Classification Search ..... 399/88, 399/89, 90, 111

See application file for complete search history.

(56) References Cited

U.S. PATENT DOCUMENTS 5,559,581 A 9/1996 Sugiura et al. ..... 355/200
5,561,496 A 10/1996 Sugiura et al. ..... 355/200
5,634,178 A 5/1997 Sugiura et al. ..... 399/110
5,642,187 A 6/1997 Nomura et al. ..... 399/111
5,650,841 A 7/1997 Matsuda et al. ..... 399/111
5,678,139 A 10/1997 Nomura et al. ..... 399/114
5,697,022 A 12/1997 Matsuda et al. ..... 399/102
5,825,472 A 10/1998 Araki et al. ..... 355/200
5,867,751 A 2/1999 Nomura et al. ..... 399/90
5,907,751 A 5/1999 Kawaguchi et al. ..... 399/117
5,953,562 A 9/1999 Kawaguchi et al. ..... 399/117

(Continued)

FOREIGN PATENT DOCUMENTS

JP 62-215278 9/1987

(Continued)

OTHER PUBLICATIONS

Patent Abstracts of Japan, vol. 1998, No. 08, Jun. 30, 1998, Abstract of Japan Document No. 10-074030.

(Continued)

*Primary Examiner*—Robert Beatty
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive drum, a process device actable on the drum, and a movable operation member. After the cartridge is mounted to the main assembly of the apparatus, the movable operation member is displaced by a driving force transmitted from the main assembly of the apparatus to the cartridge, so that the movable operation member is engaged with a displaceable member provided in the main assembly to move the displaceable member, in interrelation with which an output contact of the apparatus is moved from a retracted to an electrical connection position against an elastic force of an elastic function member. In addition, the cartridge includes an input electrical contact for receiving a voltage for enabling the process device means by engagement with the output contact moved to the electrical connection position.

22 Claims, 46 Drawing Sheets

U.S. PATENT DOCUMENTS

| | | | | |
|---|---|---|---|---|
| 6,011,941 | A * | 1/2000 | Takashima et al. | 399/111 |
| 6,047,153 | A | 4/2000 | Kawaguchi | 399/263 |
| 6,084,622 | A | 7/2000 | Sugiura et al. | 347/170 |
| 6,097,906 | A | 8/2000 | Matsuzaki et al. | 399/90 |
| 6,236,822 | B1 | 5/2001 | Kawaguchi | 399/114 |
| 6,272,300 | B1 | 8/2001 | Fujiwara et al. | 399/113 |
| 6,311,026 | B1 | 10/2001 | Higeta et al. | 399/13 |
| 6,661,977 | B1 | 12/2003 | Kubota | 399/12 |
| 6,993,264 | B2 * | 1/2006 | Oguma et al. | 399/90 |
| 7,085,509 | B2 * | 8/2006 | Kubota et al. | 399/90 |
| 7,130,557 | B2 * | 10/2006 | Abe et al. | 399/90 |
| 2004/0105699 | A1 | 6/2004 | Kubota | 399/111 |
| 2005/0135831 | A1 | 6/2005 | Kawaguchi et al. | 399/90 |
| 2005/0135832 | A1 | 6/2005 | Kubota et al. | 399/90 |
| 2005/0191079 | A1 | 9/2005 | Yokoi et al. | 399/90 |
| 2005/0191080 | A1 | 9/2005 | Oguma et al. | 399/90 |

FOREIGN PATENT DOCUMENTS

| | | |
|---|---|---|
| JP | 7-77921 | 3/1995 |
| JP | 9-68833 | 3/1997 |
| JP | 10-74030 | 3/1998 |
| JP | 10-228223 | 8/1998 |

OTHER PUBLICATIONS

Translation of final Taiwanese Office Action in Appln. No. 93138143.

* cited by examiner (a)

(b)

(a)

(b)

(a)

(b)

(a)

(b)

(a)

(b)

ELECTROPHOTOGRAPHIC IMAGE FORMING APPARATUS HAVING PROCESS CARTRIDGE WITH ELECTRICAL CONTACTS

FIELD OF THE INVENTION AND RELATED ART

The present invention relates to a process cartridge and an electrophotographic image forming apparatus usable with the process cartridge.

Here, the electrophotographic image forming apparatus is an apparatus for forming the image on a recording material (a recording sheet, an OHP sheet or the like) through an electrophotographic image forming process. It includes an electrophotographic copying machine, electrophotographic printer or the like.

The process cartridge is a cartridge containing as a unit an electrophotographic photosensitive member and process means including at least one of charging member and developing member, which cartridge is detachably mountable to a main assembly of the electrophotographic image forming apparatus.

With the electrophotographic image forming apparatus of the process cartridge type, the process cartridge can be mounted to or demounted from the main assembly of the image forming apparatus by the user without an expert serviceman. Therefore, the operability of the image forming apparatus is remarkably improved.

In such an electrophotographic image forming apparatus, it is necessary to supply electric voltages to a charging member for electrically charging the electrophotographic photosensitive member (photosensitive drum), a developing member for developing an electrostatic latent image formed on the photosensitive drum, and the like, which are contained in the process cartridge.

Heretofore, a provision of the cartridge is provided with an input electrical contact for electrical connection between the cartridge and the main assembly of the apparatus when the cartridge is mounted in place in the main assembly of the image forming apparatus. On the other hand, the main assembly of the apparatus is provided with an output contact. With this structure, when the cartridge is mounted to the main assembly of the apparatus, the input electrical contact is connected with the output contact. By doing so, the voltage can be supplied from the main assembly of the apparatus to the cartridge.

More particularly, the following structure is known.

A movable protection plate covering the contact member (the output contact) is provided in the main assembly of the apparatus. When the printer (image forming apparatus) is subjected to a maintenance operation, the operator and/or a tool is prevented from touching the contact member. By the inserting motion of the cartridge into the main assembly of the apparatus, the protection plate is retracted to a retracted position. By doing so, the electrical connection is permitted between the contact member in the main assembly of the apparatus and the contact member on the cartridge (input electrical contact) (paragraphs ([0012]–[0015], FIG. 1–FIG. 3 of Japanese Laid-open Patent Application Hei 7-77921).

When the unit is dismounted from the main assembly of the apparatus, a connector pin (output contact) is hidden inside a partition wall. By doing so, the serviceman or user is prevented from touching the connector pin. By the insertion of the unit into the main assembly of the apparatus, the connector pin enters the unit insertion space. Thus, the connector pin and connector portion of the unit (input electrical contact) are electrically connected (Japanese Laid-open Patent Application Sho 62-215278).

In addition, the drum shutter is provided with a regulating portion. The regulating portion is effective to cover the electrical contact (input electrical contact). By doing so, the contact defect which may be caused by deposition of foreign matter on the electrical contact, can be prevented. By the entering of the cartridge into the main assembly of the apparatus, the electrical contact of the cartridge and the electrical contact of the main assembly of the apparatus (output contact) are electrically connected. (Japanese Laid-open Patent Application Hei 10-74030).

A contact member (output contact) is provided and is movable between a retracted position and a regular position. By doing so, the contact portion of the cartridge (input electrical contact) and the contact member of the main assembly of the apparatus are contacted with each other in order. Before the cartridge is inserted into the main assembly of the apparatus, the contact member (output contact) is in the retracted position. When the cartridge is mounted to the main assembly of the apparatus, the contact member is moved to the regular position. By this, the contact portion and the contact portion are electrically connected with each other. (Japanese Laid-open Patent Application Hei 9-68833).

The present invention provides a further improvements in such structures.

Accordingly, it is a principal object of the present invention to provide a process cartridge and an electrophotographic image forming apparatus wherein when a process cartridge is mounted to the main assembly of the electrophotographic image forming electrical connection between an input electrical contact of the process cartridge and an output contact of the main assembly of the image forming apparatus.

It is another object of the present invention to provide a process cartridge and an electrophotographic image forming apparatus wherein damage of an electric circuit provided in the main assembly of the electrophotographic image forming apparatus can be prevented.

According to an aspect of the present invention, there is provided a process cartridge and an electrophotographic image forming apparatus which comprises a movable operation member movable relative to a cartridge frame, wherein after the process cartridge is mounted to the main assembly of the apparatus, the movable operation member is displaced by a driving force transmitted from the main assembly of the electrophotographic image forming apparatus to the process cartridge, so that movable operation member is engaged with a displaceable member provided in the main assembly of the electrophotographic image forming apparatus to move the displaceable member, in interrelation with which an output contact of the main assembly is moved from the retracted position to an electrical connecting position against an elastic force of the elastic function member, by which the assurance of establishment of electrical connection between the input electrical contact and the output contact is improved.

According to another aspect of the present invention, there is provided a process cartridge and an electrophotographic image forming apparatus which comprises a movable operation member movable relative to a cartridge frame, wherein after the process cartridge is mounted to the main assembly of the apparatus, the movable operation member is displaced by a driving force transmitted from the main assembly of the electrophotographic image forming apparatus to the process cartridge, so that the movable operation member is engaged with a displaceable member provided in the main assembly of the electrophotographic image forming apparatus to move the displaceable member, in interrelation with which an output contact is moved from a retracted position to an electrical connection position against an elastic force of an elastic function member provided in the main assembly of the apparatus, by which the damage of the electric circuit provided in the main assembly of the image forming apparatus is prevented.

It is a further object of the present invention to provide a process cartridge and an electrophotographic image forming apparatus wherein an output contact is moved relative to a stationary input electrical contact to establish the electrical connection therebetween, by which the electrical connection therebetween is assured.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The process cartridge and electrophotographic image forming apparatus according to the present invention will be described in conjunction with the accompanying drawings.

Embodiment 1

Figure 1:
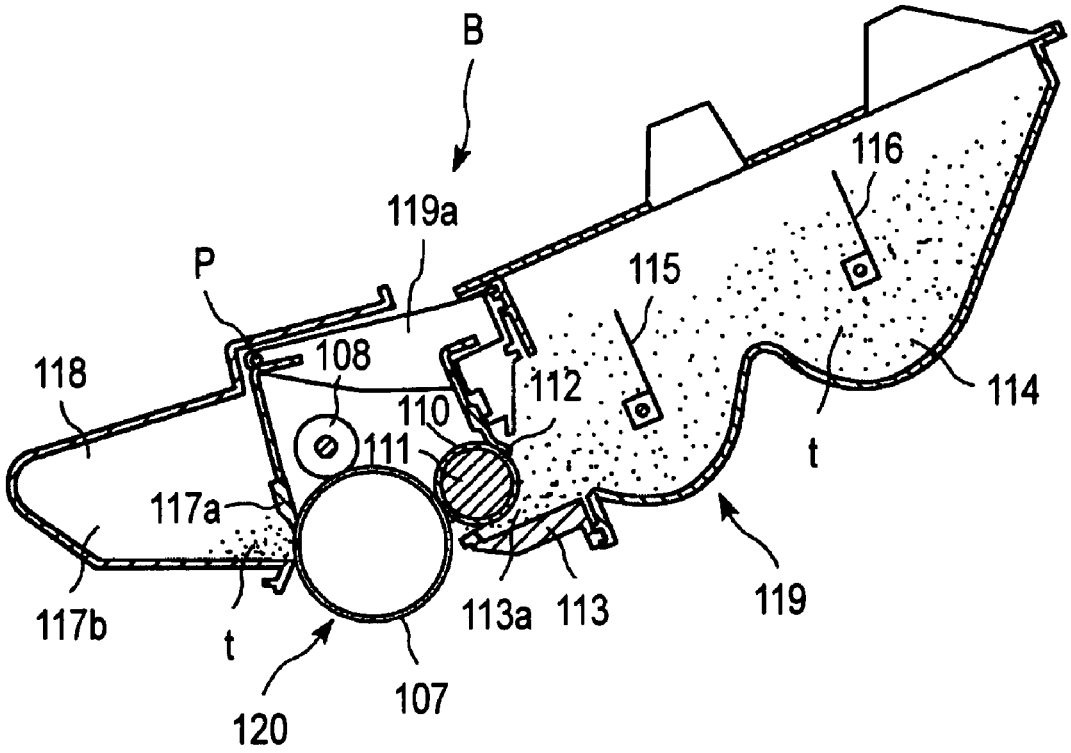
FIG. 1 is a sectional view of the process cartridge according to an embodiment of the present invention.

(1) General Structure of Process Cartridge:

Referring to FIG. 1, a process cartridge B (cartridge) according to a first embodiment of the present invention will be described. FIG. 1 is a sectional view of the cartridge B.

Figure 2:
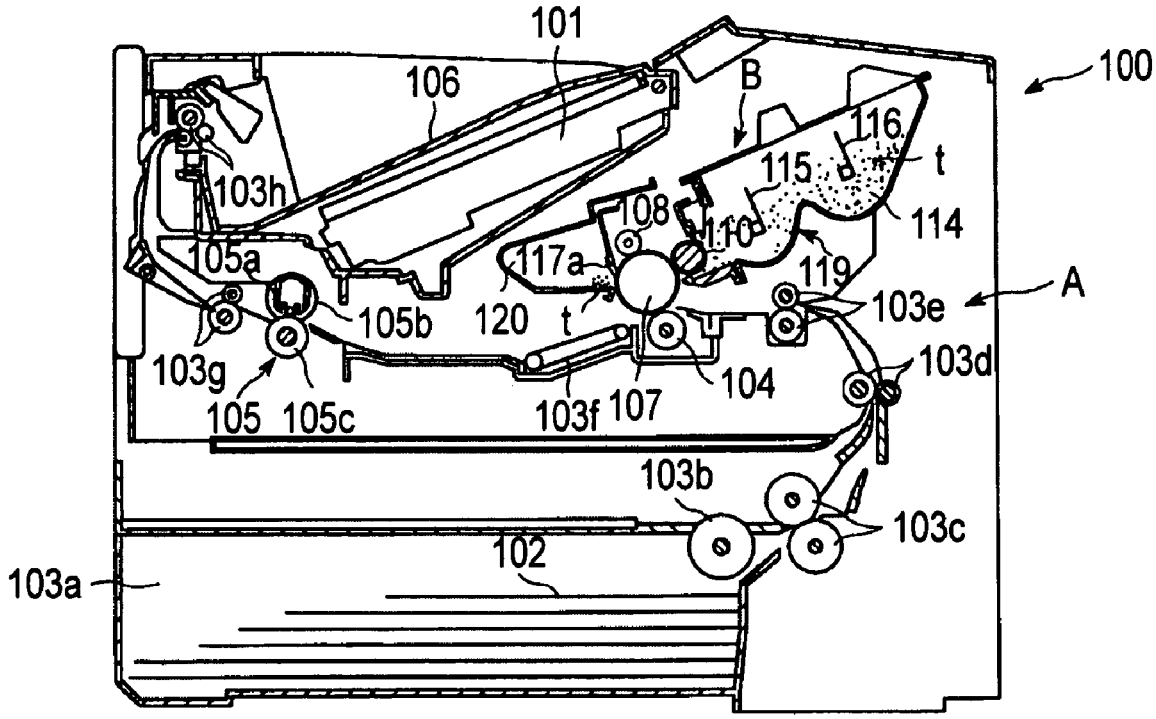
FIG. 2 illustrates a structure of an image forming apparatus according to an embodiment of the present invention.

In FIG. 1, the cartridge B comprises an electrophotographic photosensitive drum (photosensitive drum) 107. As shown in FIG. 2, when the cartridge B is mounted to the main assembly A of the electrophotographic image forming apparatus (main assembly of the apparatus), the photosensitive drum 107 is rotatable by receiving a driving force from the main assembly A.

Disposed opposed to an outer surface of the photosensitive drum 107 is a charging roller 108 functioning as a charging member. The charging roller 108 is supplied with a voltage from the main assembly A of the apparatus and electrically charges the photosensitive drum 107. The charging roller 108 is contacted to the photosensitive drum 107 and is rotated by the photosensitive drum 107.

When the cartridge B is mounted to the main assembly A of the apparatus, the charging roller 108 is supplied with a voltage from the main assembly 100 of the apparatus through a charging output contact 144*a* (FIG. 4) functioning as an output contact and a charging input electrical contact 141*a* (FIG. 10) functioning as an input electrical contact. The charging roller 108 functions by the voltage to electrically charge the photosensitive drum 107.

The cartridge B includes a developing roller 110 functioning as a developing member. The developing roller 110 supplies the developer t into a developing zone adjacent a photosensitive drum 107. The developing roller 110 develops an electrostatic latent image formed on the photosensitive drum 107 with the developer t. The developing roller 110 contains a magnet roller (stationary magnet) 111.

When the cartridge B is mounted to the main assembly A of the apparatus, the developing roller 110 is supplied with a voltage from the main assembly 100 of the apparatus through a development output contact (unshown) functioning as an output contact and a development input electrical contact (unshown) functioning as an input electrical contact. The developing roller 110 functions by the thus applied voltage to develop the electrostatic latent image.

To the peripheral surface of the developing roller 110, a developing blade 112 is contacted. The developing blade 112 functions to regulate an amount of the developer t deposited on the peripheral surface of the developing roller 110. The developing blade 112 also functions to triboelectrically charge the developer t.

The developer t accommodated in the developer accommodating container 114 is supplied out into the developer chamber 113*a* by rotation of the stirring members 115, 116. The developing roller 110 supplied with the voltage through the electrical contact 160*a* is rotated. By doing so, a layer of the developer having the triboelectric charge applied by the developing blade 112 is formed on the surface of the developing roller 110. The developer t is transferred onto the photosensitive drum 107 in accordance with the pattern of the latent image. Thus, the latent image developed.

The developed image on the photosensitive drum 107 is transferred onto a recording material 102 by a transfer roller 104.

Disposed opposed to the outer surface of the photosensitive drum 107 is an elastic cleaning blade 117*a*. The cleaning blade 117*a* has an edge which is contacted to the photosensitive drum 107. The blade 117*a* functions to remove the developer t remaining on the photosensitive drum 107 after transfer of the developed image onto the recording material 102. The developer t removed from the surface of the photosensitive drum 107 by the blade 117*a* is accommodated in a removed developer container 117*b*.

The cartridge B is constituted by the developing unit 119 and the drum unit 120.

The developing unit 119 is constituted by the developing device frame 113 which is a part of the cartridge frame B1. The developing unit 119 contains the developing roller 110, the developing blade 112, the developer chamber 113*a*, the developer accommodating container 114 and stirring members 115, 116. A development input electrical contact (unshown) is provided exposed from the developing device frame 113.

The drum unit 120 contains the photosensitive drum 107, the cleaning blade 117*a*, the removed developer container 117*b* and the charging roller 108. An electrical contact is provided on the drum frame 118 and is exposed.

One end of the photosensitive drum 107 is supported by the drum frame 118. An outer end of the drum shaft 139 functions as a cartridge guide 140L1 which will be described hereinafter referring to FIG. 7.

Figure 6:
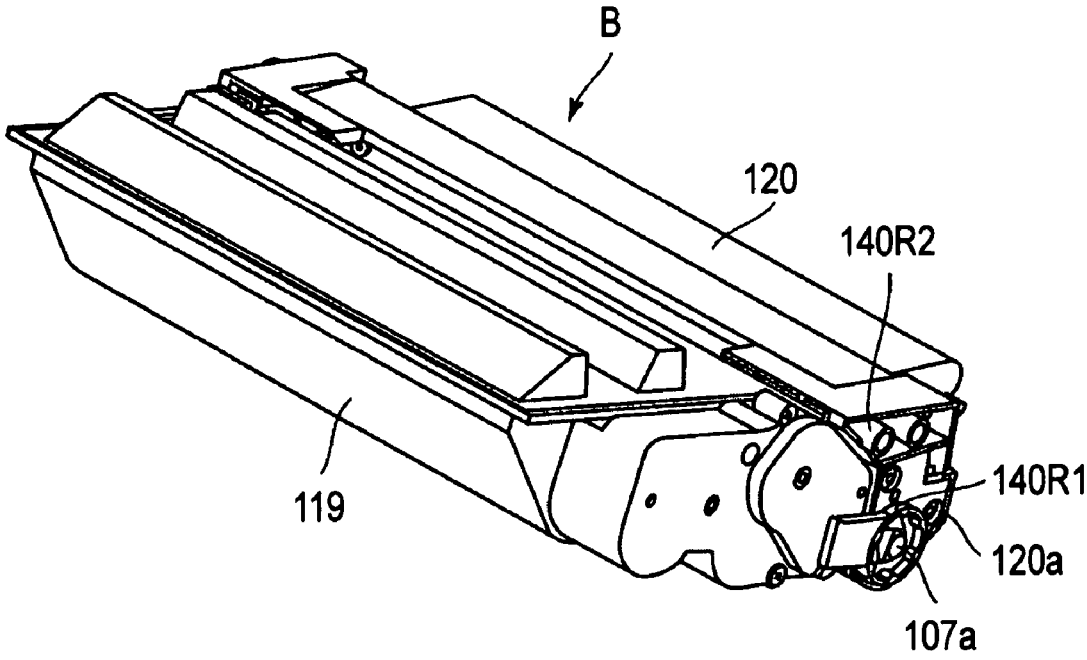
FIG. 6 is a perspective view of a process cartridge according to the embodiment of the present invention.
Figure 7:
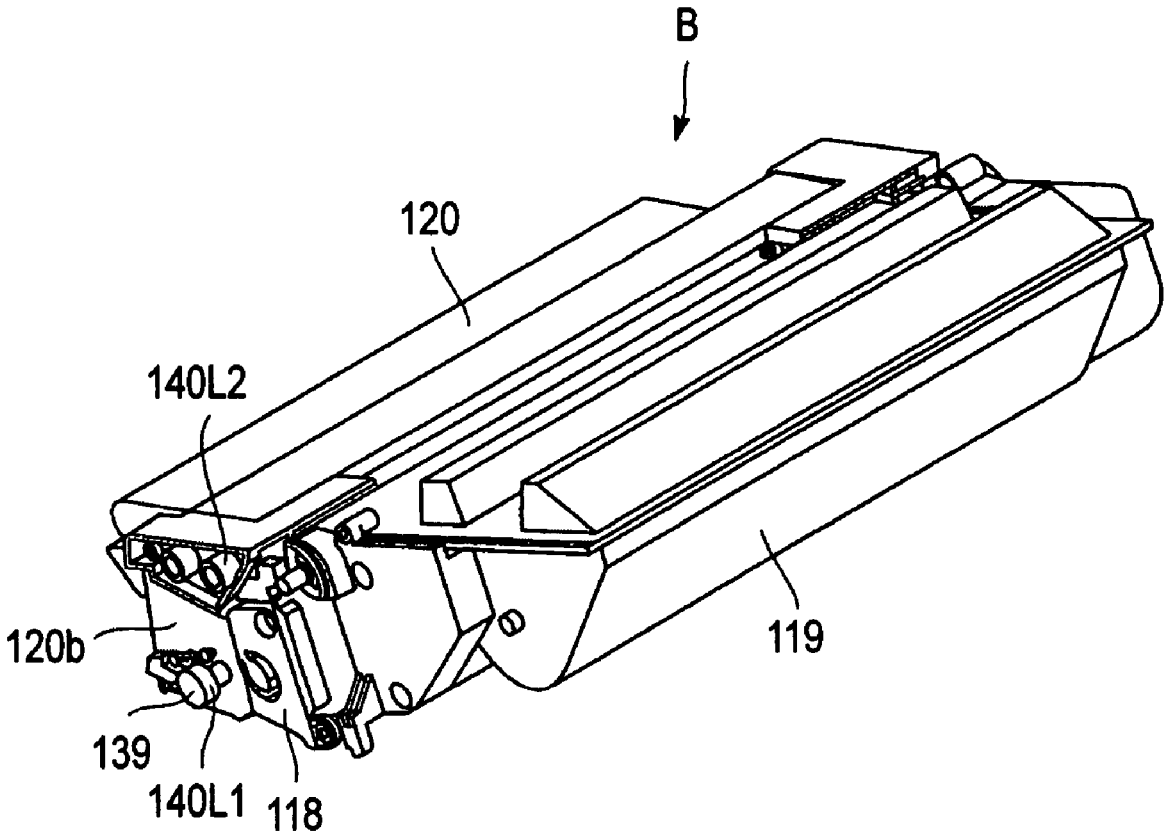
FIG. 7 is a perspective view of a process cartridge according to the embodiment of the present invention.

As will be understood from FIG. 6, cartridge guides 140R1, 140R2 are provided at one longitudinal end 120*a* of the drum unit 120. As shown in FIG. 7, a cartridge guide 140L1 and another cartridge guide 140L2 are provided at the other longitudinal end 120*b*.

The developing unit 119 and the drum unit 120 are rotatably coupled with each other by pins P (FIG. 1). The developing roller 110 is urged to the photosensitive drum 107 by elastic members 121, 122 (FIG. 8) which are provided between the units 119, 120. Designated by 119*a* is an arm which is provided in the developing unit 119. The arm 119*a* is engaged with the drum unit 120, too. A pin P is penetrated through holes formed in the units 119, 120.

Figure 8:
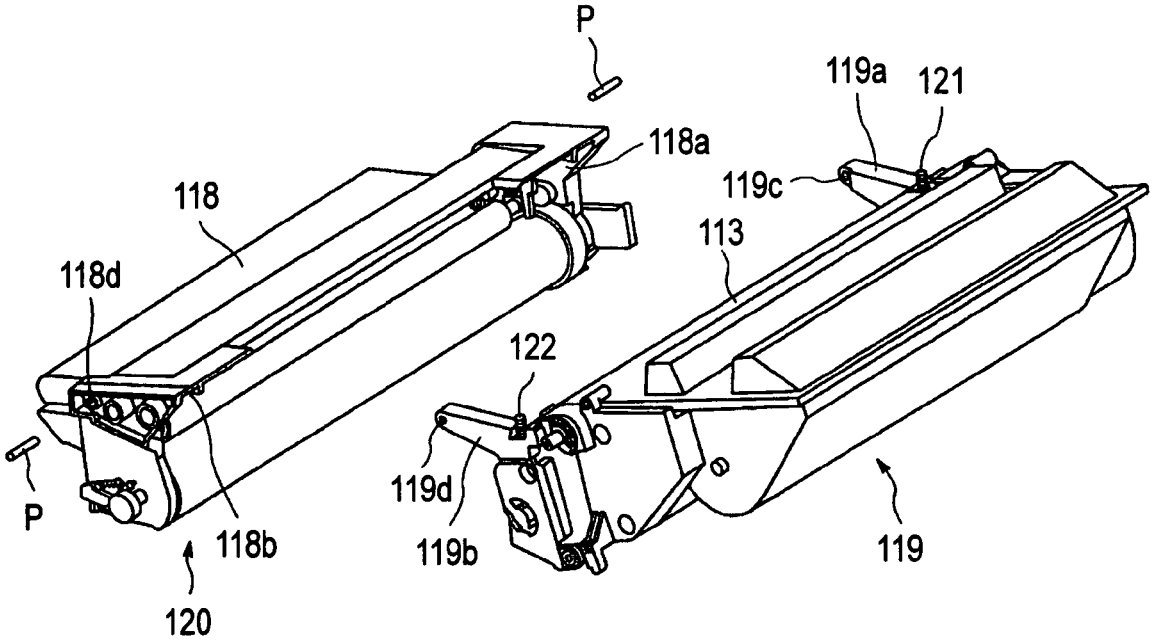
FIG. 8 is a perspective view wherein the developing unit and the drum unit are shown as being separated to illustrate the structures of the process cartridge of the embodiment of the present invention.
Figure 9:
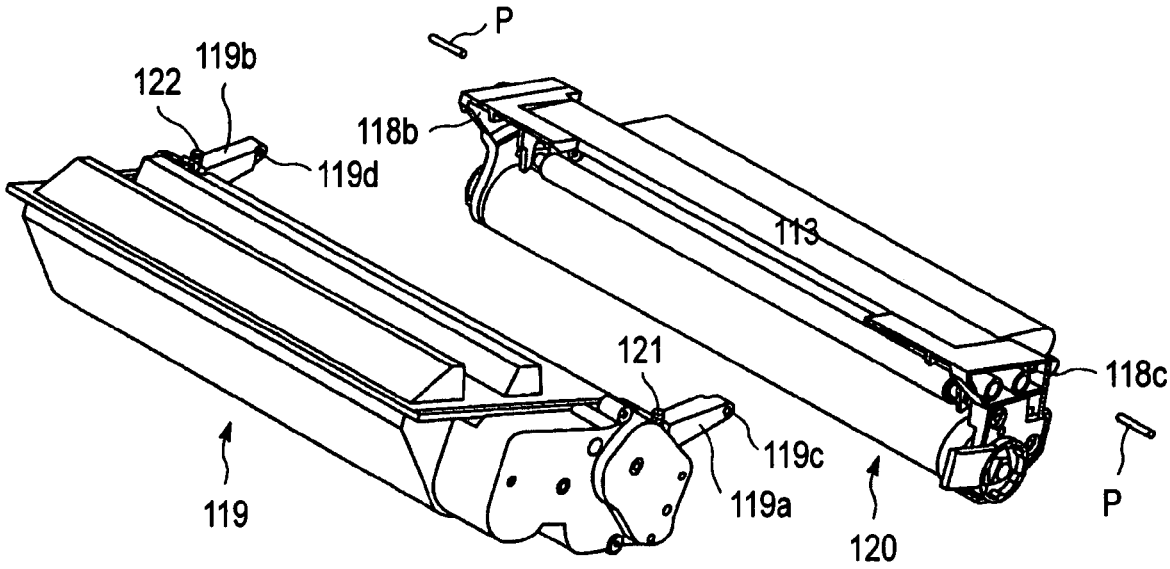
FIG. 9 is a perspective view wherein the developing unit and the drum unit are shown as being separated to illustrate the structures of the process cartridge of the embodiment of the present invention.

Referring to FIGS. 8 and 9, a more detailed description will be provided. Free ends of arm portions 119*a*, 119*b* are provided adjacent longitudinally opposite end portions of the developing device frame 113, and are provided with circular rotation holes 119*c*, 119*d* extending parallel with developing roller 110. At two positions of the longitudinal ends of the drum frame 118, recesses 118*a*, 118*b* are provided to receive the arm portion 119*a*, 119*b*. The arm portions 119*a*, 119*b* are inserted into recesses 118*a*, 118*b*. Then, coupling members, namely, pins P are inserted into mounting holes 118*c*, 118*d* of the drum frame 118. In addition, pins P are engaged into the rotation holes 119*c*, 119*d* of the arm portions 119*a*, 119*b*. Then, in the pins P are press-fitted into holes (unshown) formed inside of the drum frame 118. In this manner, the pins P are mounted. By doing so, the drum unit 120 and the developing unit 119 are rotatably coupled by the pins (coupling members) and therefore, they are rotatable about the pins. In this case, compression coil springs 121, 122 mounted to the base portions of the arm portion 119*a*, 119*b* abut upper walls of the recesses 118*a*, 118*b* of the drum frame 118. By this, the developing unit 119 is urged downwardly by the elastic force provided by the springs 121, 122. In this manner, the developing roller 110 is assuredly press against the photosensitive drum 107.

(2) Electrophotographic Image Forming Apparatus.

Referring to FIG. 2, a description will be provided as to the electrophotographic image forming apparatus 100 with which the cartridge B is usable. FIG. 2. Shows a general arrangement of an electrophotographic image forming apparatus (image forming apparatus) 100.

A description will be provided as to a laser beam printer which is an exemplary image forming apparatus 100.

In the image forming operation, a surface of the photosensitive drum 107 is uniformly charged by the charging roller 108. A laser beam is emitted from a laser diode and is projected onto the photosensitive drum 107 in accordance with image information with optical means 101 including a polygonal mirror, lenses and deflection mirrors (unshown). By doing so, an electrostatic latent image is formed on the photosensitive drum 107 corresponding to the image information. The latent image is developed by the developing roller 110 which has been described hereinbefore.

On the other hand, in synchronism with the formation of the developed image, a recording material 102 in a cassette 103*a* is fed out by pick-up roller 103*b* and is fed to a transfer position by feeding rollers 103*c*, 103*d*, 103*e*. At the transfer position, a transfer roller 104 (transferring means) is provided. The transfer roller 104 is supplied with a voltage. By this, the developed image formed on the photosensitive drum 107 is transferred onto the recording material 102.

The recording material 102 now having the developed image transferred thereto is fed to fixing means 105 through a guide 103*f*. The fixing means 105 includes a driving roller 105*c* and a fixing roller 105*b* containing a heater 105*a* therein. The fixing means 105 applies heat and pressure to the recording material 102 passing therethrough to fix the developed image on the recording material 102. The recording material 102 is fed by a pair of rollers 103*g* and 103*g* onto a tray 106. The roller 103*b*, the pair of feeding rollers 103*c*, 103*d*, 103*e*, the guide 103*f*, the pair of rollers 103*g*, 103*h* and so on constitute feeding means for the recording material 102.

The cartridge B is mounted into or demounted from the main assembly A of the apparatus in the following manner.

Figure 3:
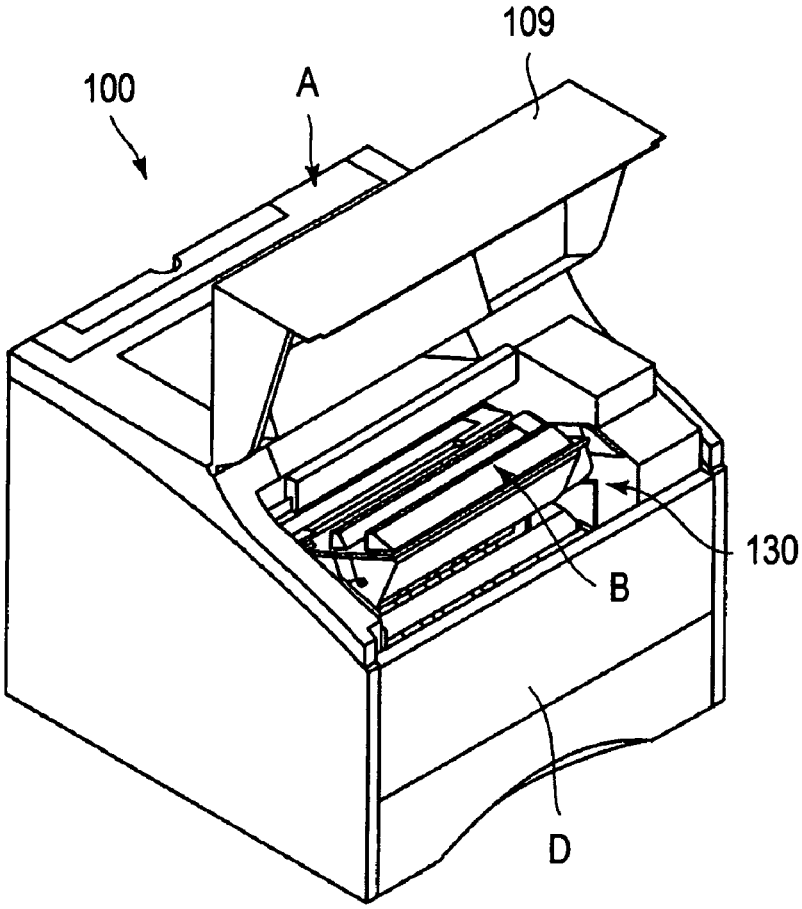
FIG. 3 is a perspective view of the image forming apparatus according to the embodiment of the present invention.

As shown in FIG. 3, the operator opens a door 109 provided in the main assembly A of the apparatus. The cartridge B is demountably mounted to cartridge mounting means 130 provided in the main assembly A of the apparatus.

Figure 4:
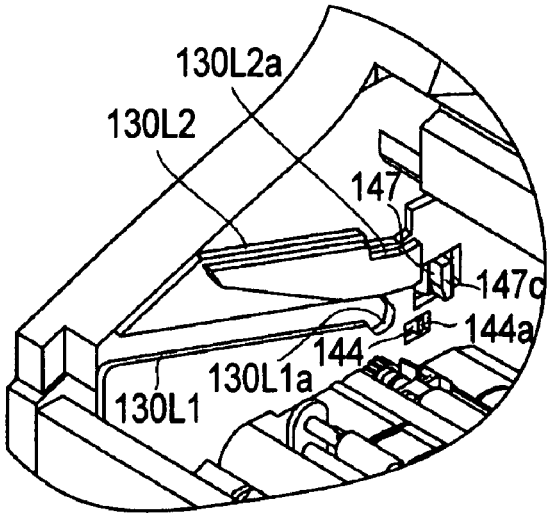
FIG. 4 shows a mounting portion of the main assembly of the apparatus to accept the process cartridge according to the embodiment of the present invention.
Figure 5:
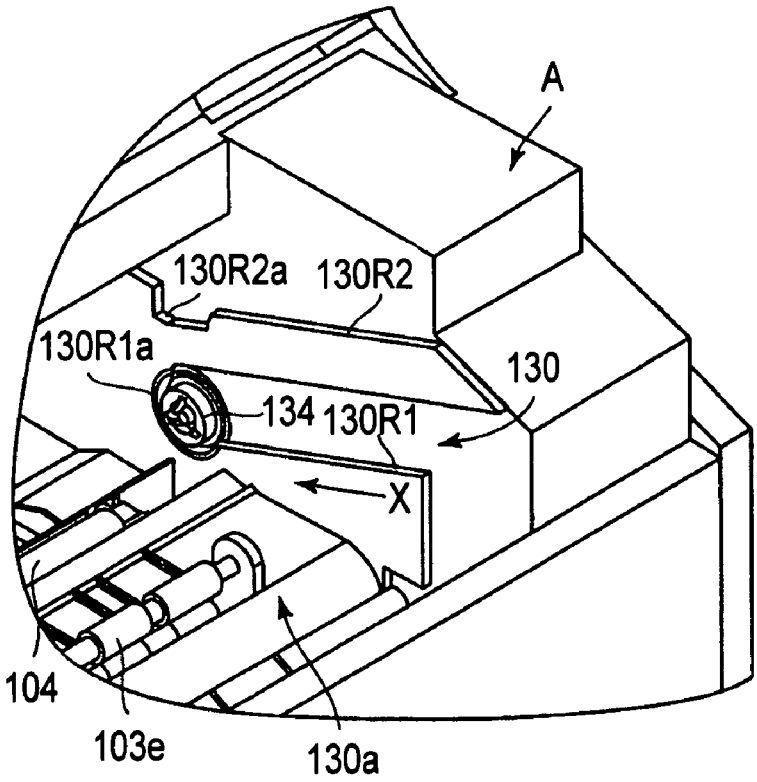
FIG. 5 shows a mounting portion of the main assembly of the apparatus to accept the process cartridge according to the embodiment of the present invention.

As shown in FIGS. 4 and 5, the mounting means 130 of this embodiment includes main assembly guides 130R1, 130R2, 130L1, 130L2 in the main assembly A of the apparatus. When the cartridge B is mounted to the main assembly A of the apparatus, it is inserted toward the cartridge mounting portion 130*a* such that cartridge guides 140R1, 140R2 (FIG. 6) are guided by the main assembly guides 130R1, 130R2, and the cartridge guides 140L1, 140L2 (FIG. 7) are guided by the main assembly guides 130L1, 130L2.

The cartridge guide 140R1 is engaged with the positioning portion 130R1*a* of the main assembly guide 130R1, and the cartridge guide 140R2 is abutted to the positioning portion 130R2*a* of the main assembly guide 130R2. The cartridge guide 140L1 is engaged with the positioning portion 130L1*a* of the main assembly guide 130L1, and the cartridge guide 140L2 is abutted to the positioning portion 130L2*a* of the main assembly guide 130L2. At this time, the cartridge B is demountably mounted to the cartridge mounting portion 130*a* by the mounting means 130. By the cartridge B mounted in place in the cartridge mounting portion 130*a*, the image forming operation is enabled. Here, the cartridge mounting portion 130*a* is the space occupied by the cartridge B which is mounted in place to the main assembly A of the apparatus by the mounting means 130.

When the cartridge B is mounted, a coupling 134 (FIG. 5) functioning as a driving force transmitting portion is at a retracted position, so that it does not interfere with the cartridge B which is being inserted for mounting. When the cover 109 is closed, the coupling 134 provided in the main assembly A of the apparatus is brought into engagement with a coupling 107*a* (FIG. 6) of the coupling 107*a* of the cartridge B functioning as a driving force receiving portion. Then, the process cartridge is capable of receiving a driving force for rotating the photosensitive drum 107 from the main assembly A of the apparatus.

Figure 10:
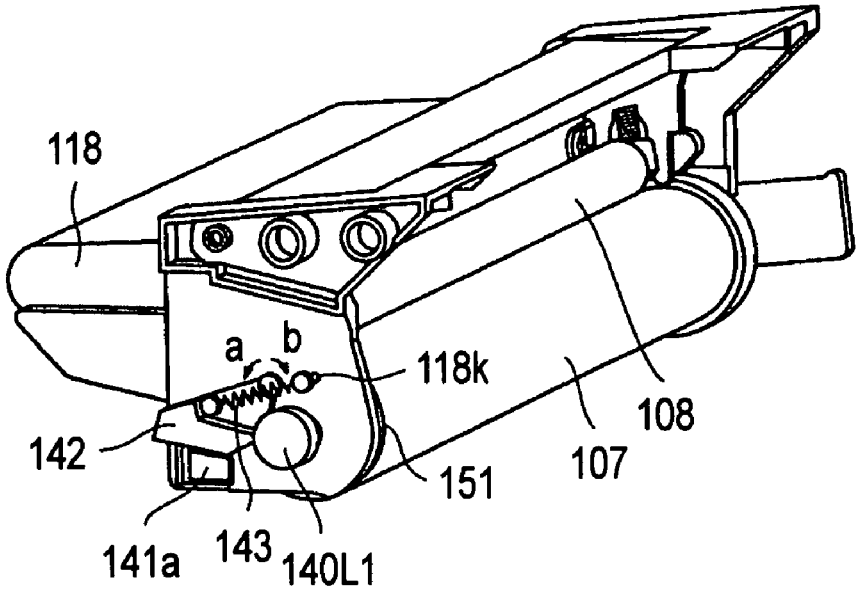
FIG. 10 illustrates a structure of a drum unit of the process cartridge according to an embodiment of the present invention.

(3) Cartridge Charging Contact Member:

As shown in FIG. 10, the drum unit 120 is provided with the input electrical contact member (input electrical contact member) 141 for receiving a charging voltage to be supplied to the charging roller 108 from the main assembly A of the apparatus. The cartridge charging contact member 141 is mounted to the drum frame 118. More particularly, the charging contact member 141 has a contact 141*a* on a side surface of the drum frame 118 to establish an electrical connection with the output contact member in the main assembly A of the apparatus, that is, an electrical contact (output contact) 144*a* (FIGS. 13(*a*) and 13(*b*)) of the main assembly charging contact member 144. The other end portion of the cartridge charging contact member 141 is electrically connected with the charging roller 108 inside the drum unit 120.

Figure 11:
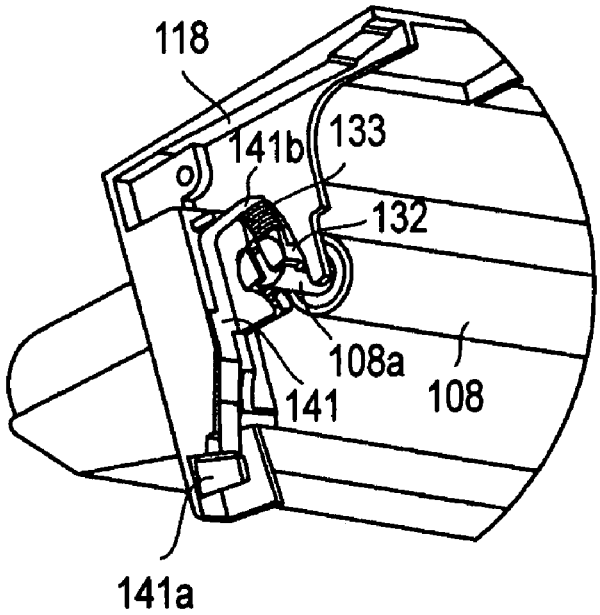
FIG. 11 illustrates a structure of a drum unit of the process cartridge according to an embodiment of the present invention.

FIG. 11 is a perspective view wherein a side of the drum frame 118 has been removed so that inside of the drum frame 118 can be seen. As shown in the figure, the charging roller 108 has a metal shaft 108*a* which is rotatably supported by charging roller bearings 132 molded from electroconductive resin material. The charging roller 108 is mounted in the drum frame 118. Between the charging roller bearing 132 and the drum frame 108, there is provided a charging roller pressing spring 133. The spring 133 urges the charging roller 108 to the photosensitive drum 107 with a predetermined force.

The charging contact member 141 is in the form of a metal plate having an electrical contact 141*a* for electrical contact to the contact 144*a* provided in the main assembly of the apparatus, and a contact 141*b* for contact to the spring 133. The (charging contact member 141) is mounted to the drum frame 118. Therefore, the contact 141*a* is electrically connected with a charging roller 108 through the contact 141*b*, the spring 133, the charging roller bearing 132 and the metal shaft 108*a*.

The electrical contact 141*a* is surrounded by a rib 118*g* so as not to project beyond the side surface of the drum frame 118.

Figure 12:
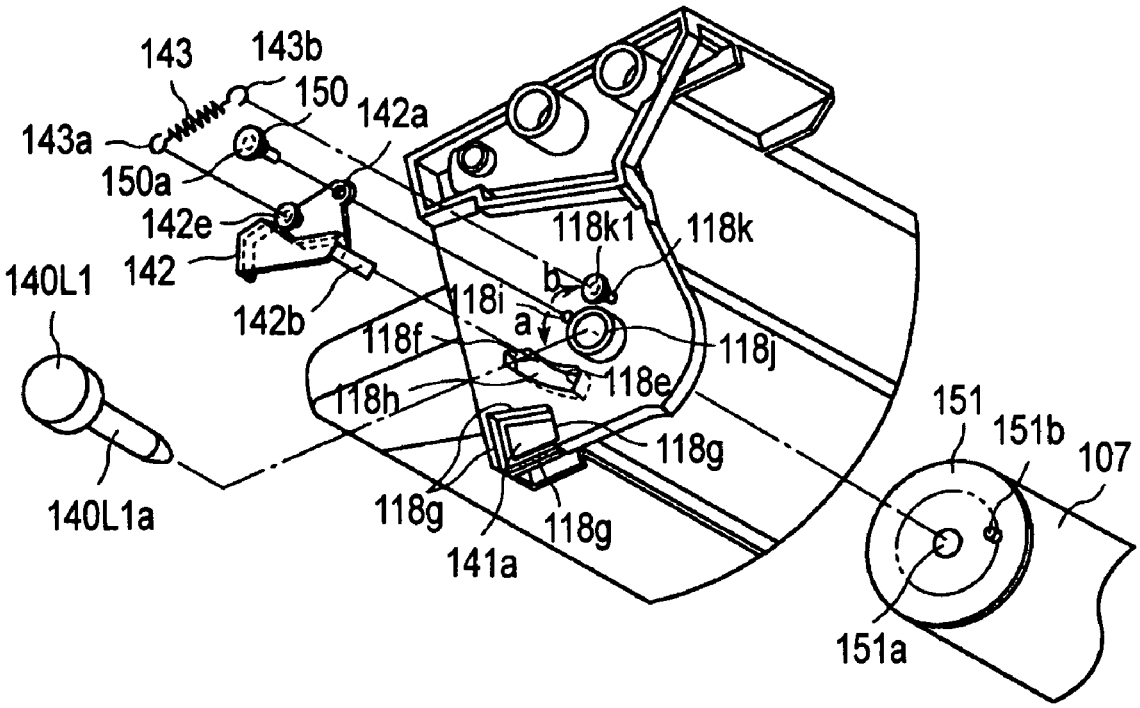
FIG. 12 illustrates a structure of a movable operation member of the process cartridge according to the embodiment of the present invention.
Figure 19:
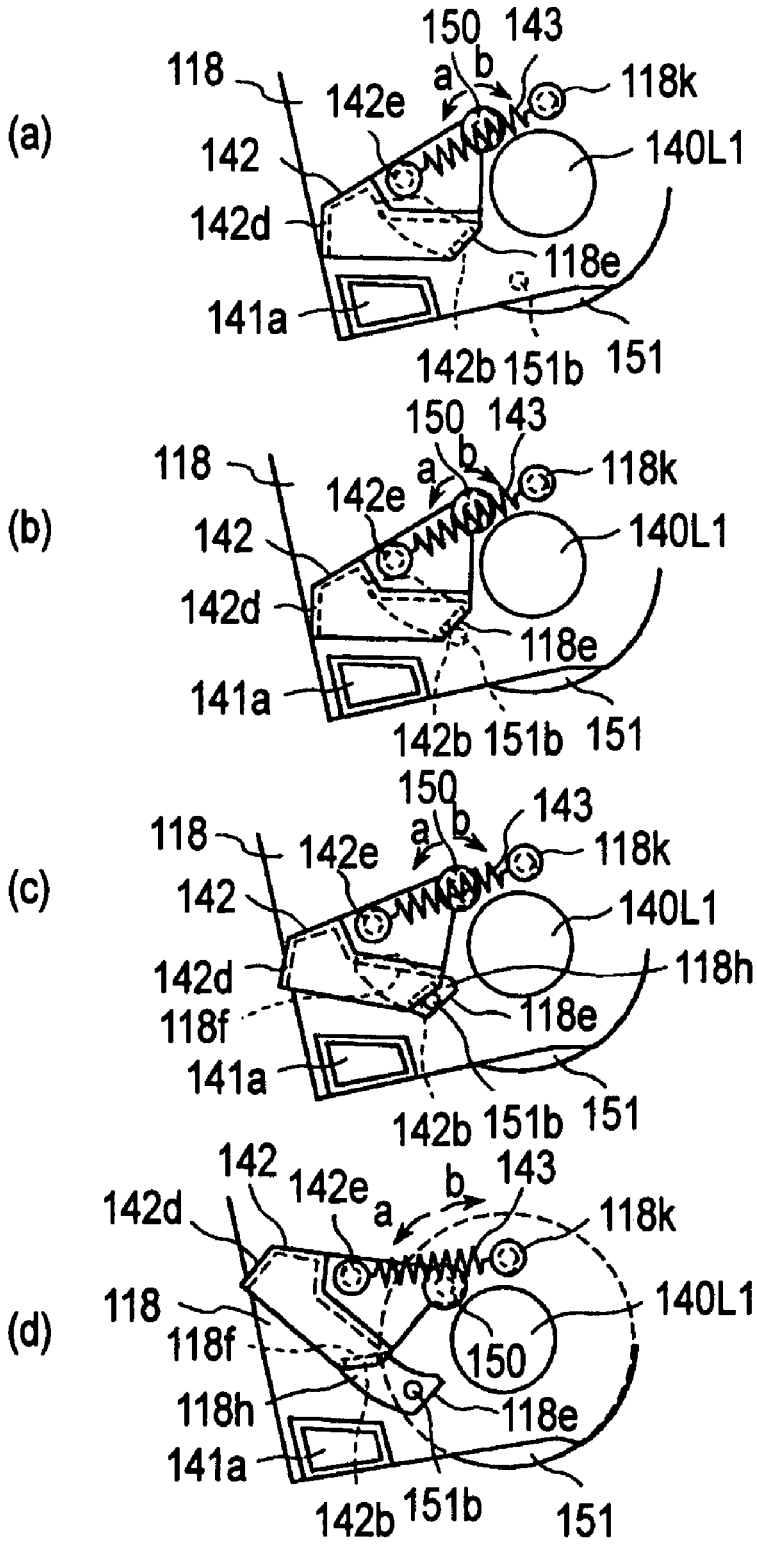
FIGS. 19(*a*)–19(*b*) are side views illustrating a major part of a movable operation member of a process cartridge according to an embodiment of the present invention.
Figure 20:
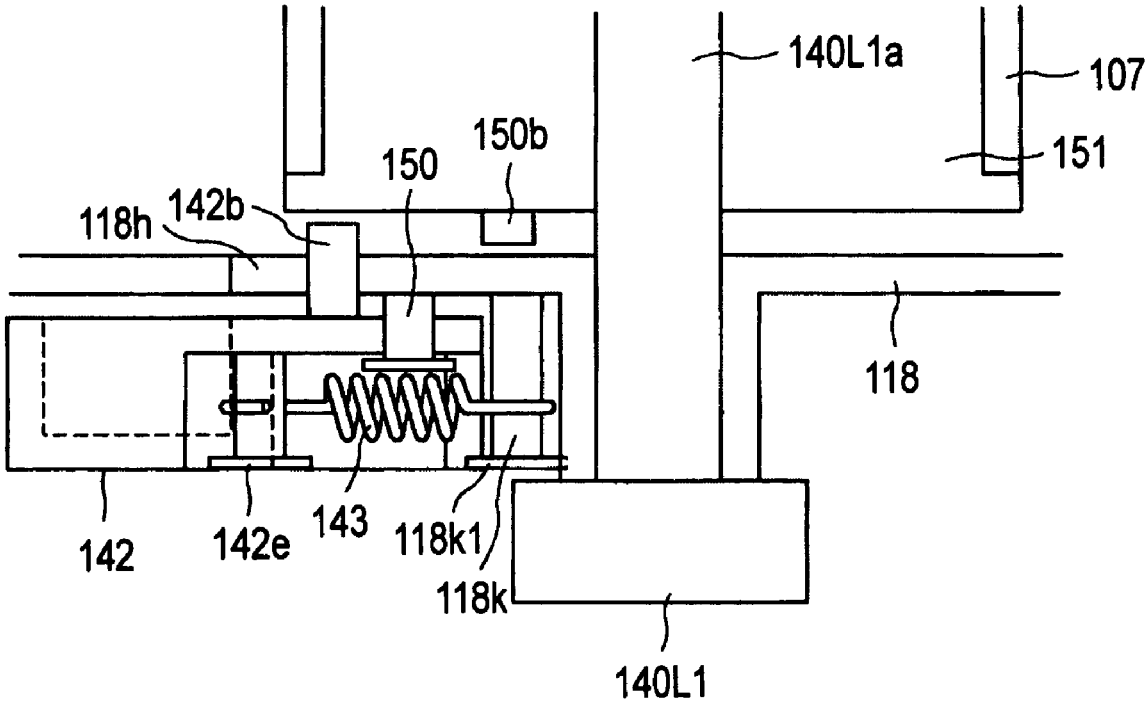
FIG. 20 is a partly broken top plan view illustrating a structure of a movable operation member of a process cartridge according to an embodiment of the present invention.

(4) Cartridge Movable Member:

Referring to FIGS. 10, 12, 19 and 20, a description will be provided made as to the movable operation member (cartridge movable member 142) of the cartridge B. FIG. 12 illustrates a mounting method of the cartridge movable member 142 or the like to the drum frame 118, and FIG. 10 shows the state after the mounting through the method illustrated in FIG. 10. FIGS. 19(*a*)–19(*d*) are side views of a major part of the movable member 142. FIG. 20 is a partly sectional view of a major part of the movable member 142.

First, the structure will be described briefly.

The movable member 142 uses a so-called toggle action. More particularly, when even a small degree of deviation occurs from a balanced position determined by a spring, the member is urged in the direction of increasing the deviation. The motion for movement from the stable position beyond the balanced position is effected by an eccentricity shaft 151*b* provided on a flange 151 which is movable integrally with the photosensitive drum 107 (FIG. 12).

As shown in FIG. 12, the flange 151 is fixed to the end of the photosensitive drum 107. The flange 151 is provided with a hole portion 151*a*. A small diameter portion 140L1*a* of a cartridge guide cylindrical portion 140L1 is penetrated through a drum supporting hole 118*j* provided in the drum frame 118. Then, the small diameter portion 140L1*a* is engaged into the hole portion 151*a* of the flange 151. The dimensions of the small diameter portion 140L1*a* and the drum supporting hole 118*j* are determined so as to provide press-fitting therebetween. By doing so, the cylindrical portion 140L1 is securedly fixed to the drum frame 118. In addition, the flange 151 is provided with an eccentricity shaft 151*b*. Therefore, the flange 151 is rotatable about the small diameter portion 140L1*a* together with rotation of the photosensitive drum 107.

As shown in FIG. 12, a hole 142*a* of the movable member 142 is penetrated by a retaining shaft 150 in the form of axially connected circular columns having different diameters (stepped shaft). The retaining shaft 150 is press-fitted into a retaining hole 118*i* formed in a side surface of the drum frame 118. Thus, the movable member 142 is mounted for rotation about the retaining shaft 150. The retaining shaft 150 has a large diameter portion 150*a* for retaining the movable member 142. When the movable member 142 is assembled, the abutting portion 142*b* is inserted into the opening 118*h* provided in the side surface of the drum frame 118. Therefore, the rotation range of the movable member 142 is defined by abutment of the abutting portion 142*b* to the abutting portion 118*e* in the direction of arrow an and by abutment of the abutting portion 142*b* to the abutting portion 118*f* in the direction of arrow b. In this manner, the rotation range of the movable member 142 is limited. The abutting portions 118*e*, 118*f* are provided on the drum frame 118.

The abutting portion 142*b* is extended through the opening 118*h* further inwardly. As shown in FIG. 20, the degree of the projection thereof is such that it is overlapped with the eccentricity shaft 151*b* of the flange 151 in the axial direction of the photosensitive drum 107. The eccentricity shaft 150*b* and the movable member 142 move while engaging with each other, and the movement will be described hereinafter.

One end 143*a* of a tension coil spring 143 (elastic function member) is hooked with a spring supporting pin portion 142*e* of the movable member 142, and the other end 143*b* thereof is mounted to a projected shaft 118*k* on the side surface of the drum frame 118. FIG. 20 shows the spring supporting pin portion 142*e* and the projected shaft 118*k*, which has a large diameter portion 118*k*1 having a diameter larger than the outer diameter of the spring 143 at the outside of the portion where the spring 143 is hooked. By this, the spring 143 is securedly retained. When the movable member 142 moves within the movable range, the spring 143 always produces a force in a direction of compression by maintaining the spring 143 in a sufficiently expanded state.

(5) Operation of Cartridge Movable Member 142.

Referring to FIGS. 19(*a*)–(*d*) and 20, a description will be provided made as to motions of the movable member 142 and the flange 151 after they are assembled.

First, the toggle function will be described.

In FIGS. 19*a*) and 19(*b*), the center of rotation of the movable member 142 (the center of the retaining shaft 150) is disposed above a line connecting the center of the portion 142*e* and the center of the projected shaft 118*k*. Therefore, in this state, the movable member 142 is urged in the direction of arrow a by the moment provided by the spring force of the spring 143. The abutting portion 142*b* indicated by broken lines in FIGS. 19(*a*)–19(*d*), abuts the abutting portion 118*e* of the drum frame 118. By this, the position of the movable member 142 in the rotational direction is determined. FIG. 19(*a*) shows the same state as FIG. 10.

In FIG. 19(*c*), the center of rotation of the movable member 142 (the center of the supporting shaft 150) is on a line connecting the center of the spring supporting portion 142*e* and the center of the projected shaft 118*k*. Therefore, in the state, no moment is produced by the spring force in the direction of rotating the movable member 142 about the center of rotation (the center of the shaft 150). This is the balanced state position. In that state, the abutting portion 142*b* is not contacted to any of said abutting portions 118*e*, 118*f*.

In FIG. 19(*d*), the center of rotation of the movable member 142 (the center of the shaft 150) is below a line connecting the center of the spring supporting portion 142*e* and the center of the projected shaft 118*k*. Therefore, the movable member 142 is urged in the direction of arrow b by the moment provided by the spring force. The abutting portion 142*b* abuts the abutting portion 118*f* of the drum frame 118. By doing so, the movable member 142 is determined in the position in the rotational direction.

A description will be provided as to the motion of the movable member 142 by the rotation of the photosensitive drum 107.

As shown in FIG. 19(*a*), the eccentricity shaft (projection) 151*b* (indicated by broken lines in FIGS. 19(*a*) and 19(*b*)) of the flange 151 positioned away from the abutting portion 142*b*, is rotated in interrelation with the clockwise rotation, in the figure, of the photosensitive drum 107 by a driving force supplied from the main assembly of the apparatus A. In this manner, the eccentricity shaft 151*b* rotates together with the photosensitive drum 107. As shown in FIG. 19(*b*), the eccentricity shaft 151*b* moves to a position where it is contacted to the abutting portion 142*b*. The eccentricity shaft 151*b* in the form of a projection is projected in the direction of the drum shaft line from the flange 151 which is integral with the photosensitive drum 107.

When the photosensitive drum 107 rotates further, the movable member 142 is pushed by the eccentricity shaft 151*b* to rotate in the direction of arrow b. As described hereinbefore, the movable member 142 reaches the balanced position shown in FIG. 19(*c*). When the photosensitive drum 107 rotates further, the movable member 142 is pushed by the eccentricity shaft 151*b* and rides over the balanced position (FIG. 19(*d*)). The movable member 142 which has come beyond the balanced position, rotates in the direction of arrow b by the elastic force of the spring 143 until the abutting portion 142*b* abuts the abutting portion 118*f* to stop there (FIG. 19(*d*)). In the state, even if the photosensitive drum 107 rotates further, the abutting portion 142*b* is outside the region passing of the eccentricity shaft 151*b*, and therefore, it is not brought into contact. For this reason, the movable member 142 maintains the state shown in FIG. 19(*d*).

In other words, the operation member 142 is movable about the center of the shaft 150 relative to the drum frame 118 as the cartridge frame. By the driving force transmitted from the main assembly A of the apparatus to the cartridge B, the photosensitive drum 107 is rotated. The driving force is transmitted to the operation member 142 by the rotation of the photosensitive drum 107. By doing so, the operation member 142 is rotated relative to the drum frame 118. In addition, the spring 143 is provided to apply the elastic force to the operation member 142. The elastic force is contributable to the rotation of the operation member 142. More particularly, the operation member 142 is rotated by being pushed by the eccentricity shaft 151*b* in the form of a projection provided on the photosensitive drum 107 which is rotated by the driving force. The operation member 142 is pushed by the eccentricity shaft 151*b* and rotated beyond the balanced position, and then, it goes away from the eccentricity shaft 151*b* (FIG. 19(*d*)). Then, the spring 143 starts rotating by the elastic force of the spring 143. By the series of rotating operations of the operation member 142, the electrical contact 144*a* is moved from the retracted position to the electrical connection position.

(6) Charging Contact Provided in Main Assembly of Apparatus A:

A description will be provided as to the main assembly charging contact member 144 (output contact member) provided in the main assembly A of the apparatus.

Figure 13:
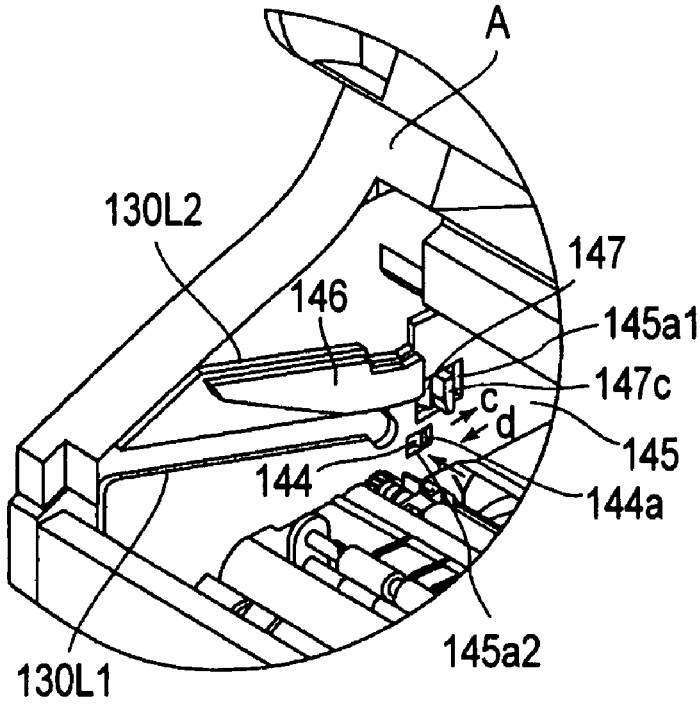
FIGS. 13(*a*) and 13(*b*) are perspective views showing a structure of an electrical contact provided in main assembly of the image forming apparatus according to an embodiment of the present invention.
Figure 13:
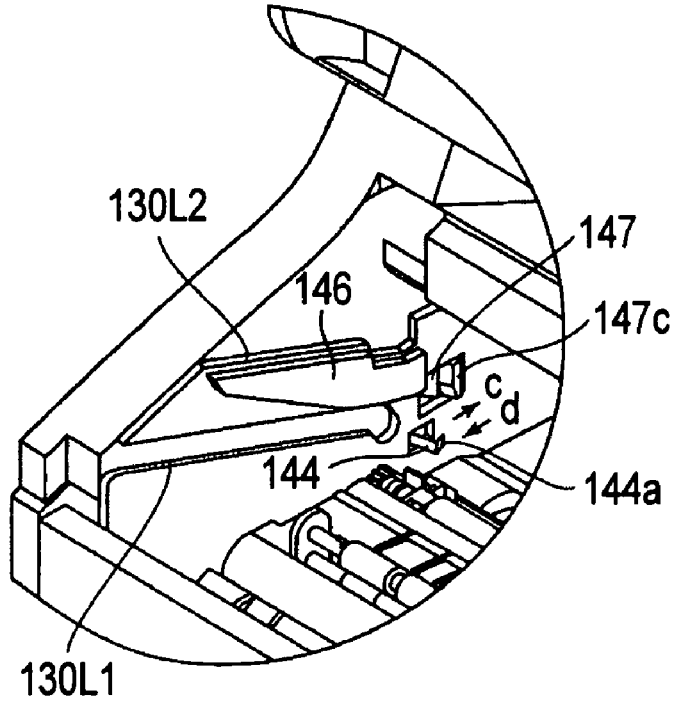

As shown in FIGS. 13(*a*) and 13(*b*), inside the main assembly A of the apparatus, there is provided a main assembly charging contact member 144 for applying the charging bias voltage by contact to the contact 141*a* of the cartridge charging contact member 141 (input electrical contact member of the cartridge B). When the cartridge B is not mounted to the main assembly of the apparatus A, the contact 144*a* of the main assembly charging contact member 144 is in a retracted position where it is not projected from the inner side plate 145 of the main assembly of the apparatus A. The main assembly charging contact member 144 is electrically connected to a high voltage electric circuit which will be described hereinafter and which is provided in the main assembly A of the apparatus by lead or the like.

Inside the main assembly A of the apparatus, a fixed member 146 is projected from the inner side plate 145. The fixed member 146 is abutted by the movable member 142 when the cartridge B is removed from the main assembly of the apparatus A. Thus, the fixed member 146 functions as an abutting portion for rotating the movable member 142 beyond the balanced position to the original position. One end portion 147*c* of the main assembly movable member 147 is projected at a position downstream of the fixed member 146 with respect to the mounting direction of the cartridge B. The fixed member 146 is not contacted by the movable member 142 when the cartridge B is mounted to the main assembly A of the apparatus. Therefore, the fixed member 146 does not rotation the movable member 142 at that time.

The main assembly movable member 147 moves in the directions of the arrows c, d in interrelation with the rotating operation of the cartridge movable member 142. As shown in FIG. 13(*b*), when the photosensitive drum 107 rotates, after the cartridge B is mounted into the main assembly A of the apparatus and the apparatus is ready for the image forming operation, the main assembly movable member 147 is pushed in the direction of the main assembly A of the apparatus by the movable member 142. In interrelation with the operation of the main assembly movable member 147, the charging contact 144*a* rotationally moves out of the inner side plate 145 toward the mounting portion 130*a*. The contact 144*a* is brought into contact to the contact 141*a* of the cartridge B. In this manner, the charging roller 108 is able to receive a voltage from the main assembly A of the apparatus. More particularly, while the contact 144*a* is making a rotational motion, it is contacted to the contact 141*a* which is in a stand-by state and is stationary at the electrical contact position. The contact 144*a* is contacted to the contact 141*a*, and thereafter, it slides on the contact 141*a*. Therefore, foreign matter such as dust, developer or the like can be removed by the wiping action by the sliding. For this reason, the establishment of the electrical connection between the contacts is improved.

(7) Internal Structure of Main Assembly A of Apparatus.

Figure 14:
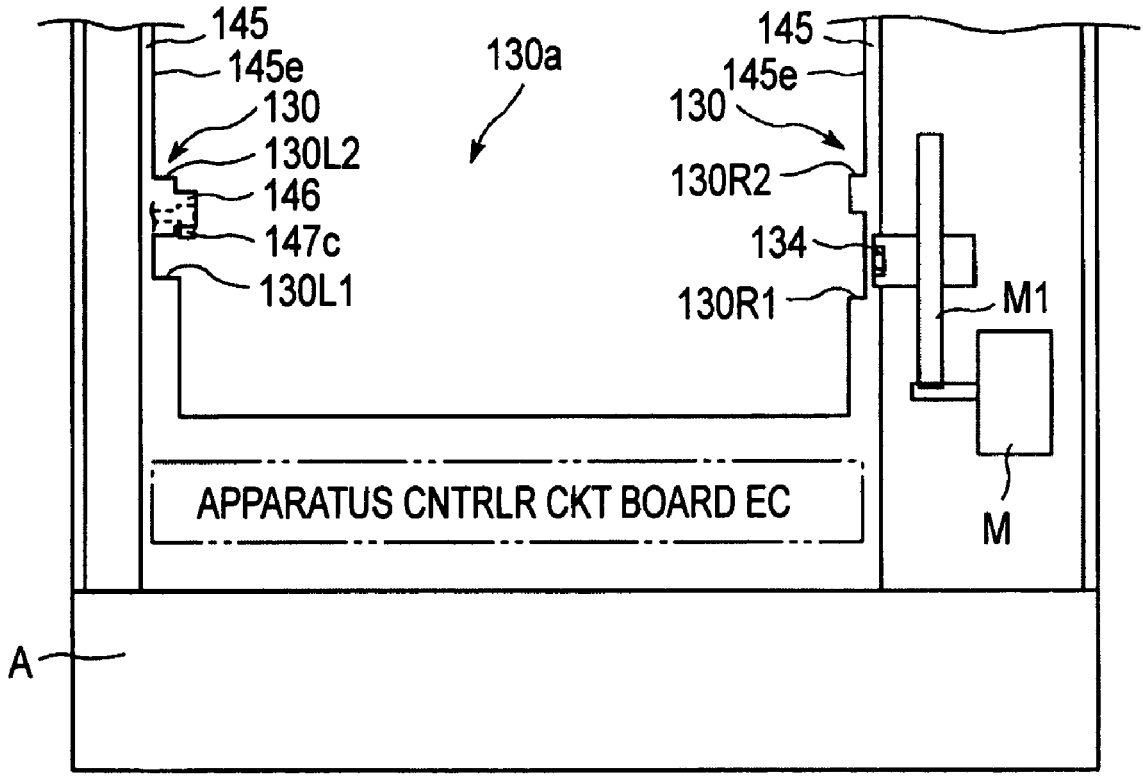
FIG. 14 illustrates a structure of a mounting portion provided in the main assembly of the image forming apparatus according to the embodiment of the present invention.

Referring to FIG. 14, a description will be provided as to the internal structure of the main assembly A of the apparatus. FIG. 14 is a front view of the inside of the main assembly A of the apparatus as seen from the front side D, that is, in the direction of mounting the cartridge B (FIG. 3).

Figure 21:
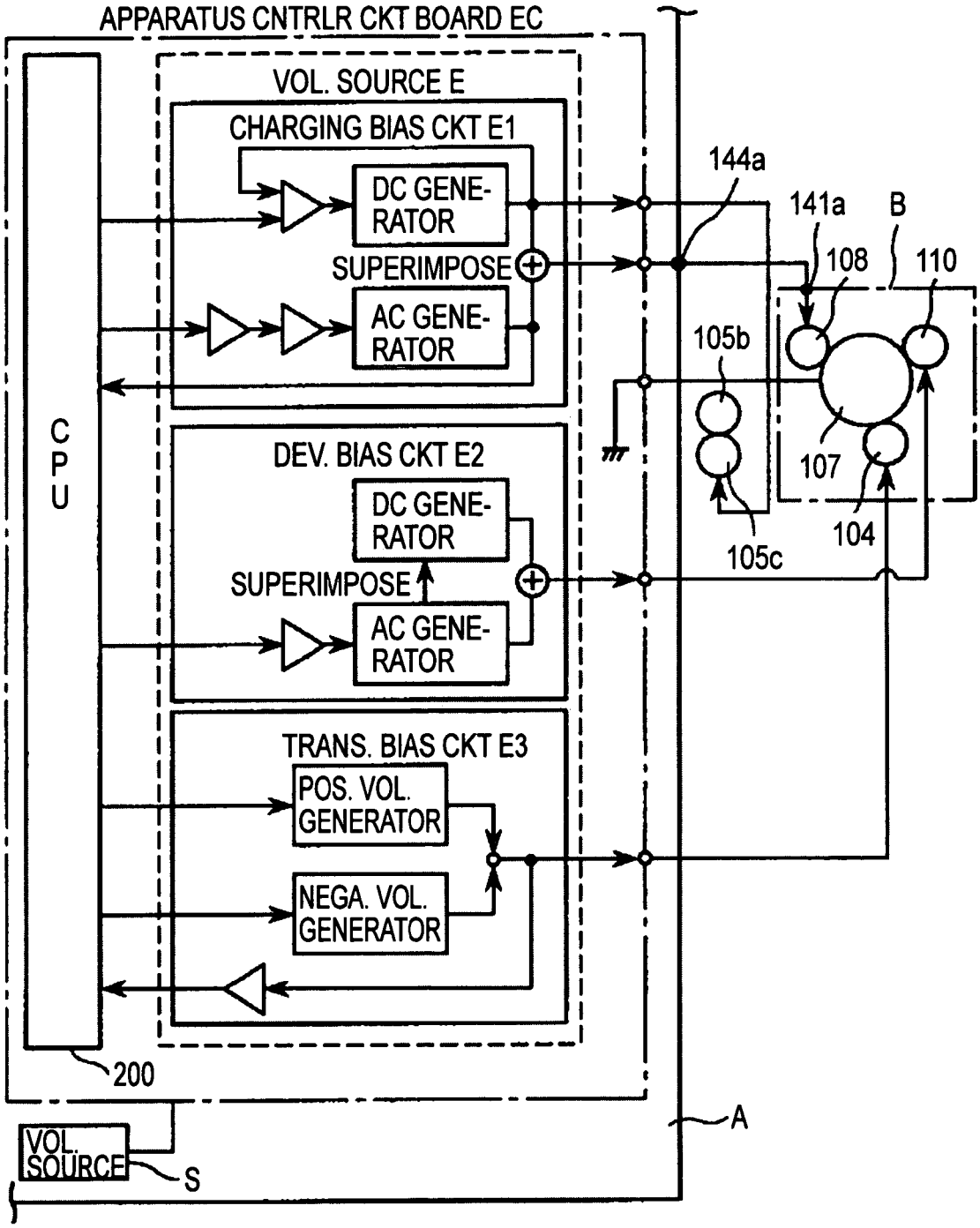
FIG. 21 illustrates a structure of a circuit board in the image forming apparatus according to the embodiment of the present invention.

At the bottom surface of the main assembly A of the apparatus, that is, below the cartridge mounting portion 130*a* there is provided an apparatus controller circuit board EC (FIG. 21). At one lateral side of the mounting portion 130*a* with respect to the mounting direction, there is disposed a motor M and a driving gear train (driving force transmitting means) M1 for transmitting the driving force from the motor M to the coupling 134 or the like, outside the inside side surface 145*e* of the inner side plate 145.

At the opposite lateral side of the mounting portion 130*a*, the displaceable engaging portion 147*c* is disposed downstream of the fixed engageable member 146 with respect to the inserting direction X of the cartridge B relative to the main assembly A of the apparatus. In addition, at least a part of the engaging portion 147*c* is overlapped with the fixed engageable member 146 as seen in the inserting direction X. In other words, a part of the engaging portion 147*c* is behind the fixed engageable member 146 as seen in the inserting direction X.

For this reason, even if the operator inserts his or her hand from the front D into the main assembly A of the apparatus for the purpose of maintenance (jam clearance operation or the like) after the cartridge B is dismounted, the hand is blocked by the fixed engageable member 146. Therefore, the displaceable engaging portion 147*c* is protected from inadvertently being accessed by the operator. The output contact 144*a* (not shown in FIG. 12) placed in the retracted position is prevented from moving unintentionally to the electrical connection position.

Figure 15:
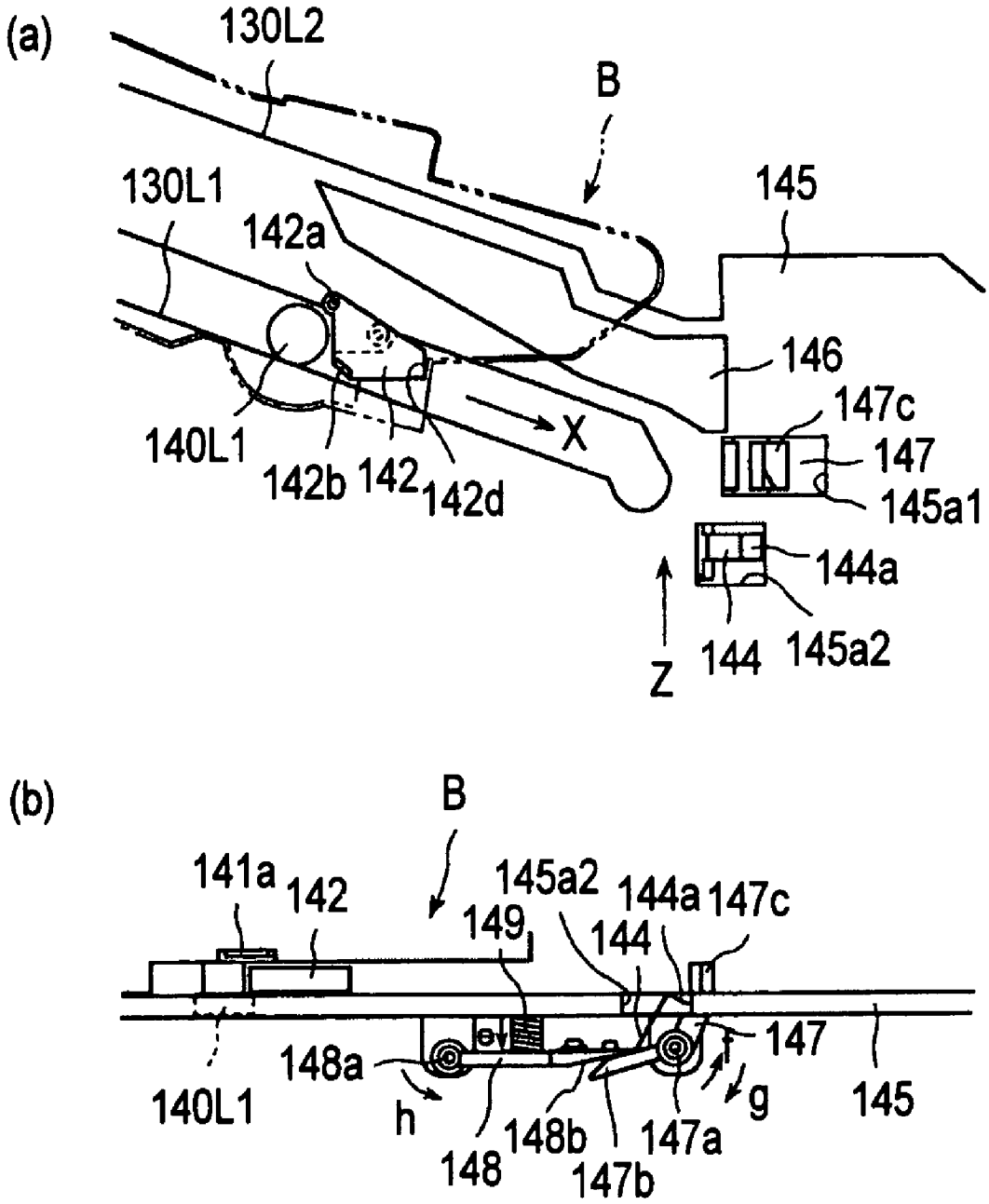
FIGS. 15(*a*) and 15(*b*) illustrate structures of the movable operation member and the electrical contact of the image forming apparatus according to the embodiment of the present invention.
Figure 18:
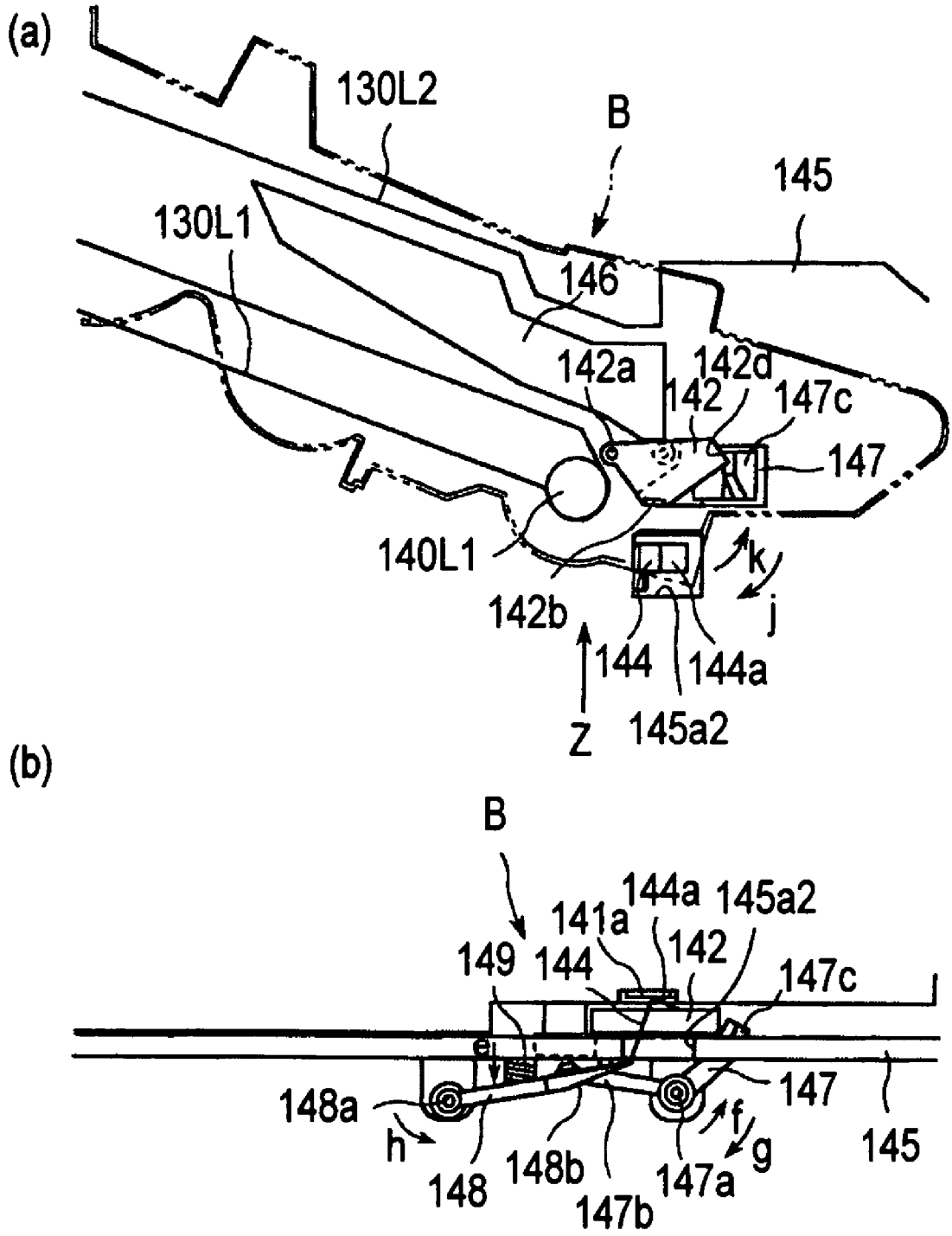
FIGS. 18(*a*) and 18(*b*) illustrate structures of the movable operation member and the electrical contact of the image forming apparatus according to the embodiment of the present invention.

(8) Operations of Movable Member and Charging Contact Member:

Referring to FIG. 15(*a*)–FIG. 18(*b*), a description will be provided as to the operations of the cartridge movable member 142 and the main assembly charging contact member 144 which is provided in the main assembly A of the apparatus. FIGS. 15(*a*) and 15(*b*) illustrate the operation in the process of mounting the cartridge B to the apparatus A, and FIG. 16(*a*)–FIG. 18(*b*) are schematic views for illustrating an operation after the mounting.

FIGS. 15(*a*), 16(*a*), 17(*a*), and 18(*a*) show views of the inner side plate 145 of the main assembly A of the apparatus as seen from an inside of the main assembly of the apparatus (in the direction of the arrow Y in FIG. 13). FIGS. 15(*b*), 16(*b*), 17(*b*), and 18(*b*) show the views as seen in the direction of arrow Z.

As will be understood from these figures, the main assembly movable member 147 is rotatably supported on the outside of the inner side plate 145 for rotation about the shaft portion 147*a*. The main assembly charging contact member 144 is mounted on a contact supporting member 148. The contact supporting member 148 is rotatably supported for rotation about the center of the shaft portion 148*a*, and is urged in the direction of the arrow e by the compression spring 149. The main assembly movable member 147 and the contact supporting member 148 are abutted to each other at the abutting portions 147*b* and 148*b* to move interrelatedly.

When the contact supporting member 148 is urged in the direction of the arrow e, the main assembly movable member 147 rotates in the direction of the arrow f. The main assembly movable member 147 is positioned, by the abutting portion (unshown) abuts an edge portion of an opening 145*a*1 of the inner side plate 145. At this time, the contact 144*a* is at such a position that it does not project into the main assembly A of the apparatus through the opening 145*a*2, and therefore, it is at a retracted position where it is retracted from the electrical connection position relative to the cartridge B.

Figure 16:
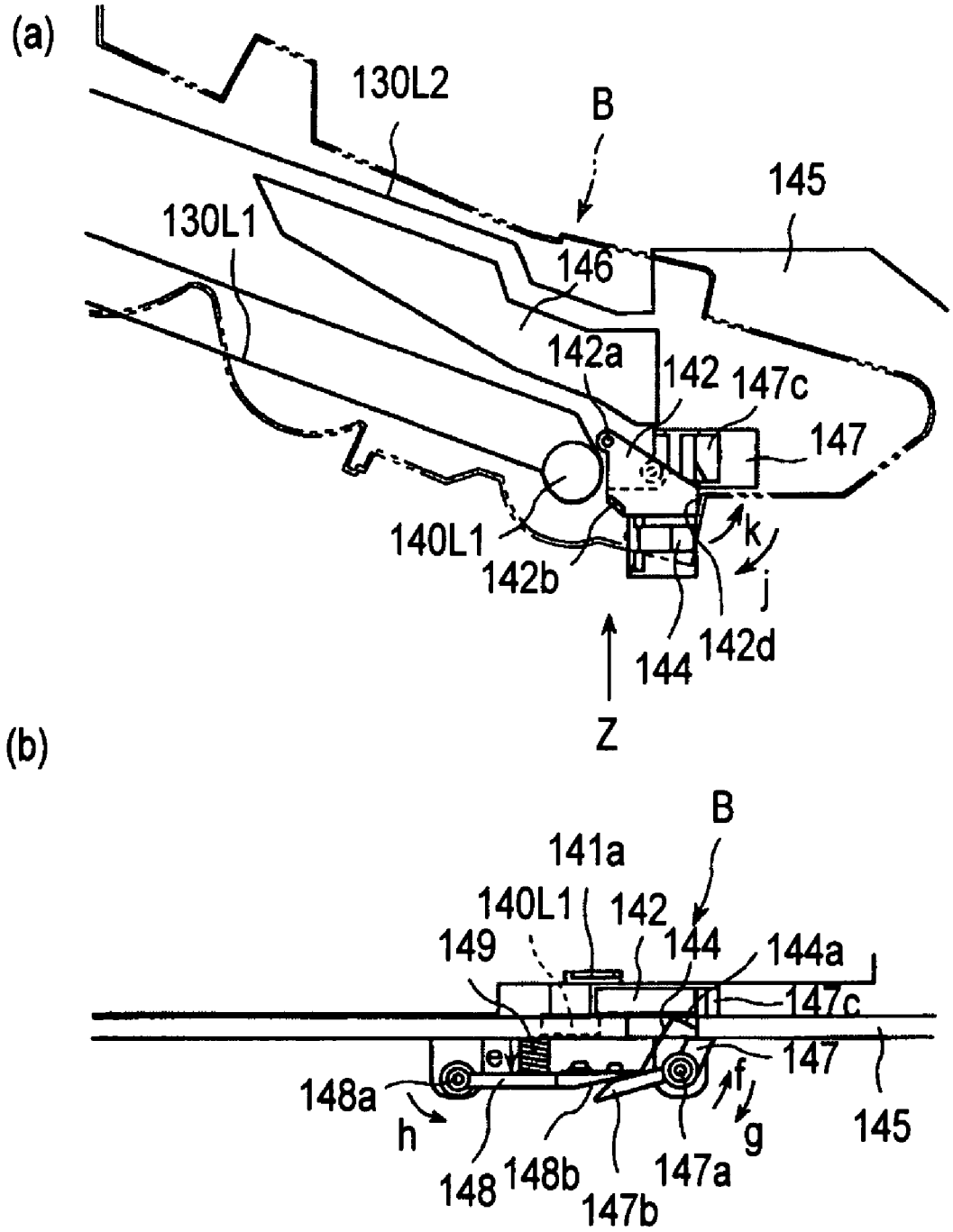
FIGS. 16(*a*) and 16(*b*) illustrate structures of the movable operation member and the electrical contact of the image forming apparatus according to the embodiment of the present invention.

FIGS. 15(*a*) and 15(*b*) show the state in the process of mounting the cartridge B into the main assembly A of the apparatus. The cartridge B is mounted in the direction of the arrow X along guide portions 130L1, 130L2. In the process of mounting, the movable member 142 is at a position shown in FIG. 19(*a*) described hereinbefore. The contact 144*a* is at a position where it does not project through the opening 145*a*2 of the inner side plate 145. After the mounting operation of the cartridge B into the main assembly A of the apparatus, as shown in FIGS. 16(*a*) and 16(*b*), the movable member 142 is not yet contacted to the main assembly movable member 147.

After the mounting of the cartridge B is completed, the cartridge door 109 (FIG. 3) is closed, by which the image forming apparatus 100 starts preparation for the image forming operation.

Then, the main assembly A of the apparatus starts to operate, and the driving force is transmitted to rotate the photosensitive drum 107. Then, as shown in FIG. 19(*a*), the eccentricity shaft 151*b* located at the position away from the abutting portion 142*b* rotates together with the photosensitive drum 107. As shown in FIG. 19(*b*), the eccentricity shaft 151*b* is brought into contact to the abutting portion 142*b*. Thereafter, as described hereinbefore, the movable member 142 passes over the position shown in FIG. 19(*c*)and rotates to the position shown in FIG. 19(*d*).

Figure 17:
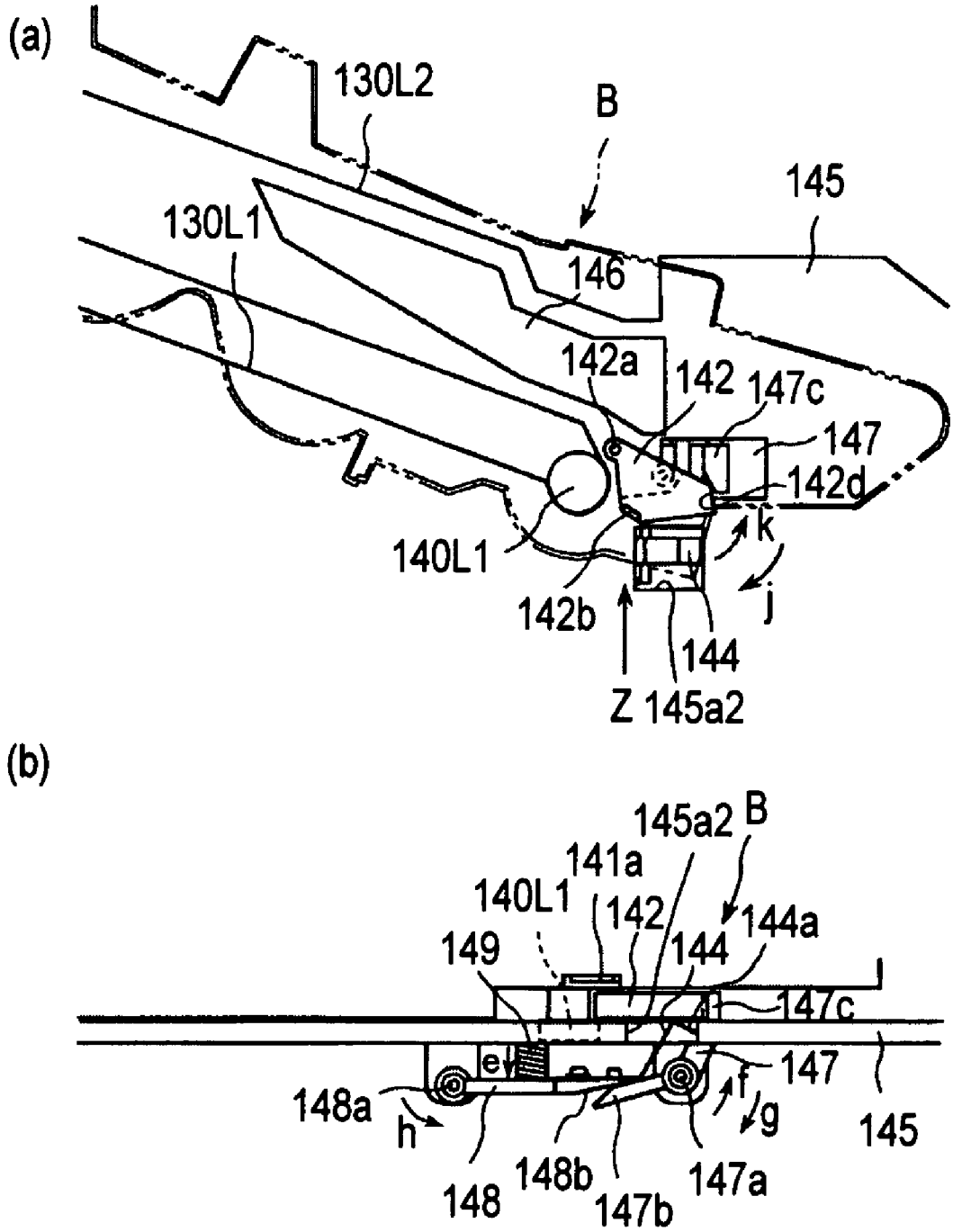
FIGS. 17(*a*) and 17(*b*) illustrate structures of the movable operation member and the electrical contact of the image forming apparatus according to the embodiment of the present invention.

Referring to FIGS. 17(*a*), 17(*b*), 18(*a*), and 18(*b*), a description will be provided as to the operation of the movable member 142. The movable member 142 rotates in the direction of the arrow k from the position shown in FIGS. 16(*a*) and 16(*b*). Then, as shown in FIGS. 17(*a*) and 17(*b*), the engaging portion 142*d* of the movable member 142 is contacted to one end 147*c* of the main assembly movable member. When the movable member 142 rotates further in the direction of the arrow k, the engaging portion 142*d* of the movable member 142 pushes the main assembly movable member 147. By this, the main assembly movable member 147 rotates in the direction of the arrow g. Thus, the contact supporting member 148 is rotated in the direction of the arrow h. By doing so, the contact 144*a* is projected into the main assembly A of the apparatus through the opening

145*a*2 of the inner side plate 145. During the rotation of the movable member 142 to the position shown in FIGS. 16(*a*) and 16(*b*) (the same as the position shown in FIG. 19(*d*)), the engaging portion 142*d* further rotates the main assembly movable member 147 in the direction of the arrow g.

In interrelation therewith, the main assembly charging contact 144*a* further projects through the inner side plate 145 until it is contacted to the contact 141*a* of the cartridge B.

As described hereinbefore, according to this embodiment of the present invention the contact 141*a* and the contact 144*a* are contacted to each other in the state that the cartridge B is mounted to the mounting portion 130, and the cartridge B is stopped there. Therefore, these contacts can be assuredly electrically connected to each other.

As described hereinbefore, in this embodiment, when the mounting of the cartridge B into the main assembly A of the apparatus is completed, and the photosensitive drum 107 starts to rotate, the electrical contact 144*a* enters the mounting portion of the main assembly of the apparatus A to contact to the electrical contact 141*a* by the operations of the cartridge movable member 142, the main assembly movable member 147 and the contact supporting member 148. In accordance with the control of the CPU200 (FIG. 21), a voltage is supplied to the charging roller 108 through the electrical contact 144*a* and the electrical contact 141*a* from the voltage source S (FIG. 21). As described hereinbefore, the output contact 144*a* is movable between the electrical connection position and the retracted position where it is retracted from the electrical connection position and is outside the cartridge mounting portion 130. The output contact 144*a* is electrically connected with the voltage source S through the voltage source circuit E. The input electrical contact 141*a* is engaged with the output contact 144*a* located at the electrical connection position. Then, it receives a voltage for operating the developing roller 110 and the charging roller 108 which are said process means.

Thus, according to this embodiment, the electrical contact 144*a* moves and contacts the electrical contact 141*a* stationarily positioned at the electrical connection position. Therefore, the electrical contacts are assuredly contacted to each other. In this manner, the voltage for operating the charging roller 108 as the process means is received from the apparatus A.

By this, the charging roller 108 can receive the charging bias from the main assembly of the apparatus A.

When the cartridge B is to be removed from the main A assembly of the apparatus, the movable member 142 is engaged with the fixed member (abutting portion) 146. By this, the movable member 142 is engaged with the fixed member 146 and is rotated so that it returns to the original position (the position shown in the fixed member 146, (*a*)) beyond the balanced position described hereinbefore. As shown in FIGS. 13(*a*) and 13(*b*), in interrelation with the motion of the movable member 142, the main assembly movable member 147 moves in the direction of the arrow d. Therefore, the main assembly charging electrical contact 144*a* returns to the retracted position shown in FIG. 13(*a*), FIG. 15(*a*), and FIG. 15(*b*) from the projected position.

(9) Apparatus Controller Circuit Board (Voltage Source Circuit).

Referring to FIG. 21, a description will be provided as to apparatus controller circuit board EC including voltage source circuits in the main assembly A of the apparatus usable with this embodiment. The circuit board EC is disposed below the cartridge mounting portion 130*a*. The circuit board EC comprises the CPU200 and the electric circuit E.

The circuit board EC comprises the CPU200 and the electric circuit E (voltage source circuit). The electric circuit E is constituted by a charging bias circuit E1, a developing bias circuit E2 and a transfer/charging bias circuit E3.

The charging bias circuit E1 generates a negative DC voltage and an AC voltage. It applies a voltage in the form of a sum of these voltages to the charging roller 108. The charging roller 108 receives the voltage and charges the photosensitive drum 107.

The charging bias circuit E1 applies the negative DC voltage also to the fixing roller 105*b* through a driving roller 105*c*. The developing bias circuit E2 generates a negative DC voltage and an AC voltage. The developing roller 110 is supplied with a voltage in the form of a sum of these voltages. The developing roller 110 receives the voltage to develop the electrostatic latent image with the developer. The transfer bias circuit E3 generate a positive or negative DC voltage. It applies positive or negative DC voltage to the transfer roller 104.

Thus, the charging roller 108 is supplied with the voltage from the voltage source S through the charging bias circuit E1. The fixing roller 105*b* and the driving roller 105*c* are supplied with the voltage from the voltage source S through the charging bias circuit E1. The developing roller 110 is supplied with the voltage from the voltage source S through the developing bias circuit E2. The transfer roller 104 is supplied with the voltage from the voltage source S through the transfer/charging bias circuit E3.

These circuits E1, E2, E3 are on-off-controlled or subjected to the controls in response to instructions from the CPU200 provided on the circuit board EC.

As described in the foregoing, according to this embodiment, even if the operator inserts his or her hand into the main assembly A of the apparatus for the purpose of jam clearance (removal of the recording material 102 from the main assembly A when the recording material 102 is jammed in the main assembly A) or for the purpose of the maintenance operation, the output contact 144*a* is not easily touched by the hand. This is because the output contact 144*a* is retracted to the retracted position. Therefore, (1) the output contact 144*a* is protected from deposition of foreign matter (developer, grease, sweat or the like deposited on the hand). It is possible that grease or the developer on parts in the main assembly A of the apparatus contaminates the operators hand, and if this occurs, they are liable to contaminate the output contact 144*a*. (2) Or, the output contact 144*a* is not damaged. This is because static electricity of the human body may be applied on the output contact 144*a*. This is an electrostatic noise, which, however, can be avoided according to this embodiment. (3) Thus, elements in the electric circuit E in the main assembly of the apparatus can be prevented from the damage which may be caused by the electrostatic noise or the like. (4) More particularly, while the contact 144*a* is making a rotational motion, it is contacted to the contact 141 which is in the stand-by state and is stationary at the electrical contact position. The contact 144*a* is contacted to the contact 141*a*, and thereafter, it slides on the contact 141*a*. Therefore, foreign matter such as dust, developer or the like can be removed by the wiping action by the sliding. For this reason, the establishment of the electrical connection between the contacts is improved.

Accordingly, an electrical conduction defect from the voltage source S (FIGS. 16(*a*) and 16(*b*)) to the charging roller 108 can be suppressed by (1)–(4).

As described in the foregoing, the engaging portion 147*c* of the displaceable member 147 (main assembly movable member) is disposed downstream of the fixed member 146 with respect to the inserting direction X, as seen in the direction of the inserting direction X. Namely, as seen in the direction of the inserting direction X, at least part of the engaging portion 147*c* is positioned behind the fixed member 146. Therefore, even if the operator inserts his or her hand into the main assembly A of the apparatus for the purpose of maintenance operation such as jam clearance or the like, the fixed member 146 is effective to prevent the hand from touching the engaging portion 147*c*.

Thus, unintentional movement of the output contact 144*a* placed in the retracted position to the electrical connection position can be avoided.

In other words, according to the foregoing embodiment, the following advantageous effects can be provided.

(1) Even if the user inserts the hand into the main assembly of the image forming apparatus for maintenance, such as jam clearance, with the process cartridge being removed from the main assembly of the image forming apparatus, the electrical contact is not easily contacted by the user, since the electrical contact is not projected out of the inner side surface. As seen in the direction of mounting the cartridge into the main assembly of the image forming apparatus, the main assembly movable member for projecting the electrical contact out, is disposed behind the fixed member, so that operator does not easily contact the main assembly movable member. Therefore, the electrical contact is protected from the possibility of electrostatic noise, so that damage of the element in the electric circuit of the main assembly of the apparatus can be prevented. In addition, the contact is protected from sweat of the user or grease, so that conduction defect can be prevented beforehand. (2) The operator mounts the cartridge into the image forming apparatus, there is no resistance caused by the electrical contacts. Therefore, the cartridge can be smoothly mounted into the image forming apparatus. (3) With respect to the structure of the main assembly of the image forming apparatus, the contact member is disposed at a side opposite from the driving side. Therefore, a space in the main assembly of the image forming apparatus can be efficiently utilized, so that apparatus can be downsized. (4) The cartridge movable member is disposed on a side surface of the process cartridge, the assembling property is good. (5) The cartridge contact member of the process cartridge is disposed at a position where it does not project out of the surface of the frame of the process cartridge. Therefore, the operator is protected from contacting to the electrical contact during manipulation of the cartridge. Thus, the contact is protected from sweat of the user or grease, so that a conduction defect can be prevented beforehand.

In this embodiment, the cartridge movable member 142 is moved using the rotation of the photosensitive drum 107, but the present invention is not limited to such a structure. For example, the rotation of the developing roller 110 is usable in place of the rotation of the photosensitive member.

In the foregoing embodiments, when the cartridge B is mounted to the main assembly A of the apparatus, the charging member, more particularly, the charging roller 107 (process means) receives the voltage from the main assembly of the apparatus 100 through the charging output contact 144*a* as the output contact and the charging input electrical contact 141*a* as the input electrical contact. However, the present invention is not limited to such a structure. In an alternative, using structures similar to those described in the foregoing, when the cartridge B is mounted to the main assembly of the apparatus A, the developing roller 110 receives the voltage from the main assembly of the apparatus 100 through a development output contact (unshown) as the development output contact and the development input electrical contact (unshown) as the input electrical contact. In a further alternative, voltages may be supplied to the charging roller 108 and to the developing roller 110. Thus, the process means is enabled.

Therefore, the following embodiments will be described with respect to the charging roller 108 and/or developing roller 110, but the present invention is not limited to such examples, and the present invention is applicable to voltage supply from the main assembly of the apparatus 100 to another process means.

Embodiment 2

Figure 22:
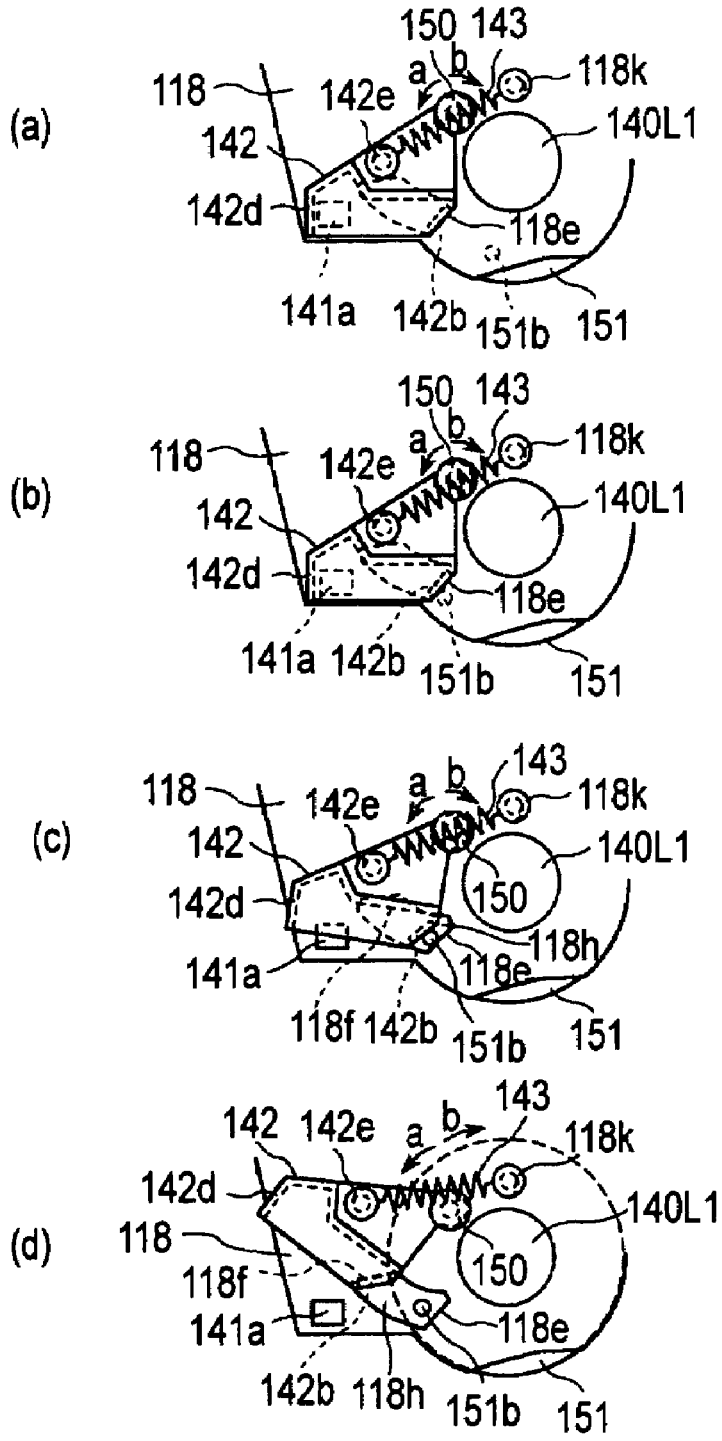
FIGS. 22(*a*)–22(*d*) are side views illustrating a major part of the movable operation member of a process cartridge according to another embodiment of the present invention.
Figure 26:
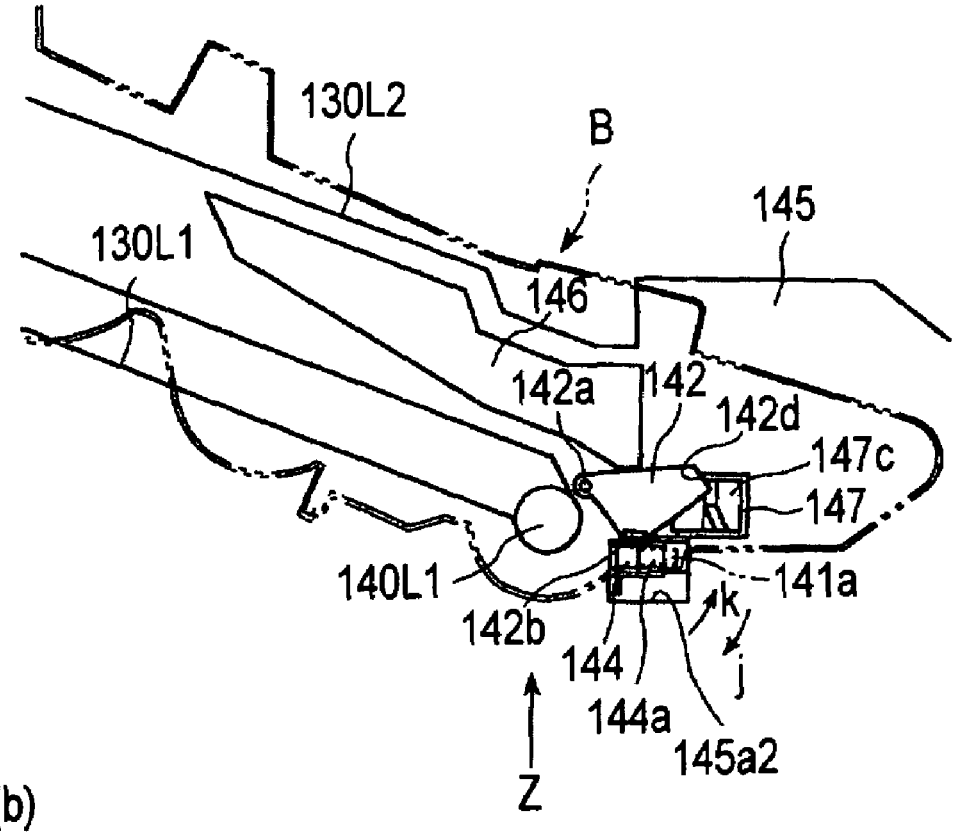
FIGS. 26(*a*) and 26(*b*) illustrate structures of the movable operation member and the electrical contact of the image forming apparatus.
Figure 26:
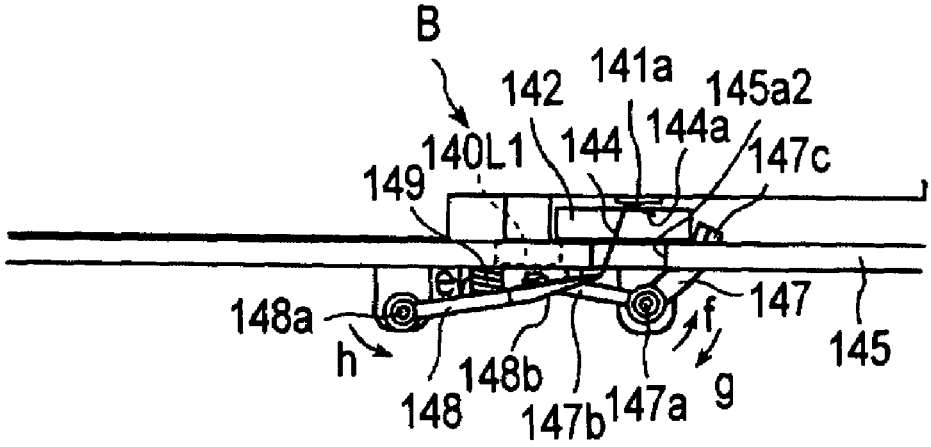

Referring to FIG. 22(*a*)–FIG. 26(*b*), the second embodiment of the present invention will be described.

In this embodiment, the structure of the cartridge B and the image forming apparatus 100 are similar to those of Embodiment 1 (FIGS. 1 and 2). The same reference numerals as in Embodiment 1 are assigned to the elements having the corresponding functions in this embodiment, and the detailed description thereof is omitted for simplicity.

In the foregoing embodiment, the electrical contact 141*a* is protected by the use of the rib 118*g* provided in the drum frame. However, in this embodiment, the electrical contact 141*a* is protected by the cartridge movable member 142 not by the rib 118*g* provided in the drum frame. This embodiment is different from the foregoing embodiment in this respect. More particularly, the electrical contact 141*a* is disposed behind the cartridge movable member 142. By doing so, the movable member 142 can cover the contact 141*a*. This embodiment is the same as Embodiment 1 in the other respects except for that particularly mentioned.

Figure 23:
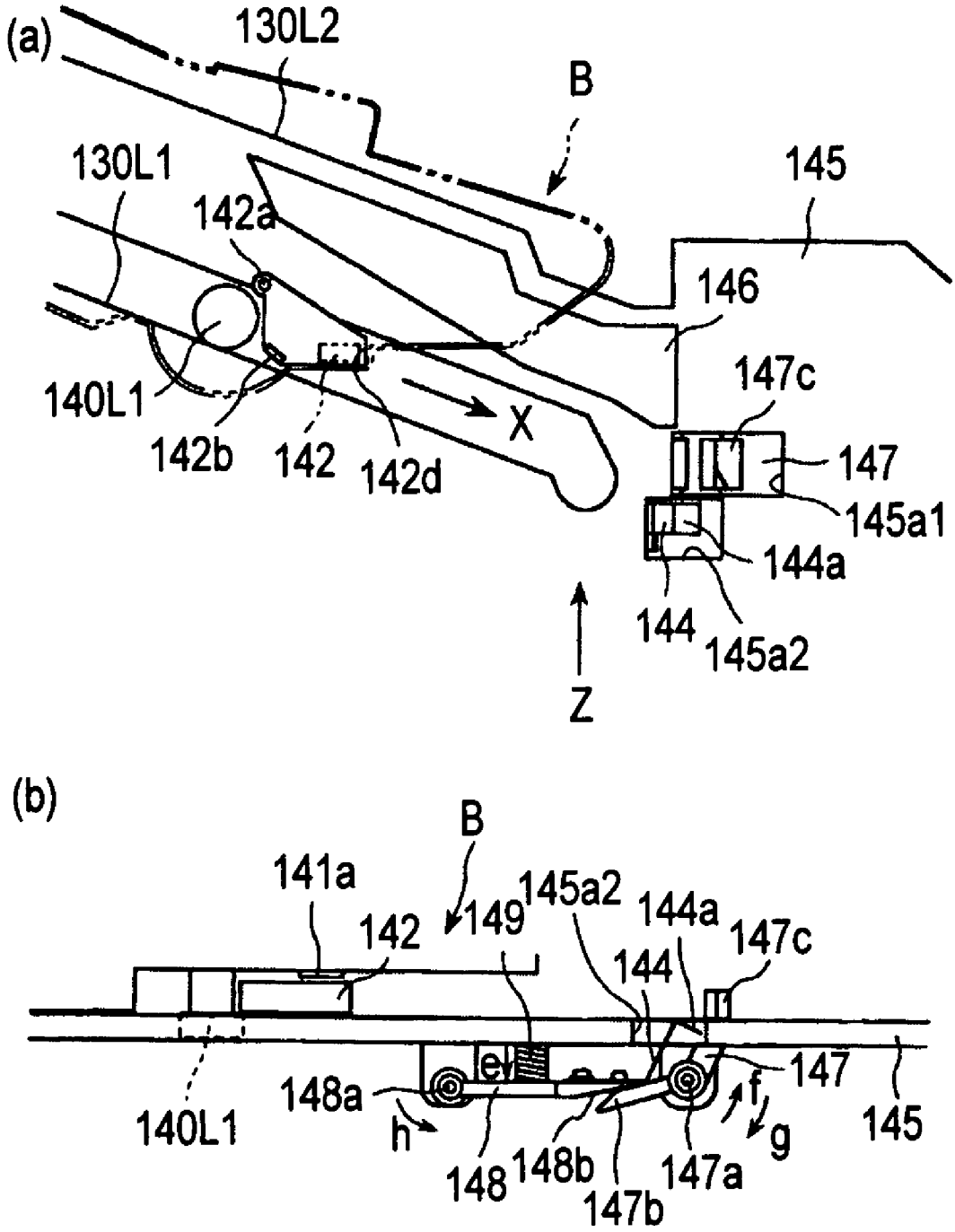
FIGS. 23(*a*) and 23(*b*) illustrate structures of the movable operation member and the electrical contact of the image forming apparatus.

FIGS. 22(*a*)–22(*d*) are side views of major parts of the cartridge movable member 142 according to Embodiment 2. The states of FIGS. 22(*a*)–22(*d*) correspond to the states of FIGS. 19(*a*) through 19(*d*), respectively. FIGS. 23(*a*) and (*b*) show the states during the process of mounting the cartridge B into the apparatus A, and FIGS. 24(*a*) and 24(*b*)–FIGS. 26(*a*) and 26(*b*) show the states after the cartridge B is mounted to the apparatus.

FIGS. 23(*a*), 24(*a*), 25(*a*), and 26(*a*) show views of the inner side plate 145 of the main assembly A of the apparatus as seen from an inside of the main assembly of the apparatus (in the direction of the arrow Y in FIGS. 13(*a*) and 13(*b*)). FIGS. 23(*b*), 24(*b*), 25(*b*), and 26(*b*) show views as seen in the direction of arrow Z. In other words, the states of FIGS. 23(*a*) and 23(*b*)–FIGS. 26(*a*) and 26(*b*) correspond to the states of FIGS. 15(*a*), 15(*b*)–FIGS. 18(*a*), 18(*b*).

(1) Cartridge Charging Contact Member and Cartridge Movable Member.

A description will be provided using FIG. 22(*a*) corresponding to the state of FIG. 19(*a*) in Embodiment 1. The electrical contact 141*a* is disposed behind the movable member 142 so as not to be exposed from the movable member 142. By this arrangement, the movable member 142 functions to protect the contact 141*a*.

(2) Operation of Cartridge Movable Member 142.

The toggle function is used also in this embodiment, and the toggle motion of the cartridge movable member 142 is the same as with Embodiment 1.

By the rotation of the photosensitive drum 107, the movable member 142 rotates in the direction of the arrow b. It rotates from the position shown in FIG. 22(*b*) which corresponds to the position of FIG. 19(*b*) of Embodiment 1 to the position shown in FIG. 22(*c*) which corresponds to the position of FIG. 19(*c*), and then to the position shown in FIG. 22(*d*) which corresponds to the position of FIG. 19(*d*).

As shown in the figure, with the rotation of the movable member 142 in the direction of the arrow b, the electrical contact 141*a* is gradually exposed by the movable member 142. In the state shown in FIG. 22(*d*), the electrical contact 141*a* is completely exposed.

(3) Charging Contact Member of Main Assembly A of Apparatus:

The main assembly charging contact member 144 provided in the main assembly A of the apparatus has a structure similar to Embodiment 1 (FIGS. 13(*a*) and 13(*b*)).

(4) Operations of Movable Member and Charging Contact Member:

By the motion of the movable member 142, the electrical contact 144*a* is projected into the main assembly A of the image forming apparatus. The structures for contacting the electrical contact 144*a* to the electrical contact 141*a* are the same as with Embodiment 1.

Figure 24:
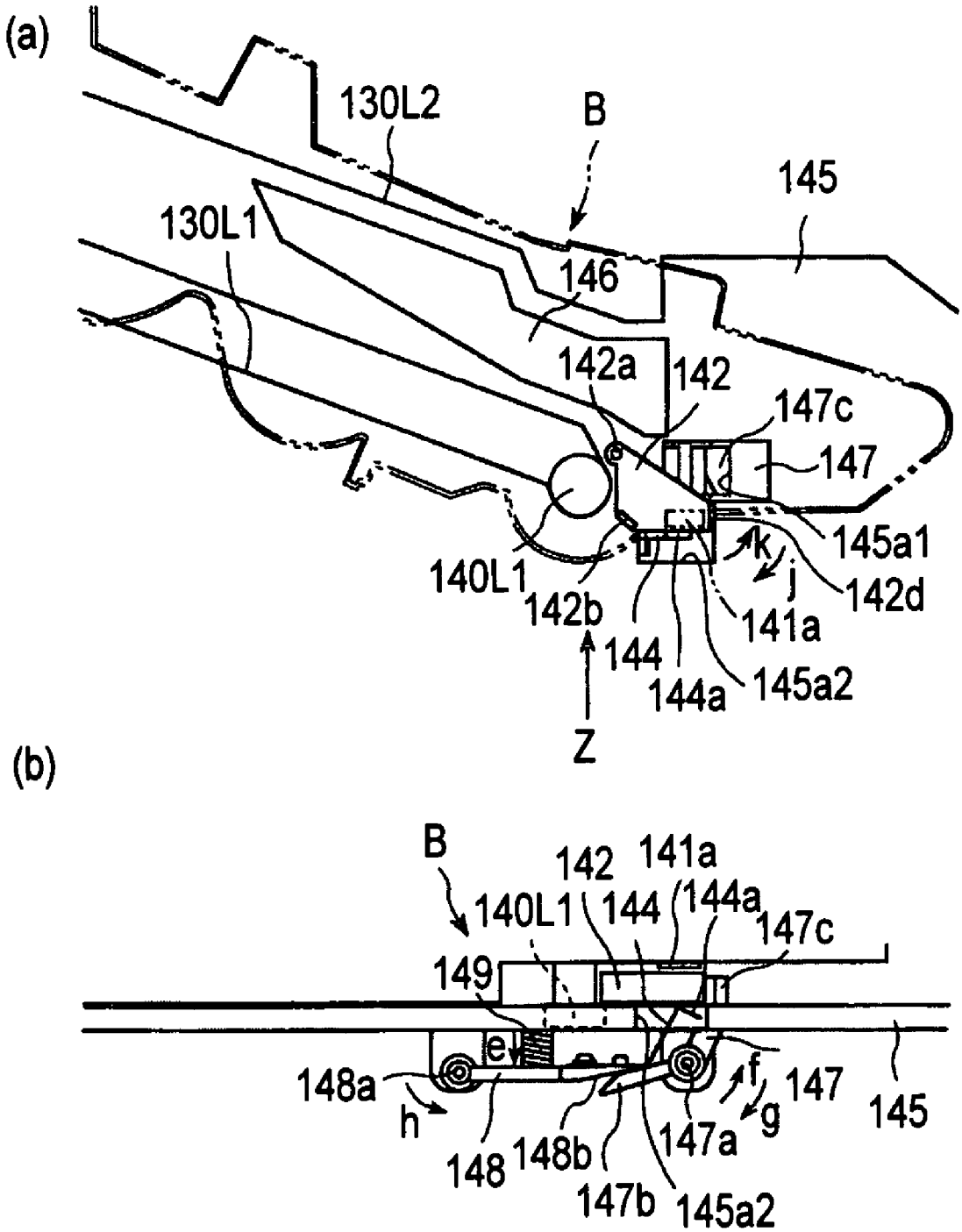
FIGS. 24(*a*) and 24(*b*) illustrate structures of the movable operation member and the electrical contact of the image forming apparatus.

The contact 141*a* is covered by the movable member 142 and is not exposed before the cartridge B is mounted into the apparatus, during the process of cartridge mounting shown in FIG. 23(*b*), and immediately after the mounting shown by FIGS. 24(*a*) and 24(*b*). Namely, the contact 141*a* is protected by the movable member 142.

After the completion of the cartridge B mounting to the mounting portion 130, the cartridge door 109 (FIG. 3) is closed. By this, the main assembly A of the apparatus starts to prepare for the image forming operation.

Figure 25:
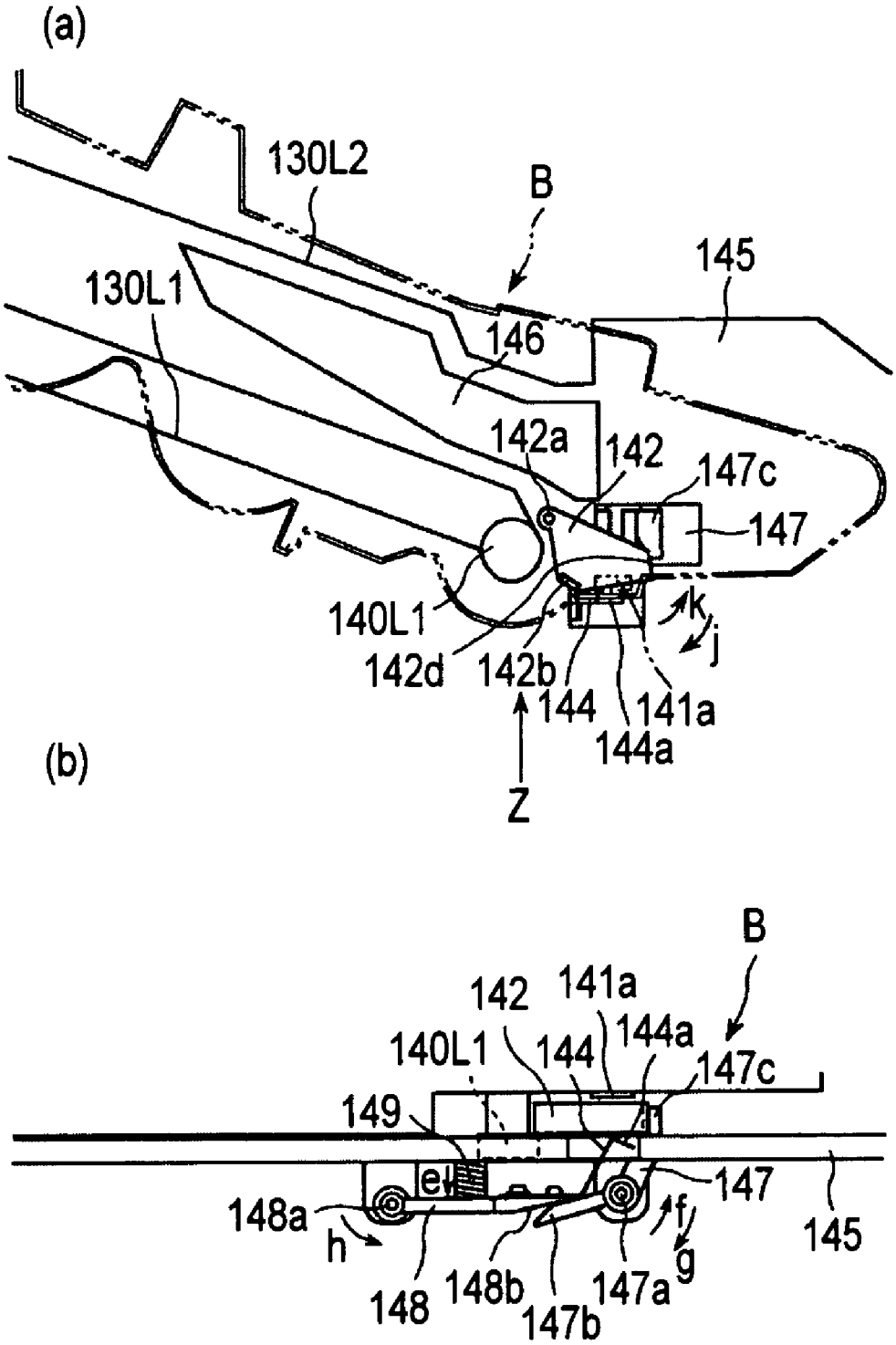
FIGS. 25(*a*) and 25(*b*) illustrate structures of the movable operation member and the electrical contact of the image forming apparatus.

Then, the main assembly A of the apparatus starts to operate, and the driving force is transmitted to rotate the photosensitive drum 107. Then, the movable member 142 rotates in the direction of the arrow k toward the position shown in FIG. 25(*a*) from the position shown in FIG. 24(*a*). By this, the contact 141*a* is gradually exposed from the movable member 142. Simultaneously, the movable member 142 is contacted to the main assembly movable member 147 (displaceable member). The main assembly movable member 147 moves the main assembly charging member 144 into the main assembly A of the apparatus by the mechanism having been described with Embodiment 1. After the contact 141*a* is completely exposed, the electrical contact 144*a* makes rotational movement to the stationary electrical contact 141*a*, thus starting contact thereto. The electrical contact 144*a* moves to the position shown in FIG. 26(*a*) and stops there, finally. This enables it to supply the charging bias to the charging roller 108 of the cartridge B from the main assembly A of the apparatus. More particularly, while the contact 144*a* is making a rotational motion, it is contacted to the contact 141 which is in the stand-by state and is stationary at the electrical contact position. The contact 144*a* is contacted to the contact 141*a*, and thereafter, it slides on the contact 141*a*. Therefore, foreign matter such as dust, developer or the like can be removed by the wiping action by the sliding. For this reason, the establishment of the electrical connection between the contacts is improved.

When the cartridge B is to be taken out of the main assembly A of the apparatus, the movable member 142 is engaged with the fixed member 146, similarly to Embodiment 1. The movable member 142 is returned to the position shown in FIGS. 23(*a*) and 23(*b*). In interrelation with the motion of the cartridge movable member 142, the main assembly movable member 147 moves in the direction of the arrow d. By doing so, the electrical contact 144*a* projected into the inside of the main assembly is returned to the retracted position shown in FIGS. 23(*a*) and 23(*b*).

When the cartridge B is removed out of the main assembly A of the apparatus, the electrical contact 141*a* is again covered by the cartridge movable member 142. Embodiment 2 provides the same advantageous effects as with Embodiment 1. In this embodiment, the movable member 142 does not necessarily completely cover the cartridge contact member 141. For example, it will suffice if it is projected beyond the contact surface or covers a part of the contact surface, since then the similar effects are provided. A description will be provided as to various modifications of "protection" in the following Embodiment 3.

Embodiment 3

Referring to FIG. 27–FIG. 31, the third embodiment of the present invention will be described.

In this embodiment, the structures of the cartridge B and the image forming apparatus 100 are similar to those of Embodiments 1 and 2 (FIGS. 1 and 2, and FIG. 3–FIG. 26(*b*)). The same reference numerals as with Embodiments 1 and 2 are assigned to the elements having the corresponding functions, and the detailed descriptions for such elements are omitted for simplicity.

In Embodiment 1, the electrical contact 141*a*, as shown in FIG. 12, is such that rib 118*g* encloses the contact 141*a*. By doing so, the contact 141*a* is not projected beyond the side surface of the drum frame 118. And, the operator is prevented from touching the exposed contact 141*a*. In Embodiment 2, the contact 141*a* is completely covered by the cartridge movable member 142.

Other examples of structures of the movable member 142 effective to prevent the operator from inadvertently touching the contact 141*a* are now disclosed.

FIG. 27 to FIG. 31 show various type of structures of the cartridge movable member 142 (movable operation member).

In these examples, the side surface of the drum frame 118 is provided with the electrical contact 141*a* similarly to Embodiments 1 and 2. The movable member 142 is supported and positioned similarly to the foregoing embodiments.

Figure 27:
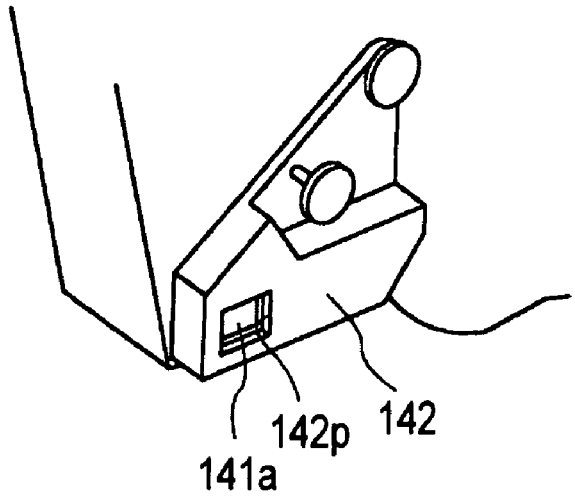
FIG. 27 illustrates a movable operation member and a contact of a process cartridge according to a further embodiment.

In the embodiment of FIG. 27, the movable member 142 is positioned so as to cover the electrical contact 141*a* in the stand-by state similarly to Embodiment 2. However, the movable member 142 is provided with an opening 142*p* facing the movable member. Thus, the contact 141*a* is not covered by the movable member 142. However, the movable member 142 provides a portion higher than the surface of the contact 141*a* around the contact 141*a*, thus effectively protecting the contact 141*a*.

Figure 28:
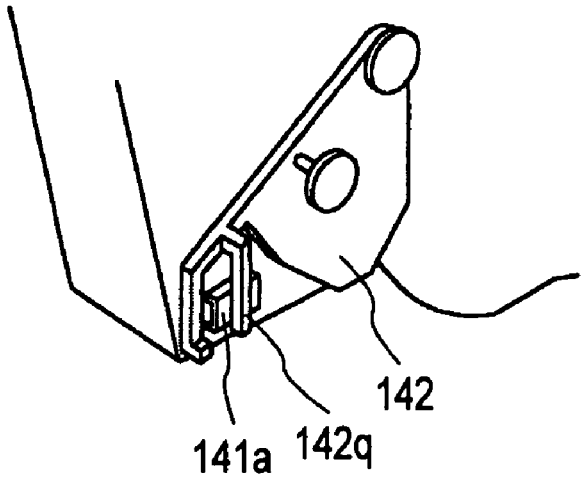
FIG. 28 illustrates a movable operation member and a contact of a process cartridge according to a further embodiment.

In the embodiment shown in FIG. 28, the movable member 142 is provided with a rib 142*q* covering a part of the contact 141*a* in the stand-by position.

Figure 29:
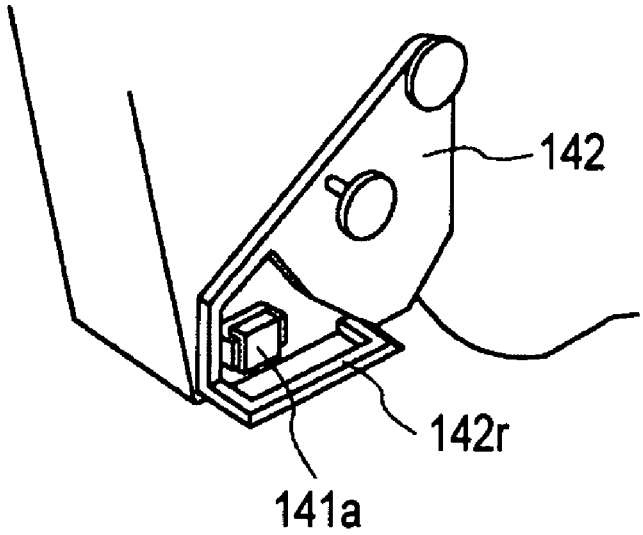
FIG. 29 illustrates a movable operation member and a contact of a process cartridge according to a further embodiment.
Figure 30:
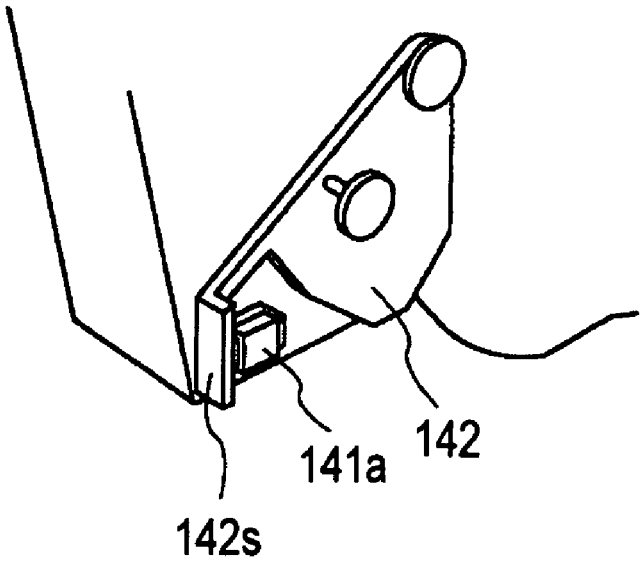
FIG. 30 illustrates a movable operation member and a contact of a process cartridge according to a further embodiment.
Figure 31:
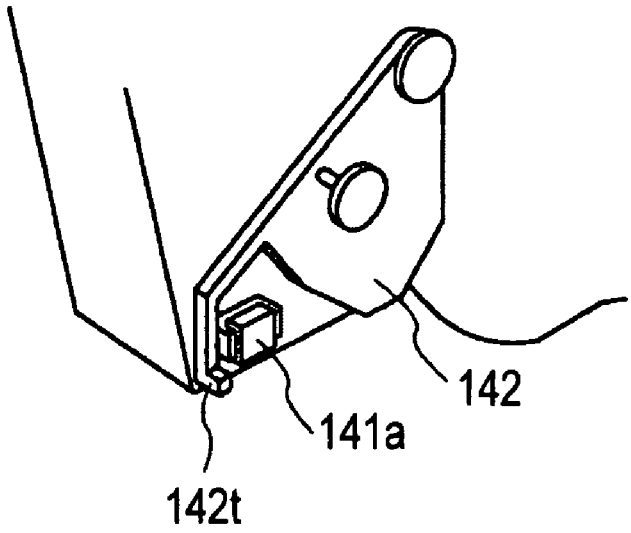
FIG. 31 illustrates a movable operation member and a contact of a process cartridge according to a further embodiment.

In the embodiment shown in FIGS. 29, 30 and 31, the movable member 142 is provided partly around the contact 141*a* with projected portions 142*r*, 142*s*, 142*t* at a level higher than the surface of the electrical contact 141*a* in the stand-by state.

In FIG. 29, the projected portion 142*r* is disposed on the movable member 142 at a position below the contact 141*a* in the figure. In FIG. 30, the projected portion 142*s* is provided on the movable member 142 at a lateral side of the contact 141*a* in the figure. In FIG. 31, the projected portion 142*t* is provided on the movable member 142 at a lower corner portion of the contact 141*a* in the figure.

In these examples of this embodiment, similarly to Embodiments 1, 2, a projected portion higher than the surface of the contact 141*a* is provided adjacent the contact 141*a*. Therefore, the operator is effectively prevented from inadvertently touching the electrical contact during manipulation of the cartridge. Thus, the contact is protected from sweat of the user or grease, so that conduction defect can be prevented beforehand. In other words, the electrical contact 141*a* can be protected.

This embodiment provides the same advantageous effects as with Embodiments 1 and 2.

Embodiment 4

Referring to FIG. 32–FIG. 35(*b*), the fourth embodiment will be described.

In this embodiment, the structure of the cartridge B and the image forming apparatus 100 in this embodiment, are similar to those of Embodiment 1 which has been described in conjunction with FIGS. 1 and 2. Similar to those of Embodiment 1 which has been described in conjunction with FIGS. 1 and 2, the same reference numerals as with the Embodiments 1 and 2 are assigned to the elements having the corresponding functions, and the detailed descriptions for such elements are omitted for simplicity.

In Embodiment 1 and Embodiment 2, it is the charging electrical contact that is protected. In the following embodiments, a development electrical contact is protected. The difference between this embodiment and Embodiment 1 and Embodiment 2 is in that movable member 142 protects not a charging electrical contact but a development electrical contact. And, the electrical contact, which is projected by engagement with the movable member 142, is an electrical contact for applying the charging bias but an electrical contact for applying a developing bias.

More particularly, a toggle mechanism similar to that used in Embodiment 2 is disposed at the center of rotation of the photosensitive drum 107. This embodiment is fundamentally the same as Embodiment 2. The same reference numerals as with the Embodiment 2 are assigned to the elements having the corresponding functions, and the detailed descriptions for such elements are omitted for simplicity.

Figure 32:
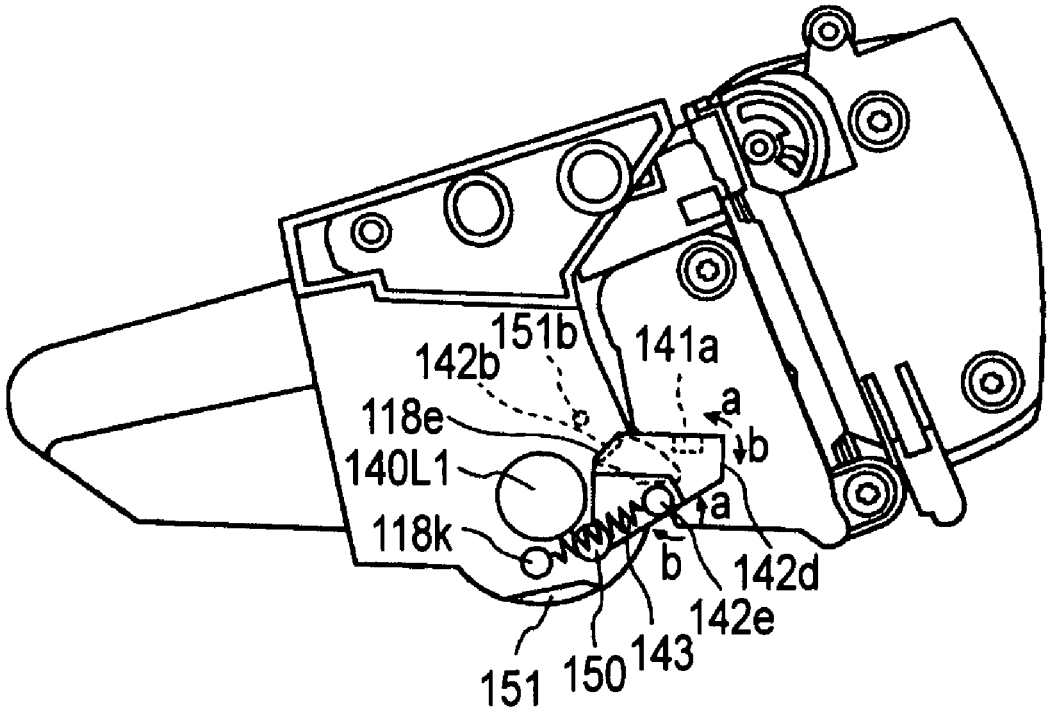
FIG. 32 is a side view of a major part of a movable operation member of a process cartridge according to a further embodiment of the present invention.
Figure 33:
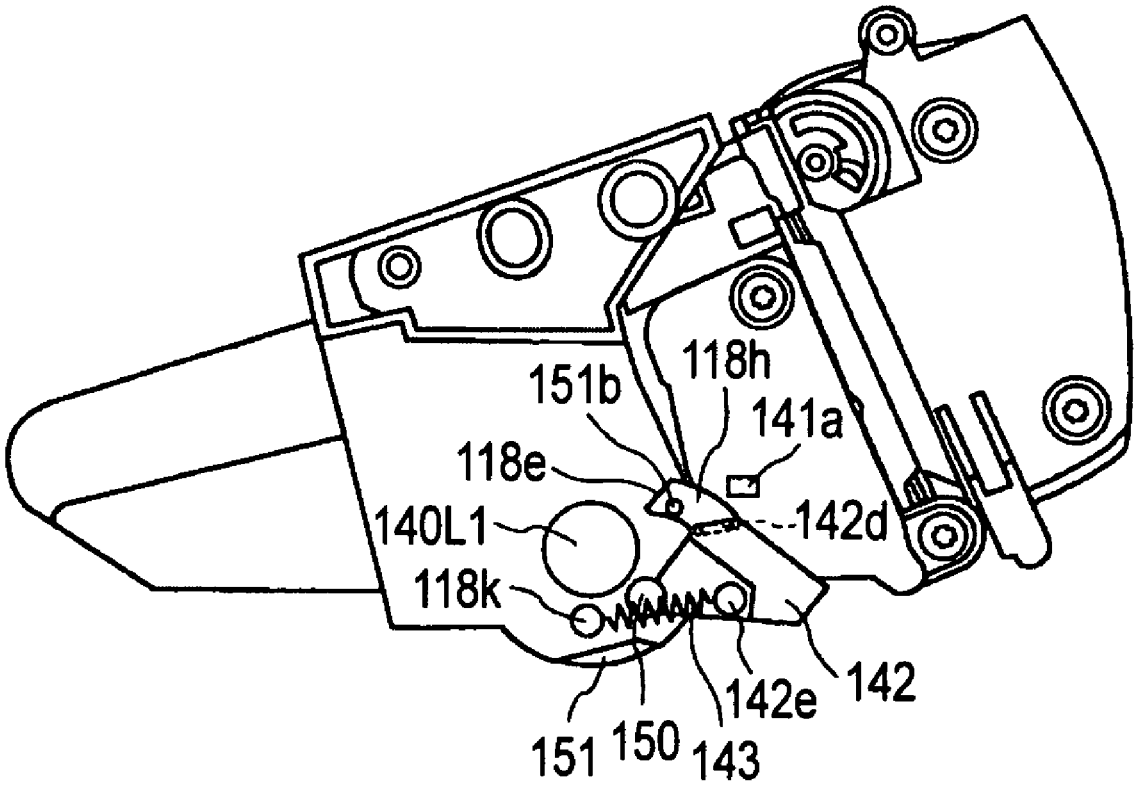
FIG. 33 is a side view of a major part of a movable operation member of a process cartridge according to a further embodiment of the present invention.

FIGS. 32 and 33 are side views illustrating major parts of the movable member 142. The states shown in FIGS. 32 and 33 correspond to the states shown in FIGS. 22(*a*) and 22(*b*) (Embodiment 2), respectively. The states of FIGS. 34(*a*) and 34(*b*) correspond to the states of FIGS. 13(*a*) and 13(*b*).

Figure 34:
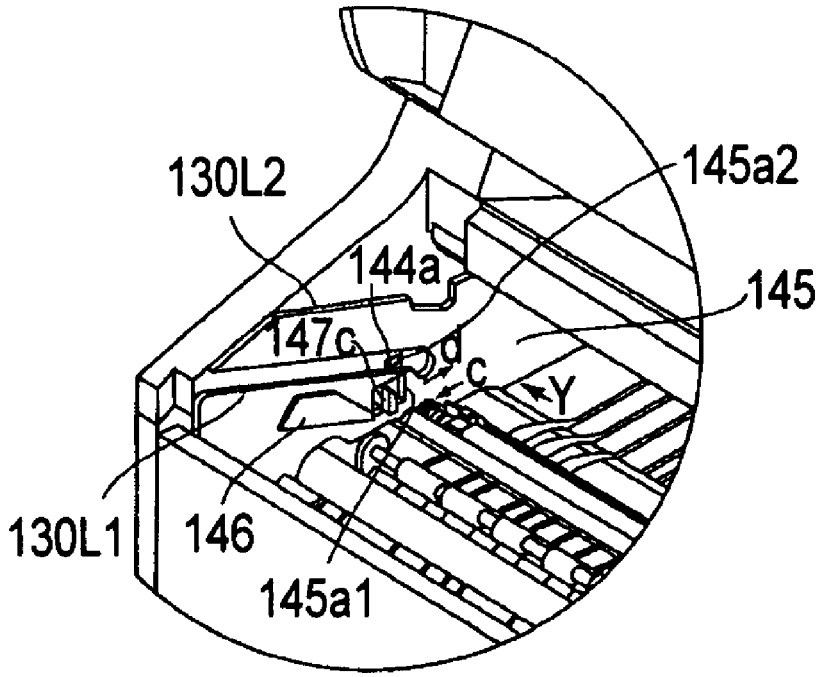
FIGS. 34(*a*) and 34(*b*) are perspective views showing a structure of an electrical contact of a main assembly of the image forming apparatus according to a further embodiment of the present invention.
Figure 34:
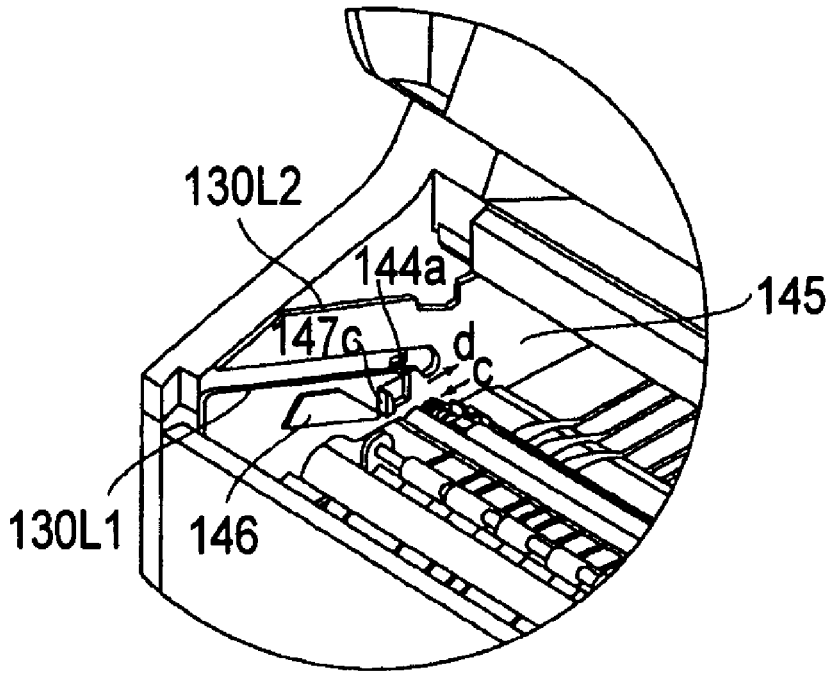
Figure 35:
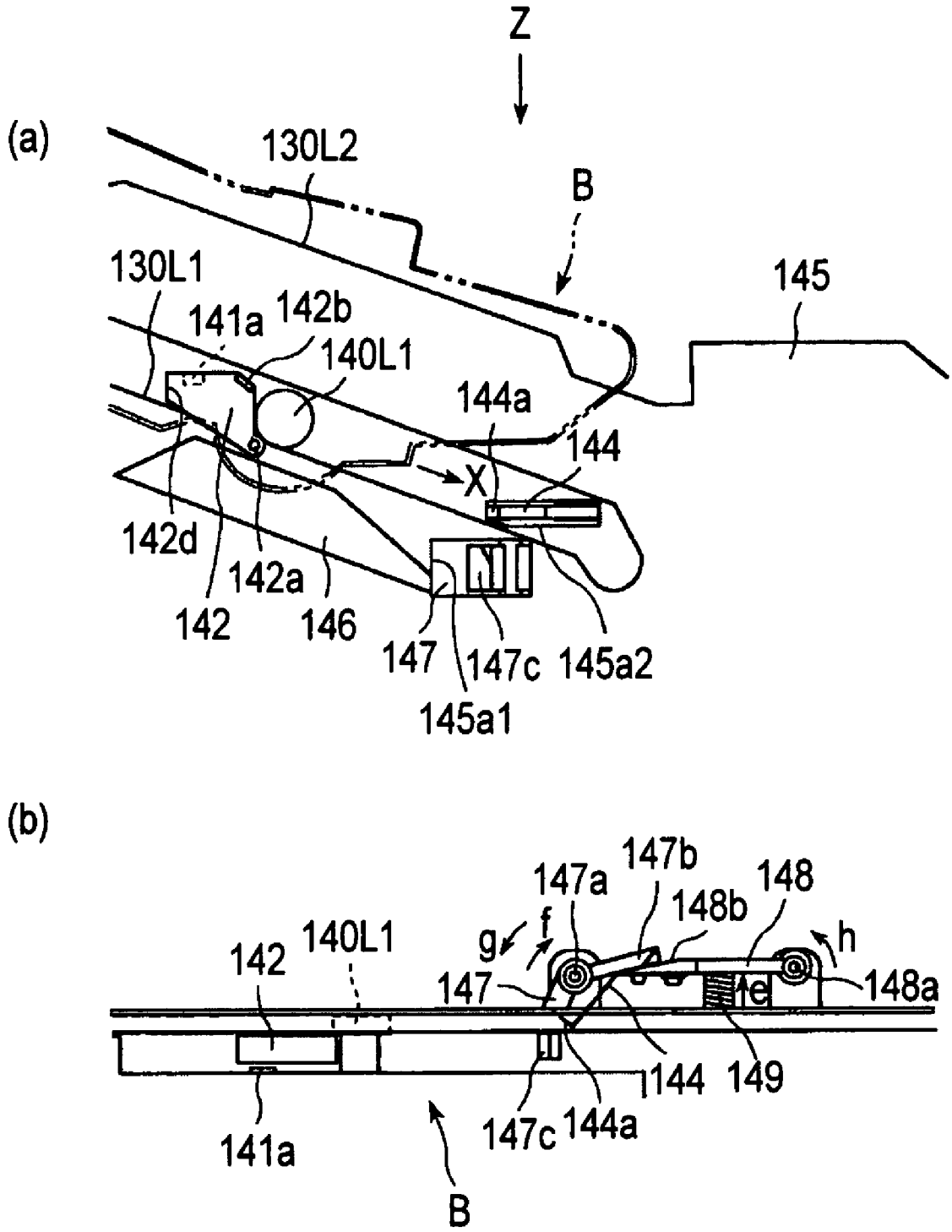
FIGS. 35(*a*) and 35(*b*) illustrate structures of the movable operation member and the electrical contact of the image forming apparatus.
Figure 36:
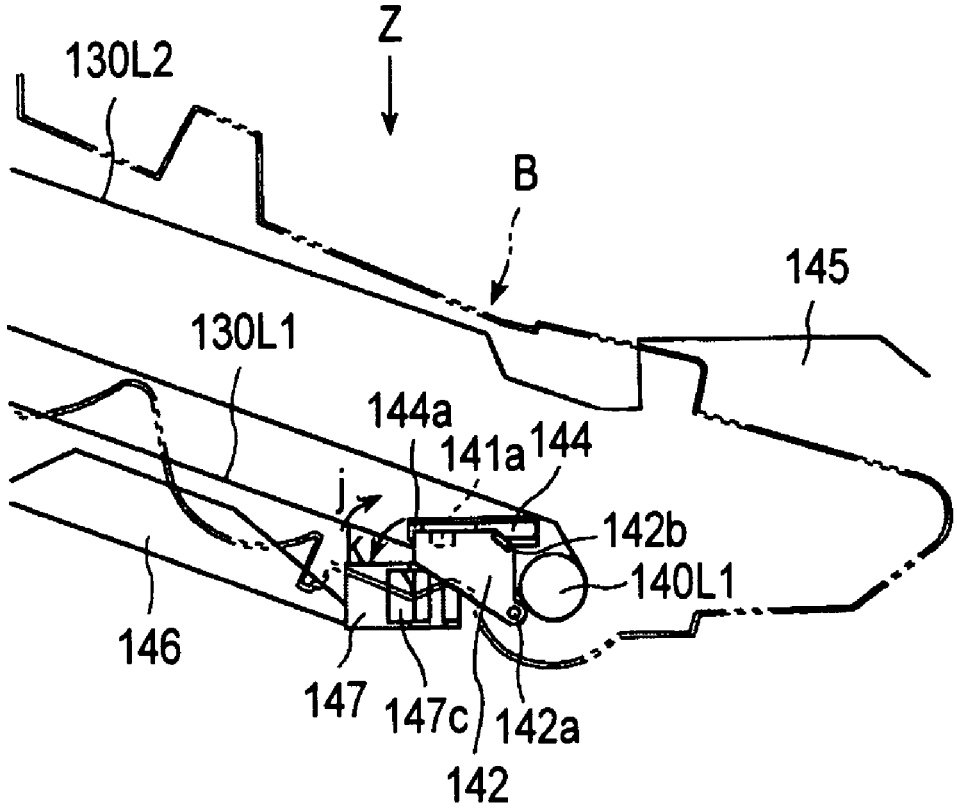
FIGS. 36(*a*) and 36(*b*) illustrate structures of the movable operation member and the electrical contact of the image forming apparatus.
Figure 36:
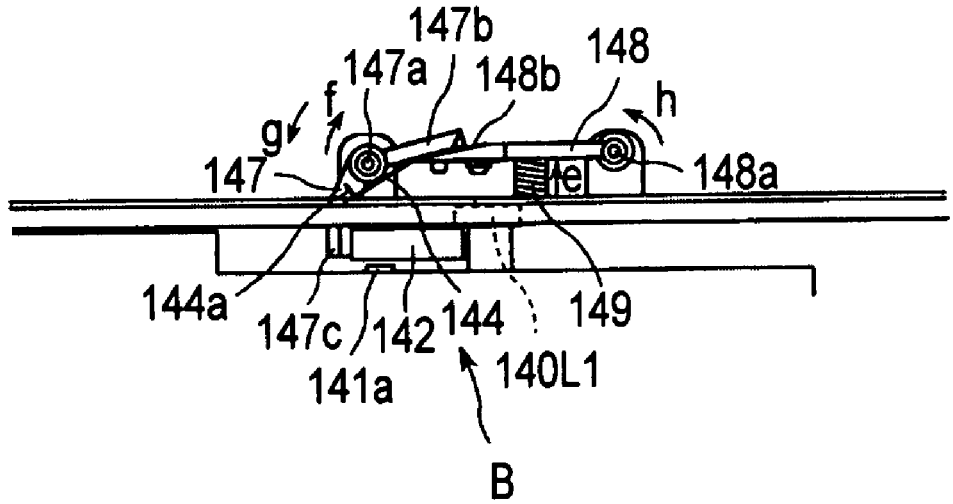
Figure 37:
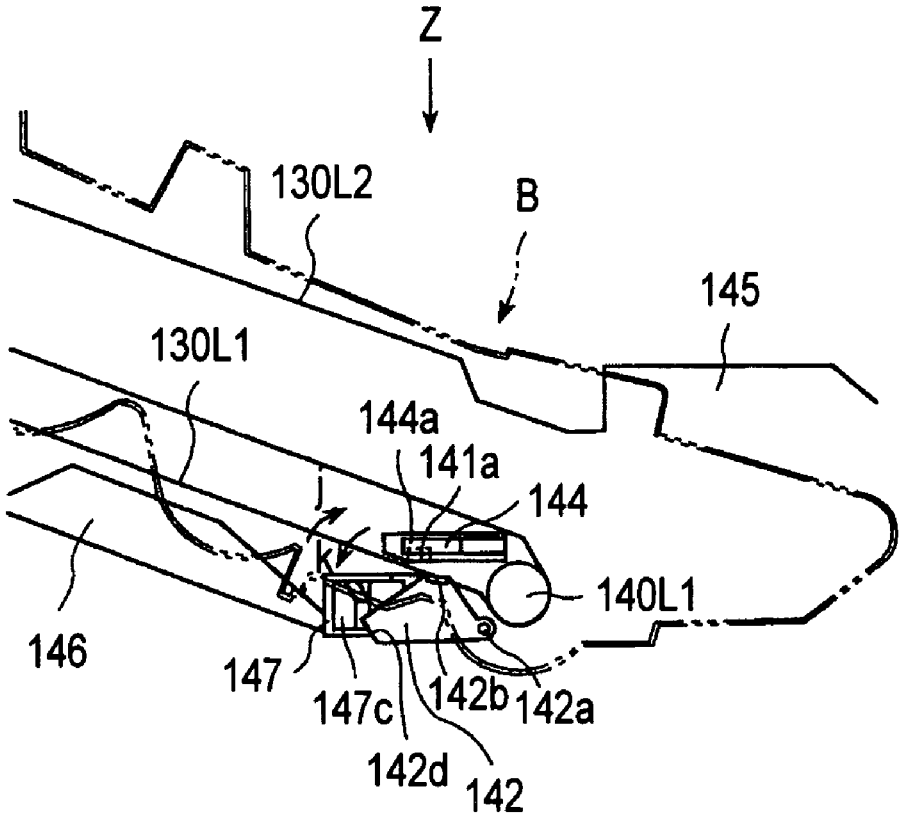
FIGS. 37(*a*) and 37(*b*) illustrate structures of the movable operation member and the electrical contact of the image forming apparatus.
Figure 37:
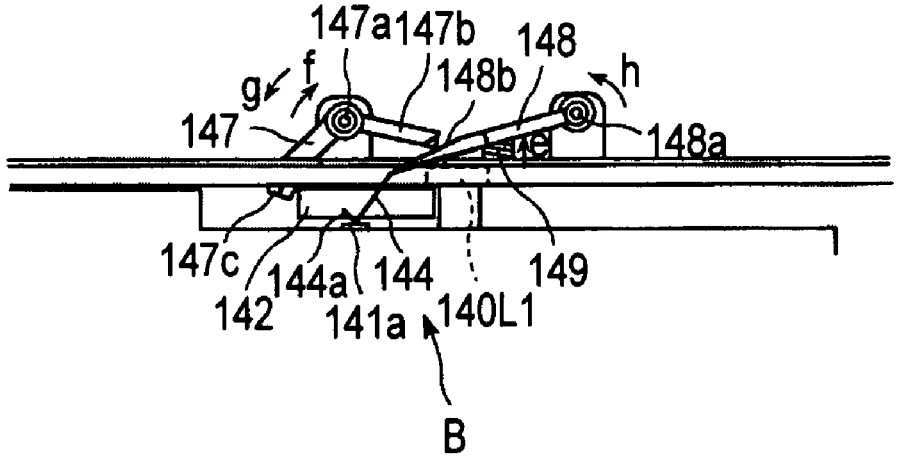

FIGS. 35(*a*) and 35(*b*) illustrate the behavior during the process of mounting the cartridge B into the apparatus, and FIGS. 36 and 37 illustrate the behavior after the mounting. FIGS. 35(*a*), 36(*a*), and 37(*a*) are views of the inner side plate 145 of the main assembly A of the apparatus as seen from an inside of the main assembly of the apparatus (in the direction of the arrow Y in FIGS. 34(*a*) and 34(*b*)). FIGS. 35(*b*), 36(*b*), and 37(*b*) are the views as seen in the direction of arrow Z. In other words, FIGS. 35(*a*), 35(*b*), 36(*a*), 36(*b*), 37(*a*), and 37(*b*) correspond to FIGS. 23(*a*), 23(*b*), 24(*a*), 24(*b*), 26(*a*), and 26(*b*) respectively.

(1) Cartridge Developing Device Contact Member and Cartridge Movable Member:

In the state shown in FIG. 32(*a*), the electrical contact (input electrical contact) 141*a* of the cartridge development electrical contact member (input electrical contact member) 141 is disposed behind the movable member 142. The electrical contact 141*a* is so disposed that it is covered by the movable member 142 and not exposed. Thus, the contact 141*a* is protected by the movable member 142. The state shown in FIG. 32(*a*) corresponds to the state shown in FIG. 22(*a*).

(2) Operation of Cartridge Movable Member 142.

The toggle operation of the movable member 142 is the same as with Embodiment 2. By the rotation of the photosensitive drum 107, cartridge movable member 142 rotates in the direction of the arrow b from the position of FIG. 32 corresponding to FIG. 22(*a*) to the position of FIG. 33 corresponding to the FIG. 22(*d*).

As shown in this figure, the movable member 142 rotates in the direction of the arrow b. By this, the contact 141*a* is gradually exposed beside the movable member 142. Finally, the contact 141*a* is completely exposed.

(3) Developing Device Contact Member Provided in Main Assembly of Apparatus A:

A description will be provided as to the main assembly developing device contact member (output contact member) 144 provided in the main assembly A of the apparatus.

As shown in FIGS. 34(*a*) and 34(*b*), on an inner side of the main assembly A of the apparatus, a main assembly developing device contact member 144 for applying the developing bias voltage by contact with the electrical contact 141*a* is provided. When the cartridge B is not mounted to the main assembly A of the apparatus, the electrical contact 144*a* (output contact) of the contact member 144 is retracted to such a position that it does not project into the inside (mounting portion 130 side) through the opening 145*a*1 of the inner side plate 145 of the main assembly A of the apparatus. The contact member 144 is connected with a voltage source circuit E provided in the main assembly A of the apparatus by lead lines or the like.

In the main assembly A of the apparatus, the above-described fixed member 146 is projected beyond the inner side plate 145. Downstream of the fixed member 146 with respect to the mounting direction of the cartridge B, a one end portion 147*c* of the main assembly movable member 147 is projected.

The main assembly movable member 147 moves in the direction of arrows c, d (b corresponds to c, and c, a corresponds to d) in interrelation with the rotating operation of the cartridge movable member 142.

After the cartridge B is mounted to the main assembly A of the apparatus, and the preparation of the image formation is completed, the photosensitive drum 107 starts to rotate. Then, as shown in FIG. 34(*b*), the main assembly movable member 147 is pushed by the movable member 142 in the direction of the arrow c. By this, the contact 144*a* is projected through the opening 145*a*2 of the inner side plate 145 in interrelation with the operation of the main assembly movable member 147. The contact 144*a* then moves to contact the stationary contact 141*a*.

(4) Movable Member and Developing Device Contact Member:

By the movable member 142, the electrical contact 144*a* is projected into the main assembly of the apparatus A. The structure for contacting to the electrical contact 141*a* is the same as Embodiment 2.

The contact 141*a* is covered by the movable member 142, before the cartridge B is mounted to the main assembly A of the apparatus, during the process of the cartridge mounting, and immediately after the mounting shown in FIGS. 36(*a*) and 36(*b*). The contact 141*a* is not exposed, and protected by the movable member 142.

After the completion of mounting of the cartridge B to the main assembly of the apparatus A, the cartridge door 109 (FIG. 3) is closed. By this, the main assembly of the apparatus A starts to prepare for the image forming operation. Then, the main assembly A of the apparatus starts to operate, and the driving force is transmitted to rotate the photosensitive drum 107. Then, the movable member 142 rotates in the direction of the arrow k from the position shown in FIG. 36(*a*) to the position shown in FIG. 37(*a*). Then, it gradually permits the contact 141*a* to be exposed. Simultaneously, the movable member 142 is contacted to the main assembly movable member 147. By the mechanism described in Embodiment 2, the contact 144*a* is moved into the main assembly A of the apparatus. After the contact 141*a* is completely exposed, the contact 141*a* and the contact 144*a* start to contact to each other. The movable member 142, moves to the position shown in FIG. 37(*a*) and stops there, finally.

Thus, the developing bias voltage becomes applicable to the developing roller 110 of the cartridge B from the main assembly of the apparatus A.

Similarly to Embodiment 2, the movable member 142 is engaged with the fixed member (abutting portion) 146. The movable member 142 is returned to the position shown in FIG. 35(*a*). The main assembly movable member 147 moves in the direction of the arrow d in interrelation with the motion of the movable member 142. By this, the main assembly development electrical contact 144*a* is moved from the position in which it is projected into the main assembly to the position in which it is retracted FIG. 34(*a*), and FIGS. 35(*a*) and 35(*b*).

When the cartridge B is removed out of the main assembly A, the contact 141*a* is covered again by the movable member 142. Then, it is protected by the movable member 142.

This embodiment provides the same advantageous effects as with Embodiments 1 and 2.

Similarly to Embodiment 2, the movable member 142 is not necessarily completely covering the contact 141*a*, in this embodiment. For example, it will suffice if it is projected beyond the contact surface or covers a part of the surface of the contact. The types of the protection may be the same as Embodiment 3.

In Embodiment 2, the present invention is applied to a charging contact only, and in this embodiment, the present invention is applied only to the developing device contact. However, the present invention is applicable to both of the contacts to cover them with the movable member. By doing so, the operator is effectively prevented from inadvertently touch the charging electrical contact and the development electrical contact. Thus, the contact is protected from sweat of the user or grease, so that conduction defect can be prevented beforehand. Here, it is not necessary for the movable member to completely cover the electrical contact. For example, it will suffice if it is projected beyond the contact surface or covers a part of the surface of the contact, similarly to Embodiments 2, 3 and 4.

Embodiment 5

Referring to FIG. 38–FIG. 46, the fifth embodiment will be described.

In this embodiment, the structure of the cartridge B and the image forming apparatus 100 in this embodiment, are similar to those of Embodiment 1 which has been described in conjunction with FIGS. 1 and 2. Similar to those of Embodiment 1 which has been described in conjunction with FIGS. 1 and 2, the same reference numerals as with the foregoing embodiments are assigned to the elements having the corresponding functions, and the detailed descriptions for such elements are omitted for simplicity.

The constituent elements of the structure of this embodiment will be described briefly.

The operation of the movable member 142 uses a so-called toggle operation. This is the same as with Embodiment 1, 2 and 4. The toggle operation is effected by the eccentric shaft 151*b* on the flange 151 which integrally rotates with the photosensitive drum 107, similarly to the foregoing embodiments.

The embodiment is different from Embodiments 1, 2 and 4 in which the rotation center shaft of the movable member 142 extends substantially in the vertical direction (substantially perpendicular to the rotation center shaft of the photosensitive drum 107), because in this embodiment, the rotation center shaft of the movable member 142 extends substantially in the horizontal direction (parallel with the rotation center shaft of the photosensitive drum 107). This embodiment is also different in that the movable member 142 is constituted by a plurality of elements, the movable member 142 being a single element in the foregoing embodiments. Moreover, in the foregoing embodiments, the electrical contact (input electrical contact) of the cartridge B is disposed on a side surface with respect to the mounting direction X, but in this embodiment, it is disposed on a front side.

Figure 38:
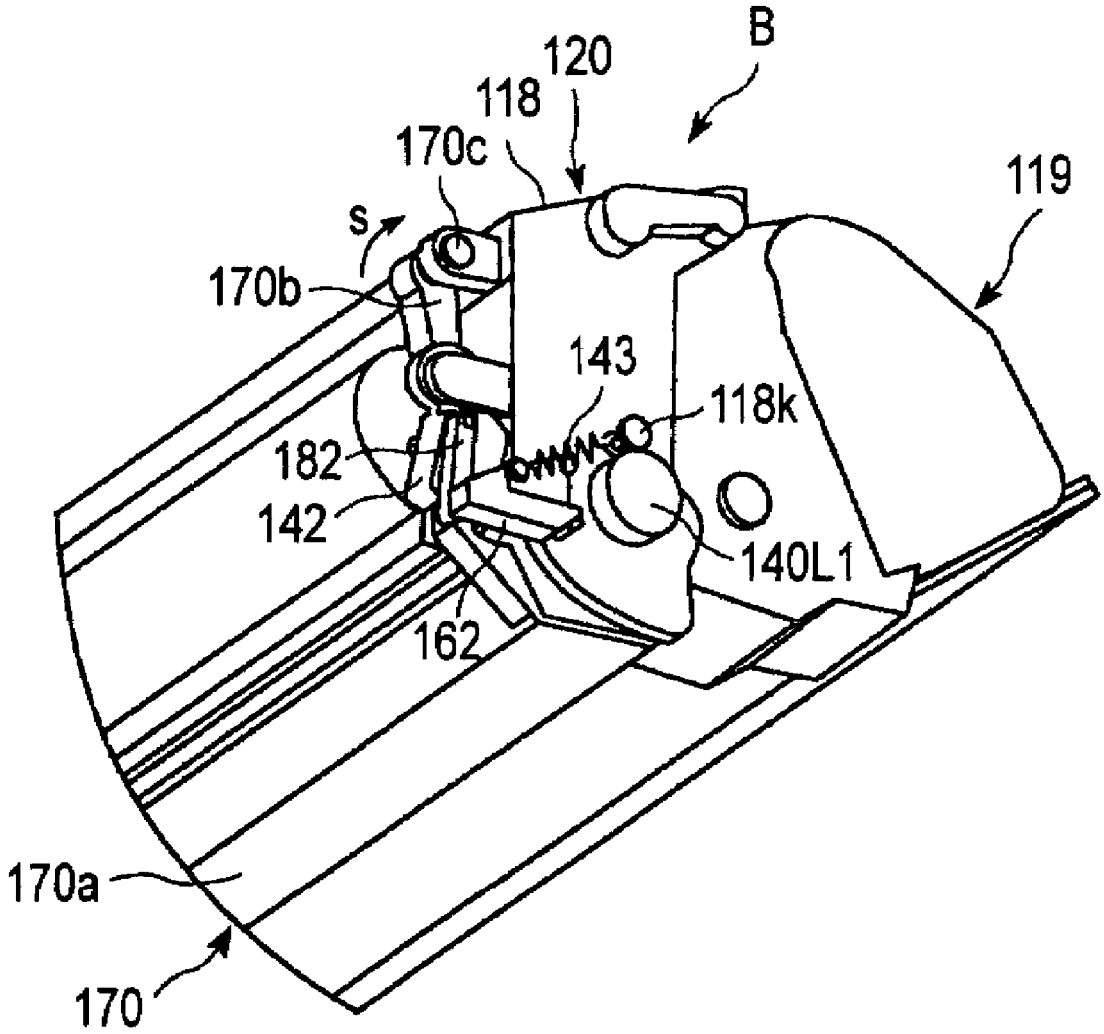
FIG. 38 is a perspective view showing a structure of a movable operation member of a process cartridge according to a further embodiment of the present invention.
Figure 39:
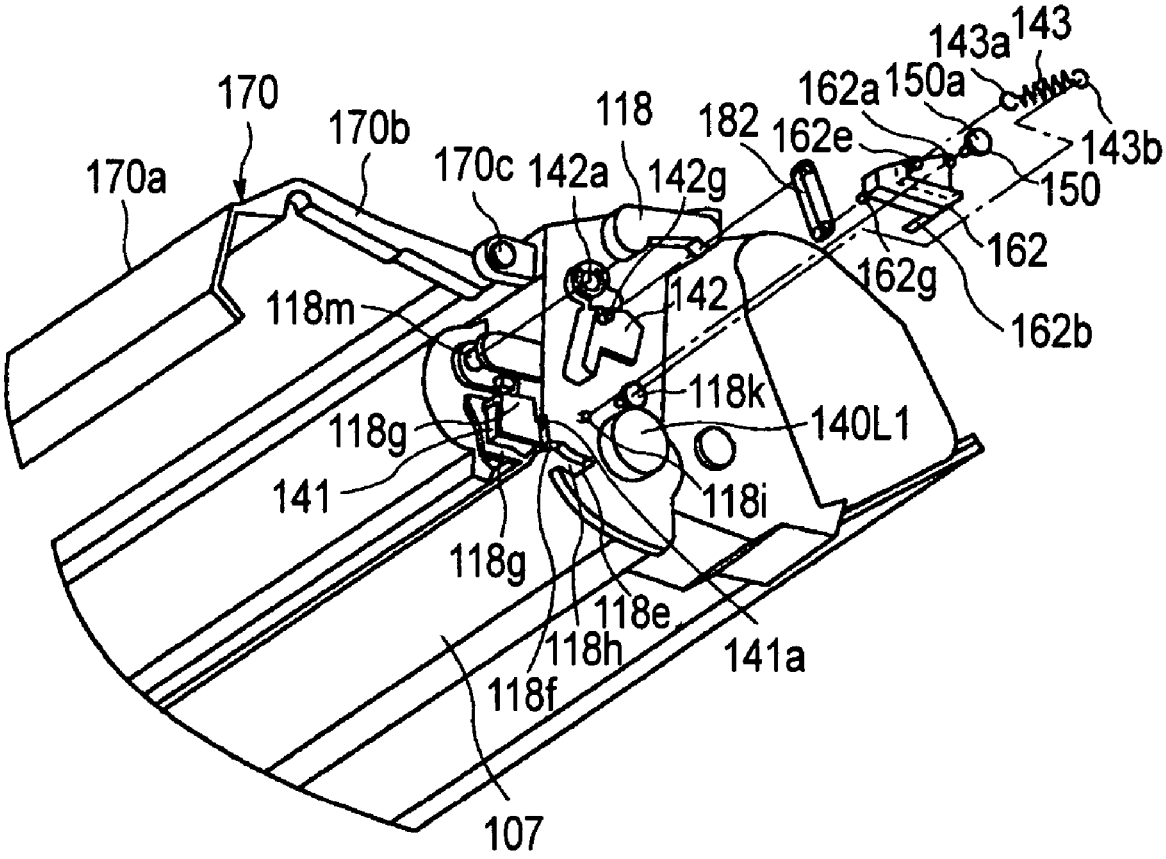
FIG. 39 is a perspective view showing a structure of a movable operation member of a process cartridge according to a further embodiment of the present invention.

(1) Movable Member Provision on Cartridge A:

FIGS. 38 and 39 show a cartridge B according to this embodiment. FIG. 38 illustrates a state of the movable member 142 before the cartridge B is mounted to the main assembly of the apparatus A. In this embodiment, the cartridge movable member is constituted by a first cartridge movable member 142, a second cartridge movable member 162 and a third cartridge movable member 182.

Figure 40:
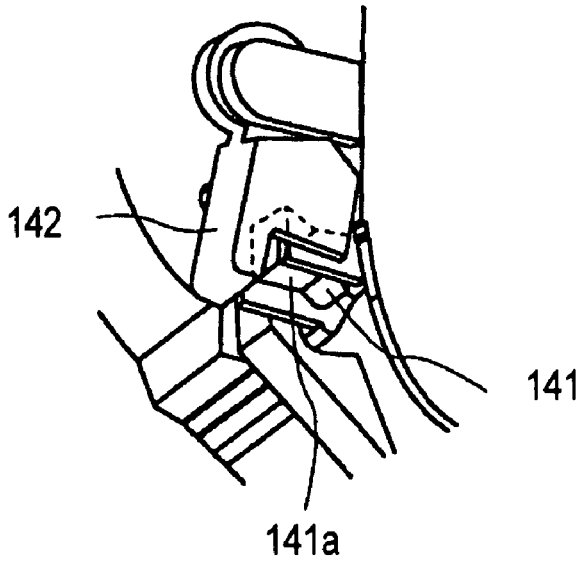
FIG. 40 is a perspective view showing a structure of a movable operation member of a process cartridge according to a further embodiment of the present invention.

FIG. 39 is a perspective view illustrating a method of mounting the first, second and third cartridge movable members 142, 162, 182 on the drum frame 118, and FIG. 40 particularly shows the first movable member 142 and the cartridge charging electrical contact member 141 with the other members omitted for better understanding.

Figure 41:
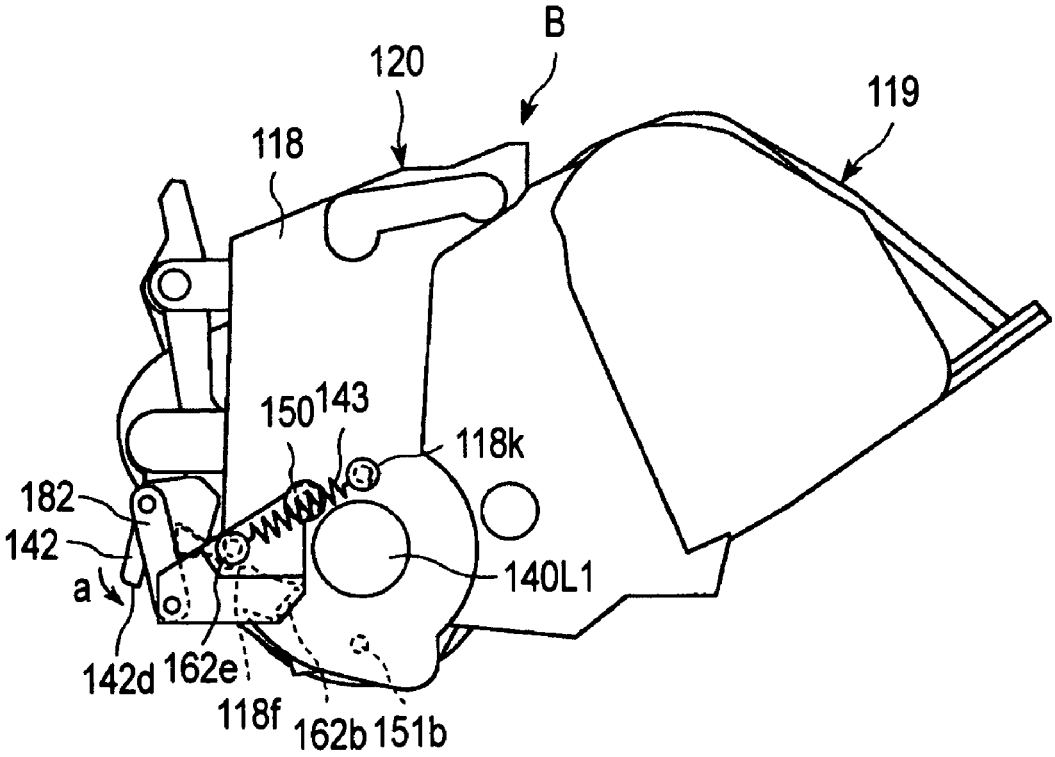
FIG. 41 is a side view of a structure of a movable operation member according to a further embodiment of the present invention.
Figure 42:
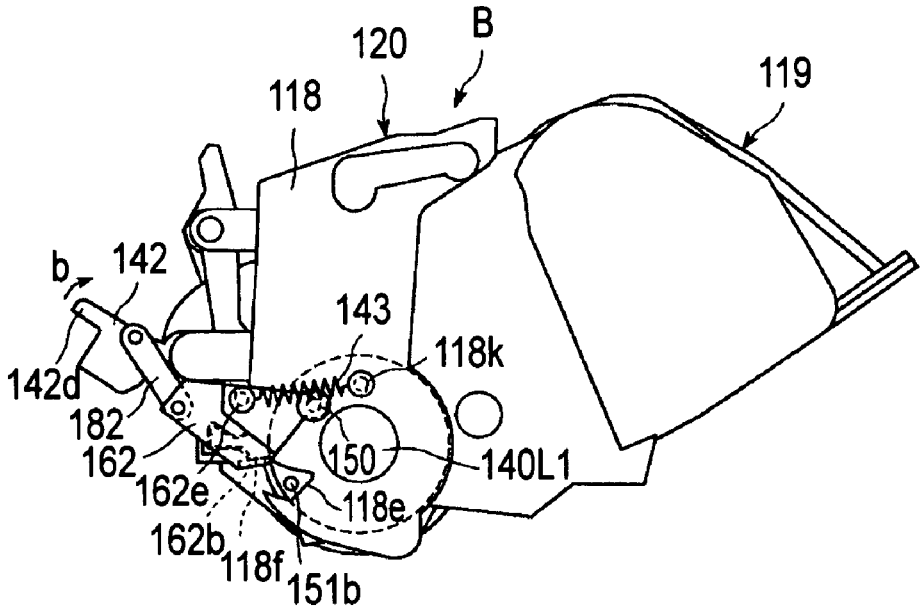
FIG. 42 is a side view of a structure of a movable operation member according to a further embodiment of the present invention.

FIG. 41 is a side view showing states of the first, second and third cartridge movable members 142, 162, 182 before the cartridge B is mounted to the main assembly A of the apparatus. FIG. 42 is a side view of the state wherein by the rotation of the photosensitive drum 107 after the mounting, the movable member 142 is moved to abut the abutting portion.

The cartridge B comprises a drum unit 120 and a developing unit 119 connected similarly to Embodiment 1. As shown in FIG. 39, adjacent a front side at a longitudinal end of the cartridge B, an electrical contact 141*a* for applying the charging bias voltage to the charging roller 108 is provided so as not to project beyond the surface of the drum frame 118, and is surrounded by a rib 118*g*. A region of the charging electrical contact member 141 adjacent the corner portion is an electrical contact (input electrical contact) 141*a* for electrical contact with an electrical contact (output contact) 144*a* of the main assembly charging contact member 144 provided in the main assembly A of the apparatus.

The drum frame 118 is provided with a drum shutter 170 for protecting a photosensitive drum 107. The drum shutter 170 has a shutter portion 170*a* covering the photosensitive drum 107, supporting arms 170*b* at the opposite ends (only one end is shown), and a shaft portion 170*c*. It is rotatably supported by the drum frame 118 for rotation about the shaft portion 170*c*. The shutter 170 rotates in the direction of the arrows in interrelation with the mounting operation of the cartridge B to the main assembly A of the apparatus. It moves from the position (FIG. 38) for protecting the photosensitive drum 107 to the position (FIG. 39) for exposing the photosensitive drum 107.

As shown in FIG. 39, to the drum frame 118, the first, second and third cartridge movable members 142, 162, 182 are mounted. This constitutes a quadric link.

The first cartridge movable member 142 is rotatably mounted on the shaft 118*m*. The second cartridge movable member 162 makes the same motions as the cartridge movable member 142 (Embodiment 1-Embodiment 4). A hole portion 162*a* of the second cartridge movable member 162 is penetrated by a retaining shaft 150 in the form of axially connected circular columns having different diameters (stepped shaft). The retaining shaft 150 is press-fitted into a retaining hole 118*i* of the drum frame 118. By doing so, the second cartridge movable member 162 is rotatably supported for rotation about the retaining shaft 150. The retaining shaft 150 has a large diameter portion 150*a* for retaining the second cartridge movable member 162. When the second cartridge movable member 162 is assembled, an abutting portion 162*b* for engagement with the eccentric shaft of the flange, which will be described hereinafter, enters an opening 118*h* provided in a side surface of the drum frame 118.

Holes of the third cartridge movable member 182 formed at the opposite end portions are rotatably connected with a projected shaft 142*g* of the first cartridge movable member 142 and a projected shaft 162*g* of the second cartridge movable member 162. This constitutes a structure.

A motion of the quadric link is limited by rotation of the second cartridge movable member 162. More particularly, with respect to the direction of the arrow a (FIG. 41), the movement range of the first cartridge movable member 142 is limited by abutment of the abutting portion 162*b* of the second cartridge movable member 162 to the abutting portion 118*e* (position of FIG. 41). With respect to the direction of the arrow b, the range of the first cartridge movable member 142 is limited by abutment of the abutting portion 142*b* of the second cartridge movable member 162 to the abutting portion 118*f*. The range of the quadric link is limited in this manner.

As shown in FIG. 39, a one end 143*a* of a tension coil spring 143 is hooked with a spring supporting portion 162*e* of the spring. The other end 143*b* of the spring 143 is mounting on a projected shaft 118*k* on the side surface of the drum frame 118. As shown in FIG. 39, the spring supporting portion 142*e* and the projected shaft 118*k* have large diameter portions having a diameter larger than the outer diameter of the spring 143 to retain the spring 143. When the second cartridge movable member 162 moves within the movable range thereof, the spring 143 always produces a force in a direction of compression by maintaining the spring 143 in a sufficiently expanded state.

When the second cartridge movable member 162 is at a position closer to the position shown in FIG. 41 than the balanced position of the toggle mechanism (unshown), the spring force urges the first cartridge movable member 142 in the direction of the arrow a. As shown in FIG. 41, the second cartridge movable member 162 urged by the coil spring 143, is determined in the rotational direction position by abutment of the abutting portion 162*b* to the abutting portion 118*e* of the drum frame 118. Therefore, the first cartridge movable member 142 moves to the position corresponding to the movement of the quadric link mechanism.

When the second cartridge movable member 162 is at a position closer to the position FIG. 42 than the balanced position of the toggle mechanism, the spring force urges the first cartridge movable member 142 in the direction of the arrow b. As shown in FIG. 42, the second cartridge movable member 162 urged by the coil spring 143 is determined in the rotational direction position by abutment of the abutting portion 162*b* to the abutting portion 118*f* of the drum frame 118. The first cartridge movable member 142 moves to the position corresponding to the quadric link mechanism.

A flange 151 is securedly fixed to one end of the photosensitive drum 107 in the same structure as with FIG. 12 (Embodiment 1). The flange 151 has a hole portion 151*a* and an eccentric shaft 151*b*. The hole portion 151*a* is supported by a small diameter portion of the cylindrical portion 140L1. By doing so, the eccentric shaft 151*b* rotates about the small diameter portion 140L1*a* together with the rotation of the photosensitive drum 107. This is the same as Embodiment 1.

The abutting portion 162*b* penetrates the opening 118*h* and projects further inwardly. The degree of projection is such that it overlies with the eccentric shaft 151*b* with respect to the direction of the rotational axis of the photosensitive drum 107 as shown in FIG. 20 of Embodiment 1.

With this structure described above, similarly to Embodiment 1, when the photosensitive drum 107 rotates, the eccentric shaft 150*b* and abutting portion 162*b* of the second cartridge movable member 162 are engaged to each other, and then, they move together. Therefore, with the movement of the second cartridge movable member 162, the first cartridge movable member 142 moves from the position shown in FIG. 41 to the position shown in FIG. 42.

(2) Charging Electrical Contact Provided in Main Assembly of Apparatus A:

A description will be provided as to the main asseambly A of the apparatus to which the cartridge B is mountable.

Figure 43:
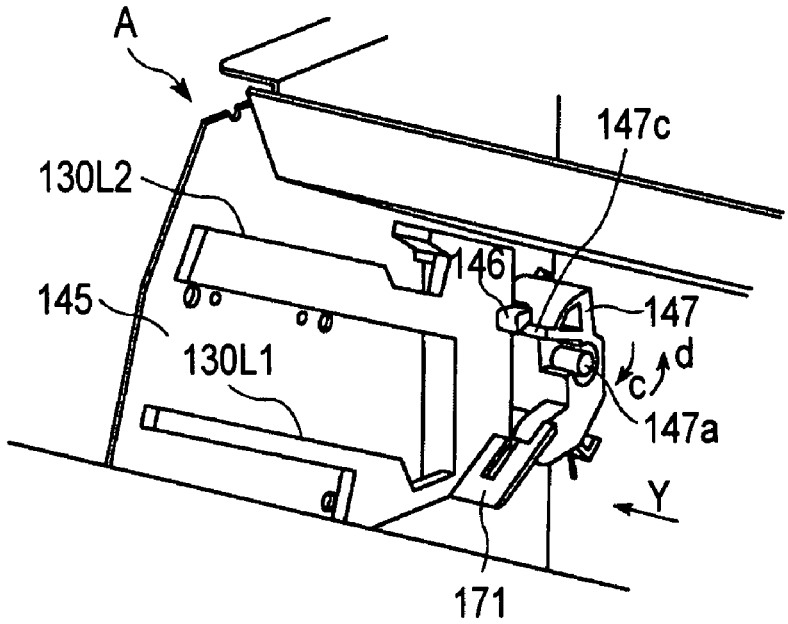
FIG. 43 is a perspective view showing a structure of an electrical contact of a main assembly of the image forming apparatus according to a further embodiment of the present invention.

As shown in FIG. 43, inside the main assembly A of the apparatus, there is provided a main assembly charging contact member 144 for applying the charging bias voltage to the charging roller 108 by contact to the contact 141*a* of the cartridge charging contact member 141.

When the cartridge B is not mounted to the main assembly A of the apparatus, the main assembly charging contact member 144 is in a retracted position where it is not projected from the cover 171 provided on an inner surface of the main assembly A of the apparatus. The main assembly charging contact member 144 is electrically connected to a high voltage electric circuit which is provided in the main assembly A of the apparatus by a lead or the like.

Similarly to Embodiment 1, inside the main assembly A of the apparatus, a fixed member 146 is projected from the inner side plate 145. Downstream of the fixed member 146 with respect to the mounting direction of the cartridge B, the one end portion 147*c* of the main assembly movable member 147 is projected.

Figure 44:
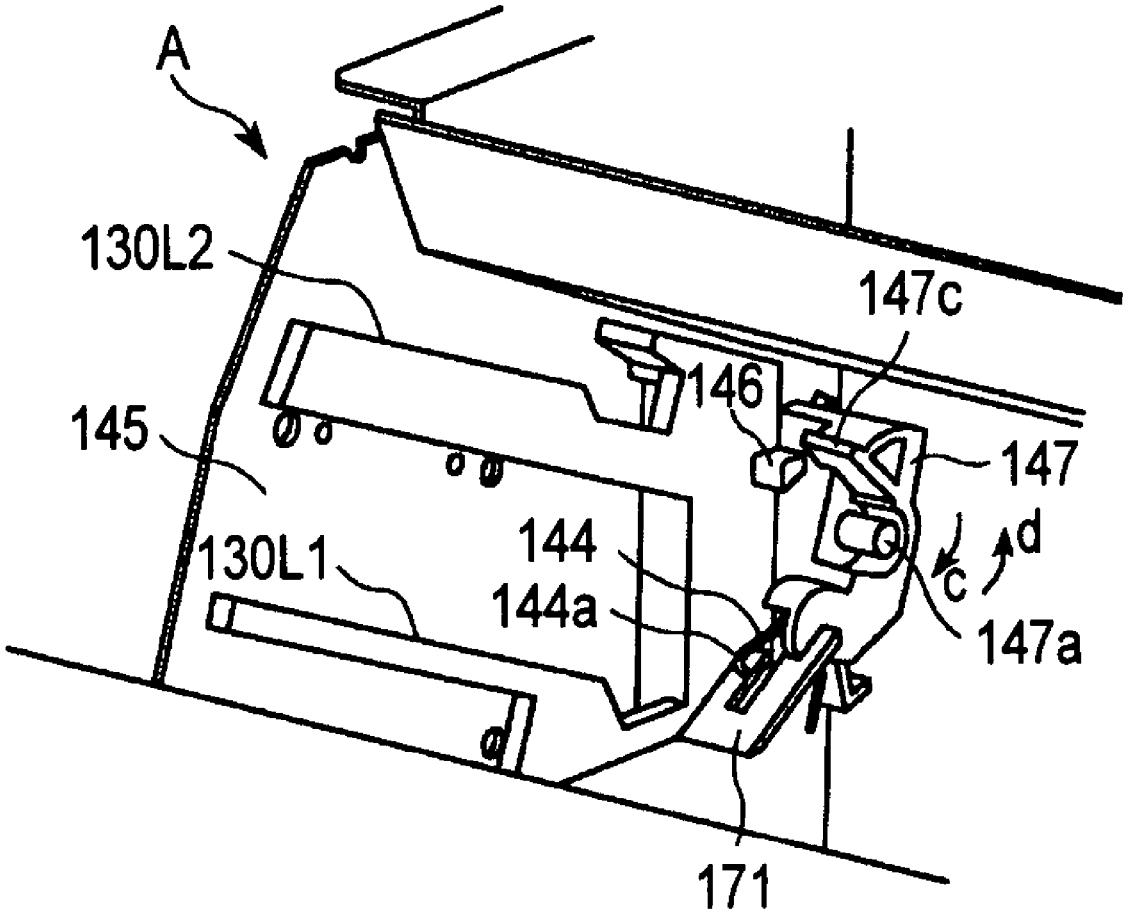
FIG. 44 is a perspective view showing a structure of an electrical contact of a main assembly of the image forming apparatus according to a further embodiment of the present invention.

The main assembly movable member 147 is rotatable about the shaft portion 147*a*. The main assembly movable member 147 rotates in the direction of the arrows c, d in interrelation with the rotating operation of the movable member 142. After completion of the mounting of the cartridge B to the main assembly A of the apparatus, and after the preparation of the image forming operation, the photosensitive drum 107 is rotated. Then, as shown in FIG. 44, the main assembly movable member 147 is pushed in the direction of the arrow c by the movable member 142 (FIGS. 38, 39). By this, in interrelation with the operation of the main assembly movable member 147, the charging electrical contact 144*a* is projected inwardly beyond the cover 171. And, the electrical contact 144*a* moves to contact the stationary electrical contact 141*a*. More particularly, while the contact 144*a* is making a rotational motion, it is contacted to the contact 141 which is in the stand-by state and is stationary at the electrical contact position. The contact 144*a* is contacted to the contact 141*a*, and thereafter, it slides on the contact 141*a*. Therefore, foreign matter such as dust, developer or the like can be removed by the wiping action by the sliding. For this reason, the establishment of the electrical connection between the contacts is improved.

Figure 45:
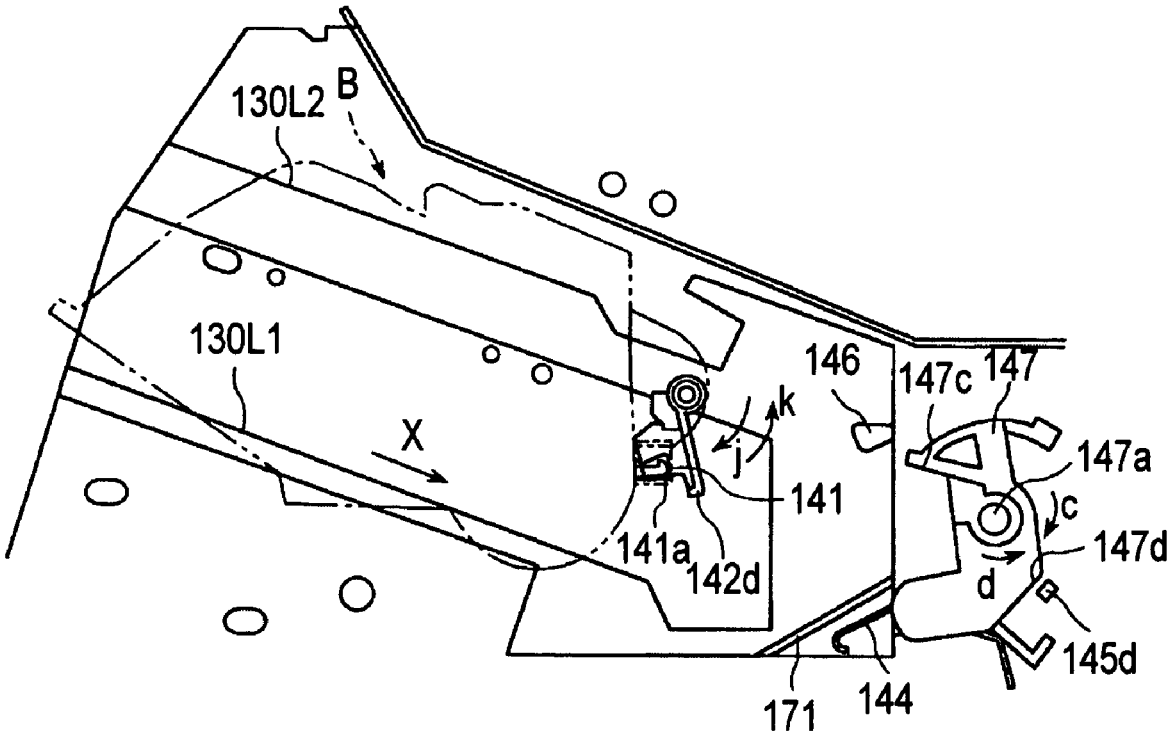
FIG. 45 illustrates structures of the movable operation member and the electrical contact of the image forming apparatus.

(3) Operations of Movable Member and Charging Contact Member:

A description will be provided as to the operations of the first cartridge movable member 142 and the main assembly charging contact member 144. FIG. 45 is a schematic view illustrating an operation when the cartridge B is inserted into the main assembly A of the apparatus.

Figure 46:
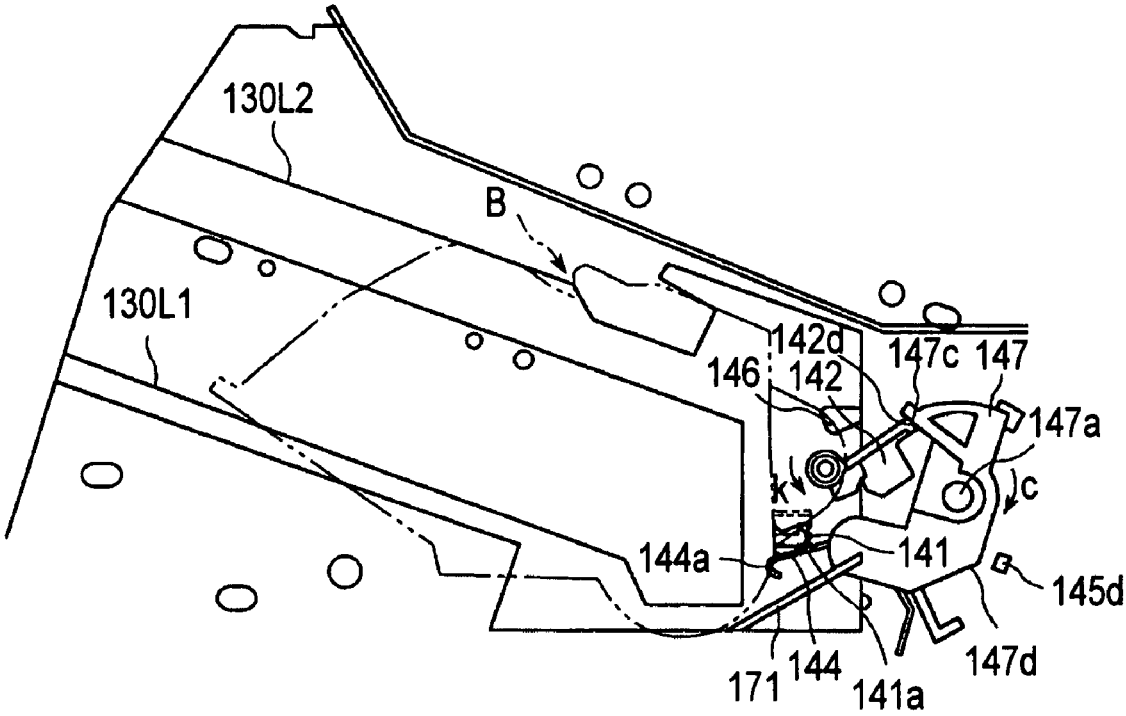
FIG. 46 illustrates structures of the movable operation member and the electrical contact of the image forming apparatus.

FIG. 45 is a view of an inner side plate 145 provided in the main assembly A of the apparatus as seen from an inside of the main assembly of the apparatus (in the direction of arrow Y in FIG. 43). FIG. 45 illustrates the behavior during the process of mounting the cartridge B into the apparatus, and FIG. 46 illustrates the behavior after the mounting, wherein the contact 141*a* and the contact 144*a* are contacted to each other.

As shown in FIG. 45, the main assembly movable member 147 is rotatably supported by the inner side plate 145 for rotation about the shaft portion 147*a*. The main assembly charging contact member 144 is mounted to the main assembly movable member 147. The main assembly movable member 147 is urged in the direction of the arrow d by a compression spring (unshown). By this, the main assembly movable member 147 is position by the abutting portion 147*d* abutting the abutting portion 145*d* of the inner side plate 145. At this time, the electrical contact 144*a* is at such a position where it does not project into the main assembly A of the apparatus beyond the cover 171.

The cartridge B is inserted in the direction of arrow X along the guide portions 130L1, 130L2.

At the position shown in FIG. 45, as described hereinbefore, the second cartridge movable member 162 is urged in the direction of an arrow j by the function of the coil spring 143. By this, the movable member 162 is disposed at the position where the abutting portion 162*b* abuts the abutting portion 118*e* of the drum frame 118. The contact 144*a* is at the position not projecting beyond the cover 171, as described hereinbefore.

After the completion of mounting of the cartridge B into the main assembly A of the apparatus, the cartridge door 109 (FIG. 3) is closed. In response to this, the image forming apparatus 100 starts preparation for image formation.

Then, the main assembly A of the apparatus starts the operation, and the driving force is transmitted to rotate the photosensitive drum 107. As described hereinbefore, the first cartridge movable member 142 rotates in the direction of arrow k from the position shown in FIG. 41. The movable member 142 rotates beyond the balanced position to the position shown information FIGS. 42 and 46.

At this time, the engaging portion 142*d* of the first cartridge movable member 142 first starts contacting to the one end 147*c* of the main assembly movable member 147. The movable member 142 rotates further in the direction of arrow k. Then, the engaging portion 142*d* of the movable member 142 pushes the main assembly movable member 147. This rotates the main assembly movable member 147 in the direction of the arrow c. By this, the electrical contact 144*a* projects out to the outside of the cover 171 into the inside of the main assembly A of the apparatus from the position where it is retracted behind the cover 171 (FIG. 45). During the rotation of the movable member 142 to the position shown in FIG. 46, the engaging portion 142*d* rotates the main assembly movable member 147 further in the direction of the arrow c. In interrelation with this, the electrical contact 144*a* is further projected beyond the cover 171. By this, the electrical contact 144*a* moves to contact to the stationary electrical contact 141*a*.

This enables application of the charging bias to the charging roller 108 from the main assembly of the apparatus A.

When the cartridge B is to be taken out of the main assembly A of the apparatus, the movable member 142 is engaged with the fixed member 146, similarly to Embodiment 1. By this, the movable member 142 is rotated to the position shown in FIG. 41. In interrelation with the motion of the movable member 142, the main assembly movable member 147 moves in the direction of the arrow d. Then, the electrical contact 144*a* returns to the retracted position from the projecting position.

When the cartridge B is removed out of the main assembly A of the apparatus, the electrical contact 141*a* is again covered by the cartridge movable member 142 and is protected thereby.

This embodiment provides the same advantageous effects as with Embodiment 1.

In this embodiment, the cartridge movable members 142, 162, 182 are disposed outside a passing path of the supporting arm 170*b* with respect to the direction of the rotational axis of the drum shutter 170. By doing so, there is no need to consider the timing of opening and closing of the cartridge movable members 142, 162, 182 and the drum shutter 170 when the cartridge B is mounted and dismounted. In addition, the image forming apparatus can be downsized.

This embodiment utilizes rotation of the photosensitive drum 107 to move the cartridge movable member 142. However, the present invention is not limited to such a structure. For example, the rotation of the developing roller 110 is usable in place of the rotation of the photosensitive member.

Embodiment 6

Referring to FIG. 47–FIG. 53, sixth embodiment will be described.

The same reference numerals as with Embodiment 5 are assigned to the elements having the corresponding functions, and the detailed descriptions for such elements are omitted for simplicity. The difference from Embodiment 5 is in that the electrical contact 141*a* is protected not by the rib 118*g* of the drum frame 118 but by the first cartridge movable member 142.

More particularly, the contact 141*a* is disposed behind the first cartridge movable member 142. By doing so, the movable member 142 can cover the contact 141*a*. This embodiment is the same as Embodiment 5 in the other respect except for particularly mentioned. A description will be provided as to the structural portions which are different from those of Embodiment 5. The same reference numerals as with Embodiment 5 are assigned to the elements having the corresponding functions, and the detailed descriptions for such elements are omitted for simplicity.

Figure 47:
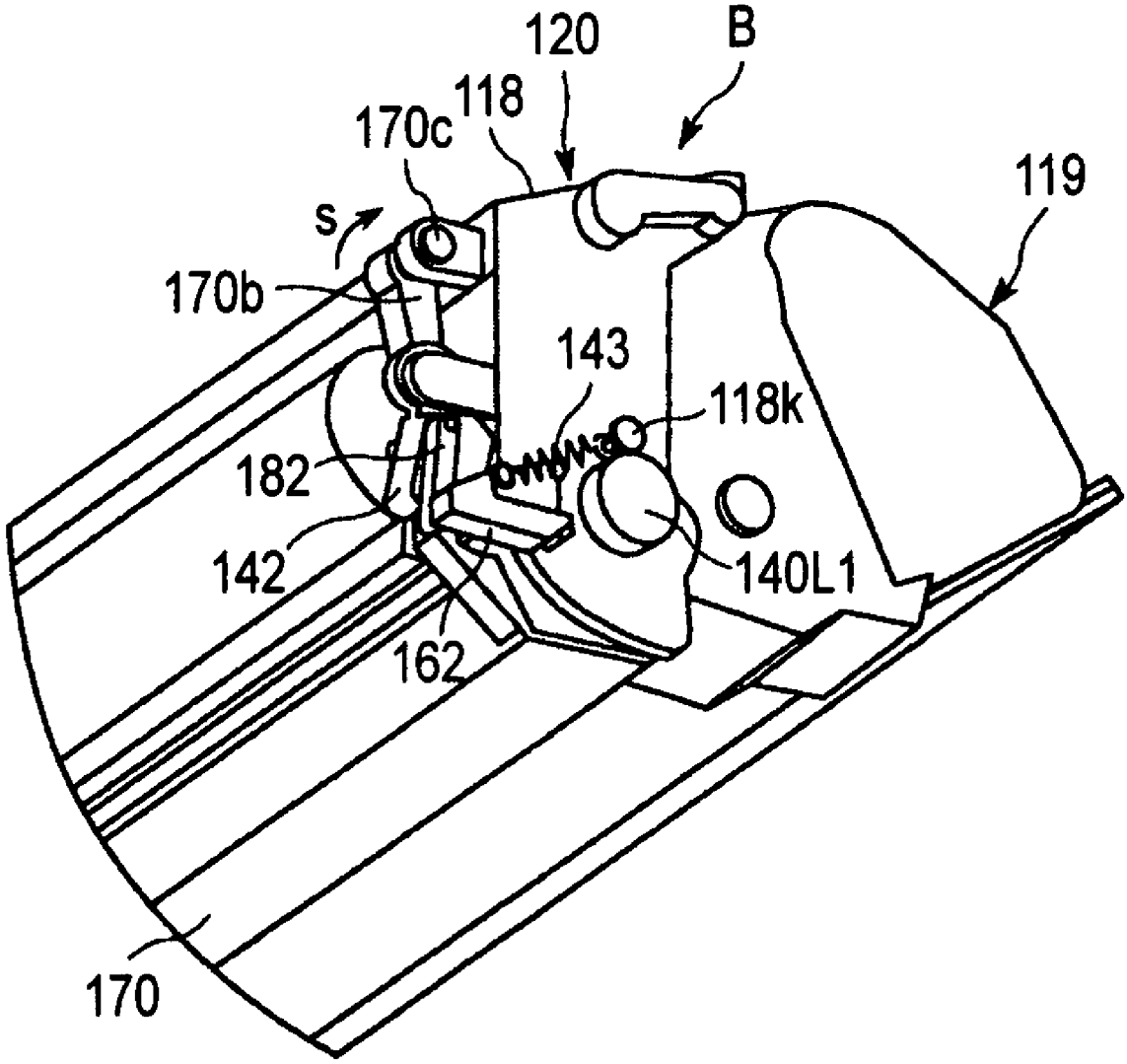
FIG. 47 is a perspective view showing a structure of a movable operation member of a process cartridge according to a further embodiment of the present invention.
Figure 48:
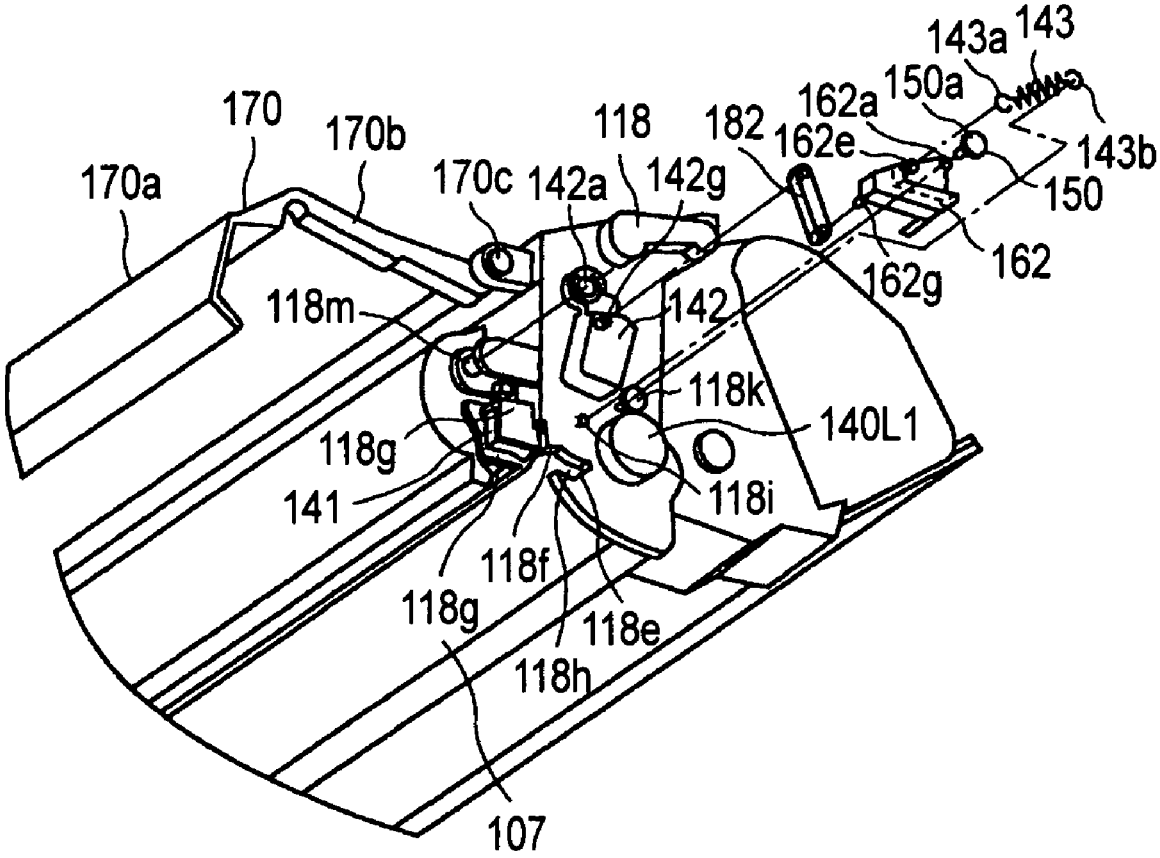
FIG. 48 is a perspective view showing a structure of a movable operation member of a process cartridge according to a further embodiment of the present invention.
Figure 49:
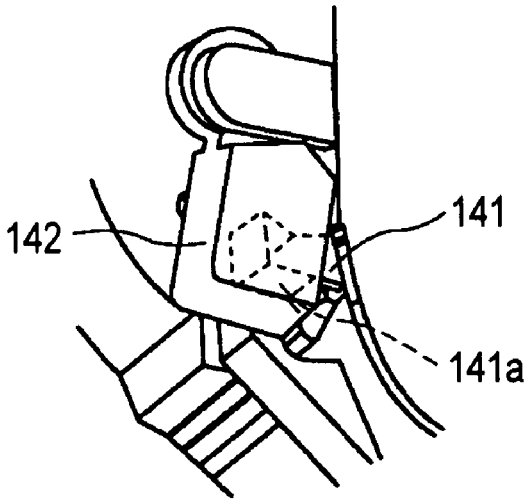
FIG. 49 is a perspective view showing a structure of a movable operation member of a process cartridge according to a further embodiment of the present invention.

FIG. 47–FIG. 51 illustrate a cartridge B according to this embodiment. FIG. 47–FIG. 51 correspond to FIG. 38–FIG. 42 of Embodiment 5. FIG. 47 is a perspective view showing the structures of first, second and third cartridge movable members 142, 162, 182 before the cartridge B is mounted to the main assembly A of the apparatus. FIG. 48 illustrates a mounting method of the movable members 142, 162, 182 to the drum frame 118. FIG. 49 particularly shows the first movable member 142 and the cartridge charging electrical contact member 141 with the other members omitted for better understanding.

Figure 50:
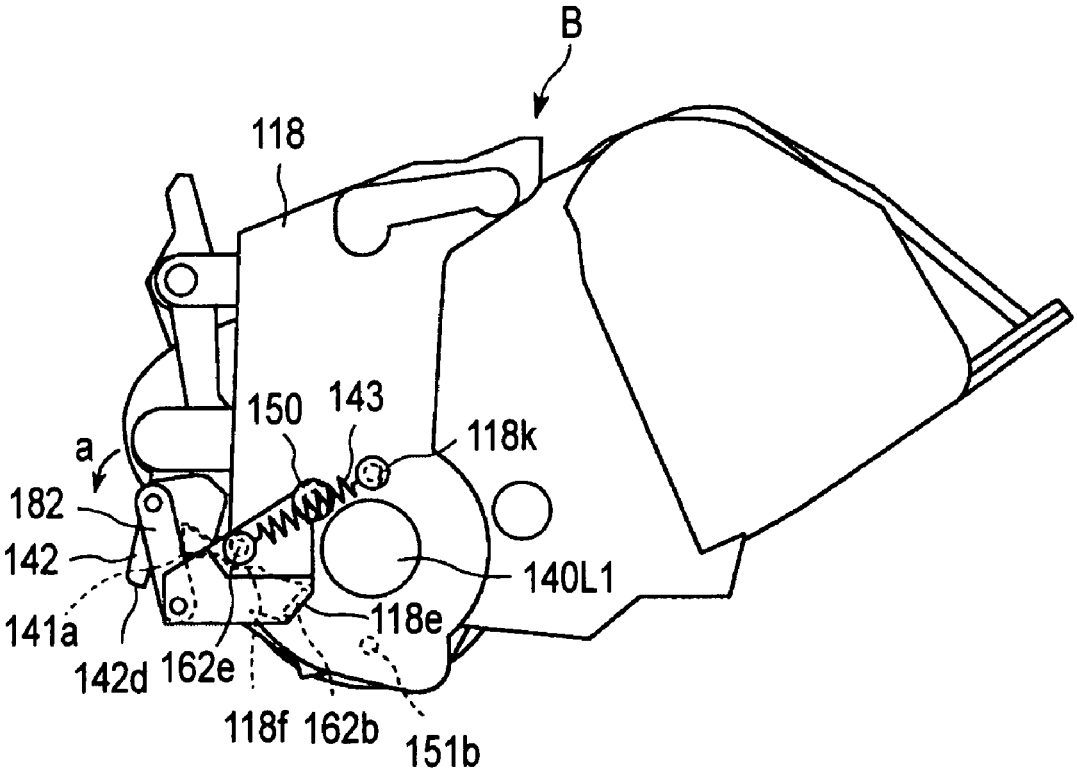
FIG. 50 is a side view of a structure of a movable operation member according to a further embodiment of the present invention.
Figure 51:
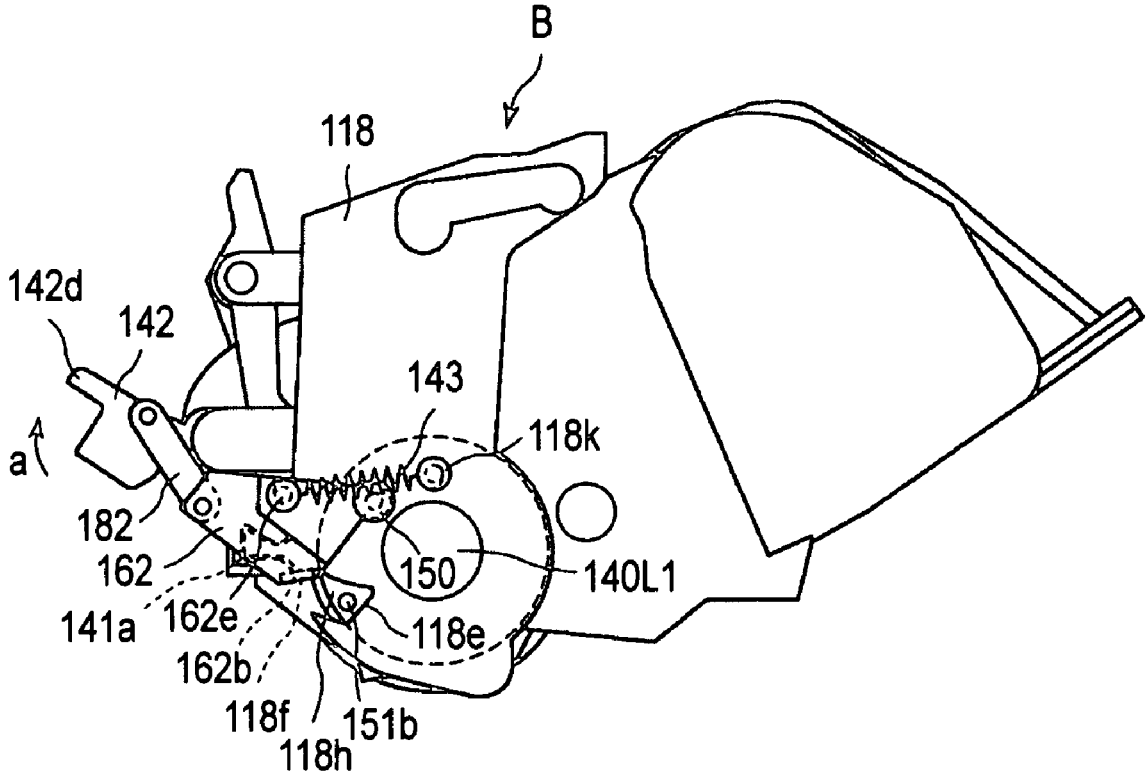
FIG. 51 is a side view of a structure of a movable operation member according to a further embodiment of the present invention.

FIG. 50 is a side view showing states of the first, second and third cartridge movable members 142, 162, 182 before the cartridge B is mounted to the main assembly A of the apparatus. FIG. 51 is a side view of the state wherein by the rotation of the photosensitive drum 107 after the mounting, the movable member 162 is moved to abut the abutting portion 118*e*.

Figure 52:
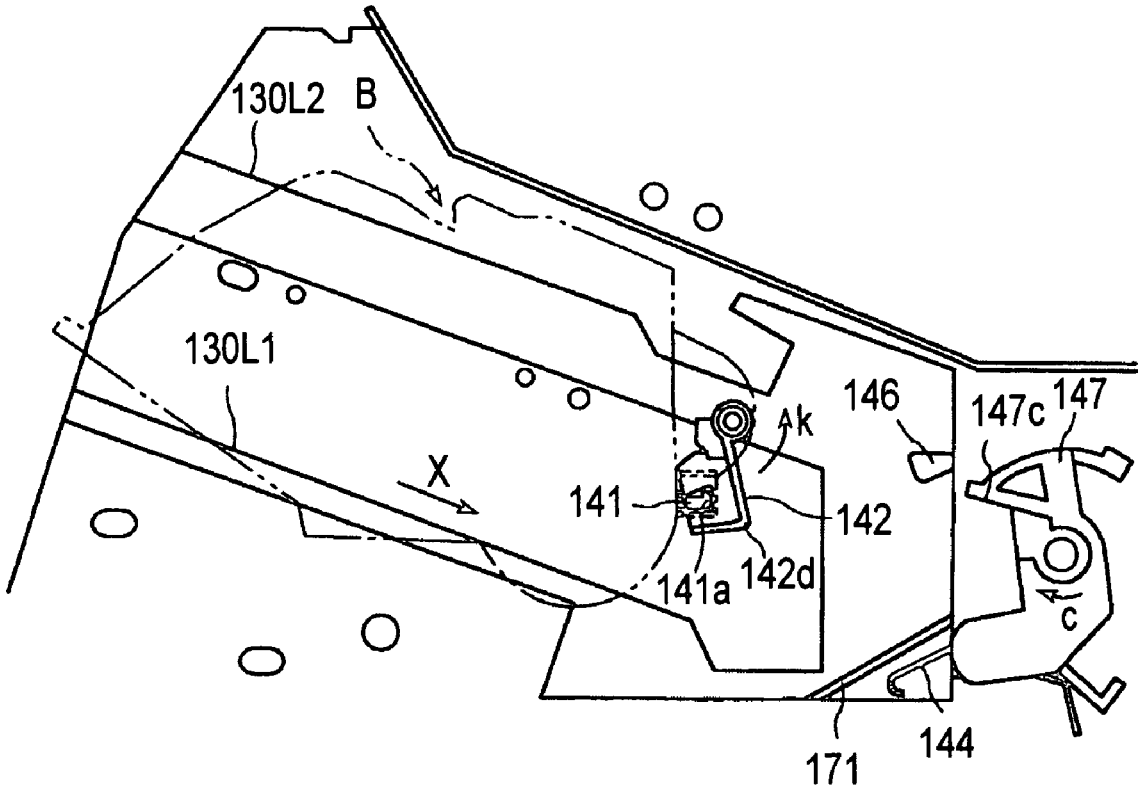
FIG. 52 illustrates structures of the movable operation member and the electrical contact of the image forming apparatus.
Figure 53:
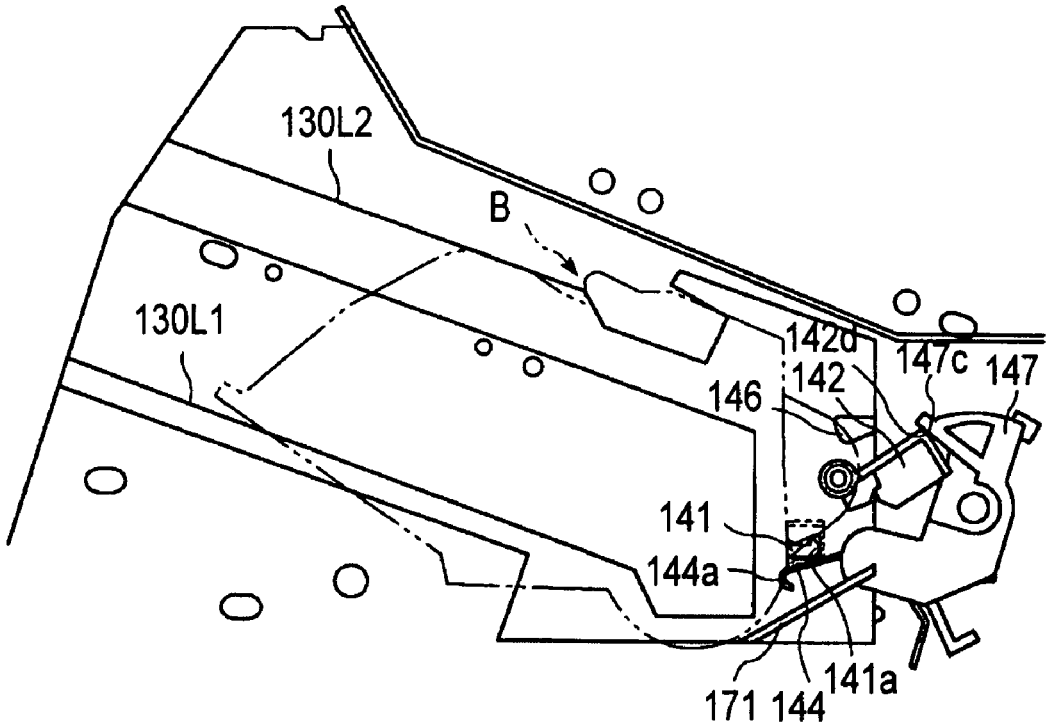
FIG. 53 is a perspective view showing a structure of a movable operation member of a process cartridge according to a further embodiment of the present invention.
Figure 54:
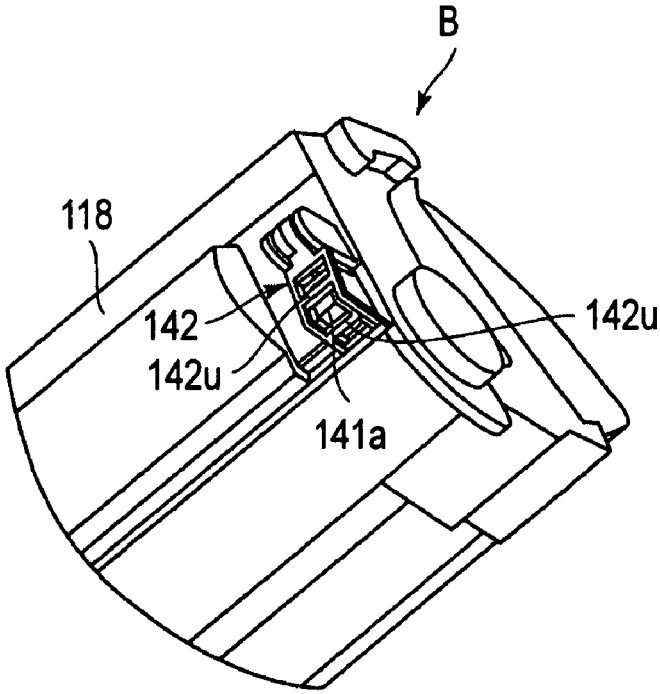
FIG. 54 illustrates structures of the movable operation member and the electrical contact of the image forming apparatus.

FIG. 52 and FIG. 53 correspond to FIG. 45 and FIG. 46 of Embodiment 5. FIG. 52 is a view of an inner side plate 145 provided in the main assembly A of the apparatus as seen from an inside of the main assembly of the apparatus (in the direction of arrow Y in FIG. 43). FIG. 52 illustrates the behavior during the process of mounting the cartridge B into the apparatus A. FIG. 54 illustrates the behavior after the mounting, wherein the contact 141*a* and the contact 144*a* are contacted to each other by movement of the first cartridge movable member 142.

(1) Cartridge Charging Contact Member and Cartridge Movable Member:

As shown in FIG. 48, adjacent a longitudinal end at a front side (leading side) with respect to the mounting direction X of the cartridge B, there is an electrical contact 141*a* for applying the charging bias voltage to the charging roller 108. A region of the charging electrical contact member 141 adjacent the corner portion is an electrical contact (input electrical contact) 141*a* for electrical contact with an electrical contact (output contact) 144*a* of the main assembly charging contact member 144 provided in the main assembly A of the apparatus. FIG. 48 corresponds to FIG. 39 of Embodiment 5.

In the state shown in FIG. 49, the contact 141*a* is disposed behind the movable member 142 so as to prevent the contact 141*a* from being exposed. Thus, the contact 141*a* is protected by the movable member 142. FIG. 49 corresponds to the state shown in FIG. 40 of Embodiment 5.

(2) Operation of Cartridge Movable Member:

The toggle operation of the cartridge movable member 142 is the same as with Embodiment 5. The movable member 142 is rotated in the direction of the arrow b by rotation of the photosensitive drum 107. The movable member 142 rotates beyond the balanced position to the position shown information FIG. 51. Then, the movable member 142 rotates in the direction of the arrow b so that the electrical contact 141*a* is gradually exposed, until it is completely exposed. FIG. 50 corresponds to FIG. 41. FIG. 51 corresponds to FIG. 42.

(3) Main Assembly Charging Contact Member Provided in Main Assembly A of Apparatus:

The main assembly charging contact member 144 provided in the main assembly A of the apparatus has the structure similar to Embodiment 5. That is, the structure has been described in conjunction with FIG. 43.

(4) Operations of Movable Member and Main Assembly Charging Contact Member:

The structure by which the contact 144*a* is contacted to the electrical contact 141*a* by the movement of the movable member 142 is the same as with Embodiment 5.

The electrical contact 141*a* is covered by the movable member 142 and is not exposed, before the cartridge B is mounted to the main assembly A of the apparatus, during the process of cartridge mounting (FIG. 52), and immediately after the mounting. Namely, it is protected by the movable member 142.

After the completion of the mounting of the cartridge B, the cartridge door 109 (FIG. 3) is closed. By this, the main assembly A of the apparatus starts preparation for image formation.

Then, the main assembly A of the apparatus starts to operate, and the driving force is transmitted to rotate photosensitive drum 107. Then, the movable member 142 rotates from the position of FIG. 52 to the position of FIG. 51 in the direction of arrow b. By this, the electrical contact 141*a* is exposed gradually. Simultaneously, the movable member 142 is contacted to the main assembly movable member 147. By the mechanism described with respect to Embodiment 5, the charging member 144 of the main assembly is moved toward inside of the main assembly A of the apparatus. After the electrical contact 141*a* is completely exposed, the contact between said electrical contact 141*a* and the electrical contact 144 starts.

Finally, the movable member 142 is moved to the position shown in FIG. 51 and FIG. 53. It stops at the state in which the contact 141*a* and the electrical contact 144*a* are assuredly contacted. More particularly, the electrical contact 144*a* moves to the contact 141*a* to contact it. With this state, the movable member 142 stops.

This enables application of the charging bias to the charging roller 108 from the main assembly of the apparatus A.

When the cartridge B is to be removed from the main assembly A of the apparatus, the movable member 142 is returned to the position shown in FIG. 50 and FIG. 52 through the operations similar to Embodiment 5.

When the cartridge B is taken out of the main assembly of the apparatus A, the movable member 142 is returned to the position of FIG. 50 through the operations similar to Embodiment 5. In interrelation with the motion of the movable member 142, the main assembly movable member 147 moves in the direction of the arrow d (FIG. 43), by which the contact 144*a* is returned to the retracted position from the projecting position (FIG. 43 and FIG. 52).

When the cartridge B is removed out of the main assembly of the apparatus, the contact 141*a* is again covered by the movable member 142 and is protected thereby.

This embodiment provides the same advantageous effects as with Embodiments 1 and 2.

Similarly to Embodiment 2, the cartridge movable member 142, 162, 182 are disposed outside the passing path of the supporting arm in this embodiment. Therefore, by doing so, there is no need to consider the timing of opening and closing of the cartridge movable members 142, 162, 182 and the drum shutter 170 when the cartridge B is mounted and dismounted. In addition, the image forming apparatus can be downsized.

In this Embodiment 6, the charging contact is protected. However, the present invention is not limited to such a structure. For example, a developing device contact may be protected by the same structure.

In the foregoing embodiments, the rotating force of the photosensitive drum 107 and the elastic force of the spring 143 are used to rotate the movable member 142. However, the present invention is not limited to such a case. For example, the movable member may be moved only by the rotating force of the photosensitive drum. Or, in place of the rotational force of the photosensitive drum, a rotating force of a developing roller may be used.

This Embodiment 6 protects the charging contact only. However, the present invention is not limited to this example. For example, the structure for protecting the developing device contact shown in Embodiment 4 may be incorporated. In such a case, both of the electrical contacts are protected.

The movable member 142 does not necessarily completely cover the electrical contact 141*a*. For example, the movable member 142 or the projected portion or the like may be projected beyond the surface of the electrical contact. Or, a part of the surface of the electrical contact is covered by the movable member 142 or projected portion or the like. By doing so, a similar effect can be provided. A description will be provided as to various modifications of "cover" in the following Embodiment 7.

Embodiment 7

Referring to FIG. 54–FIG. 58, seventh embodiment will be described.

In this embodiment, a description is provided only as to the portion different from the Embodiments 1–6.

FIG. 54–FIG. 58 show examples of the movable member 142. In these, the members other than the movable member 142 are omitted. The cartridge B of the embodiment has a contact 141*a* similarly to Embodiments 5 and 6. A region of the charging electrical contact member 141 adjacent the corner portion is an electrical contact (input electrical contact) 141*a* for electrical contact with an electrical contact (output contact) 144*a* of the main assembly charging contact member 144 provided in the main assembly of the apparatus A. The movable member 142 is supported and positioned similarly to Embodiment 5 and Embodiment 6.

In FIG. 54, the movable member 142 encloses the contact 141*a* in the stand-by state. In this example, the surface of the contact 141*a* is surrounded by a skeleton structure having a plurality of ribs 142*u* of the movable member 142.

Figure 55:
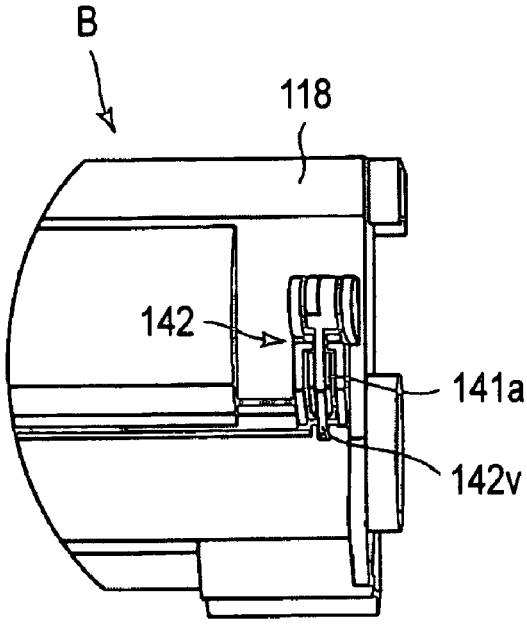
FIG. 55 illustrates structures of the movable operation member and the electrical contact of the image forming apparatus.

In FIG. 55, the movable member 142 is provided with a rib 142*v* covering a part of the contact 141*a* in the stand-by state.

Figure 56:
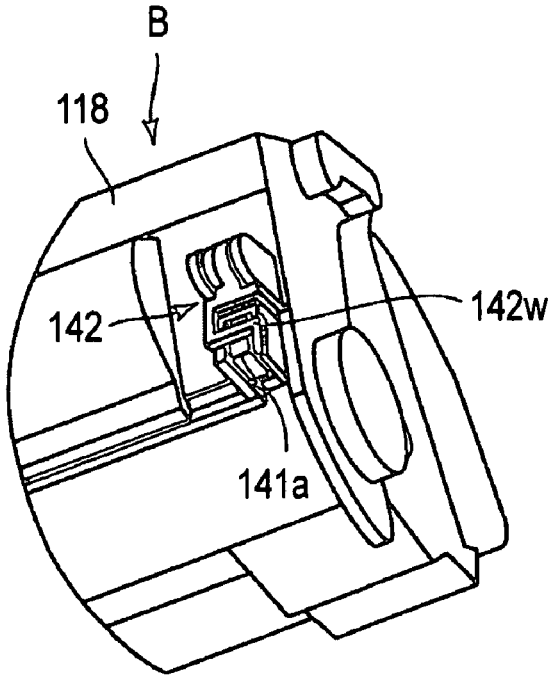
FIG. 56 illustrates structures of the movable operation member and the electrical contact of the image forming apparatus.
Figure 57:
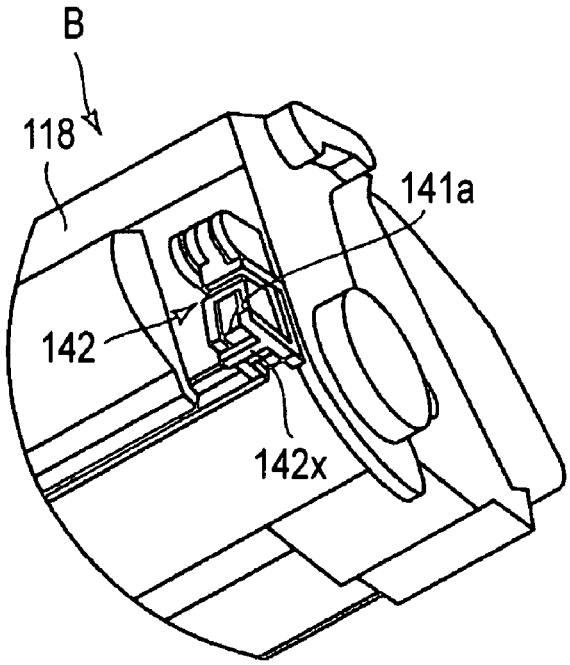
FIG. 57 illustrates a structure of the movable operation member of the process cartridge according to the embodiment of the present invention.
Figure 58:
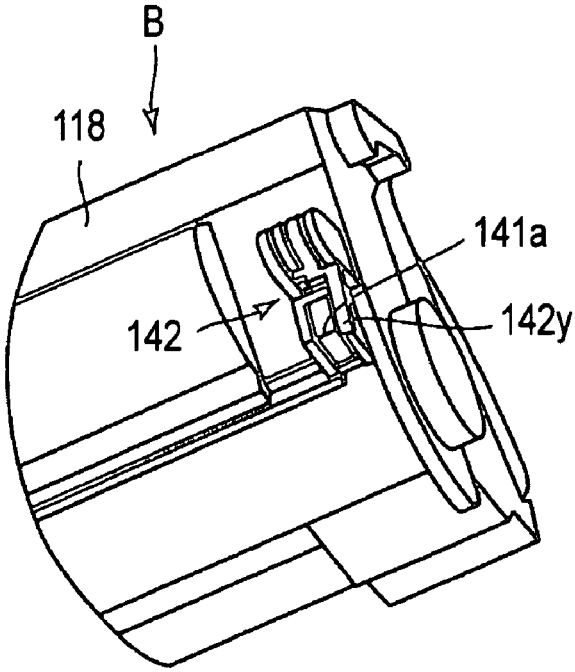
FIG. 58 illustrates a structure of an electrical contact portion in the main assembly of the image forming apparatus according to the embodiment of the present invention.

In the examples shown in FIGS. 56, 57, 58, the movable member 142 is provided with projected portions (surfaces) 142*w*, 142*x*, 142*y* which is higher than the surface of the contact 141*a* in the stand-by state. The projected portions 142*w*, 142*x*, 142*y* are provided partly around the contacts 141*a*.

In the example of FIG. 56, the projected portion 142*w* is provided on the movable member 142 so as to be positioned above the contact 141*a* in the Figure. In FIG. 57, the projected portion 142*x* is provided on the movable member 142 so as to be positioned faced to the contact 141*a* in the Figure. In the example of FIG. 58, the projected portion 142*y* is provided on the movable member 142 so as to be at the side surface portion of the contact 141*a* in the figure.

According to this embodiment including the various examples, the cartridge movable member 142 has a rib 142*u*, rib 141*v* or projected portions (surfaces) 142*w*, 142*x*, 142*y* at a level higher than the contact 141*a* adjacent the contact 141*a*. Therefore, the operator is effectively prevented from inadvertently touching the electrical contact during manipulation of the cartridge. Thus, the electrical contact 141*a* can be protected.

This embodiment provides the same advantageous effects as with Embodiments 1–6.

The process cartridge B to which the present invention is applicable is not limited to a process cartridge for formation of the monochromatic image. But it may be a color cartridge for the formation of a multicolor image (two-color images, three-color images, full-color images or the like) using a plurality of developing means. But, it is applicable to a color cartridge for formation of multicolor image is (two-color images, three-color images, full-color images or the like) using a plurality of developing means.

In the above-described, the electrophotographic photosensitive member has been described as photosensitive drum, but the electrophotographic photosensitive member is not limited to such a photosensitive drum, but the following is usable.

The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. Generally, however, a drum or a belt is used, and in the case of a drum type photosensitive member, a cylinder of aluminum alloy or the like is coated with a photoconductor by evaporation or application or the like.

Also, the present invention is preferably usable with various known developing methods such as the magnetic brush developing method using two component toner, the cascade developing method, the touch-down developing method, the cloud developing method.

The structure of the charging means described in the foregoing is of a so-called contact type charging method, but a known charging means comprising a tungsten wire which is enclosed in a metal shield of aluminum or the like at three sides, wherein positive or negative ions generated by application of a high voltage to the tungsten wire are directed to the surface of the photosensitive drum to uniformly charge the surface, is usable.

The charging means may be a roller type as described in the foregoing, a blade type (charging blade), a pad type, a block type, a rod type, a wire type or the like. As for a cleaning method for removing toner remaining on the photosensitive drum, a blade, a fur brush, a magnetic brush or the like is usable.

As described in the foregoing, the present invention provides a reliable establishment of the electrical connection between the output electrical contact of the main assembly of the electrophotographic image forming apparatus and the input electrical contact of the process cartridge when the process cartridge is mounted to the main assembly of the apparatus. In addition, the damage of the electric circuit of the main assembly of the image forming apparatus can be effectively prevented.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 411063/2003 and 352495/2004 filed Dec. 9, 2003 and Dec. 6, 2004, which are hereby incorporated by reference.

What is claimed is:

1. A process cartridge detachably mountable to a main assembly of an electrophotographic image forming apparatus, the main assembly including an output contact movable between an electrical connecting position and a retracted position retracted from the electrical connecting position, a displaceable member configured and positioned to move the output contact, and an elastic function member configured and positioned to elastically urge the displaceable member to urge the output contact toward the retracted position away from the electrical connecting position, said process cartridge comprising:

an electrophotographic photosensitive drum;

process means actable on said electrophotographic photosensitive drum;

a movable operation member movable relative to a cartridge frame, wherein after said process cartridge is mounted to the main assembly of the apparatus, said movable operation member is displaced by a driving force transmitted from the main assembly of the electrophotographic image forming apparatus to said process cartridge, so that said movable operation member is engaged with the displaceable member provided in the main assembly of the electrophotographic image forming apparatus to move the displaceable member, in interrelation with which the output contact is moved from the retracted position to the electrical connecting position against an elastic force of the elastic function member;

an input electrical contact configured and positioned to receive a voltage for enabling said process means by engagement with the output contact moved to the electrical connecting position.

2. A process cartridge according to claim 1, further comprising a driving force receiving portion configured and positioned to receive a driving force from the main assembly of the image forming apparatus when said process cartridge is mounted to said main assembly of the image forming apparatus, said driving force receiving portion being disposed at one end of said process cartridge with respect to a longitudinal direction of said electrophotographic photosensitive drum, and said movable operation member being disposed at the other end of said process cartridge with respect to the longitudinal direction.

3. A process cartridge according to claim 1 or 2, wherein said movable operation member is supported on a cartridge frame for rotation about a shaft relative to the cartridge frame, and said electrophotographic photosensitive drum is rotated by a driving force transmitted from the main assembly of the electrophotographic image forming apparatus to said process cartridge, wherein the driving force is transmitted to said movable operation member by rotation of said electrophotographic photosensitive drum to rotate said movable operation member relative to the cartridge frame.

4. A process cartridge according to claim 1 or 2, further comprising an elastic function member configured and positioned to apply an elastic force to said movable operation member, wherein the elastic force is contributable to rotation of said movable operation member.

5. A process cartridge according to claim 1 or 2, further comprising an elastic function member configured and positioned to apply an elastic force to said movable operation member, wherein said movable operation member is rotated by being pushed by a projection provided on said electrophotographic photosensitive drum which is rotated by the driving force, and wherein when said movable operation member is rotated beyond a balanced position, said movable operation member moves away from said projection, and said movable operation member starts rotating by the elastic force of said elastic function member of said process cartridge, thus moving the output contact from said retracted position to said electrical connecting position by movement of said movable operation member caused by the projection and said elastic function member of said process cartridge.

6. A process cartridge according to claim 1 or 2, wherein said process means includes a charging member configured and positioned to electrically charge said electrophotographic photosensitive drum, and said input electrical contact receives from the output contact the voltage for charging said electrophotographic photosensitive drum.

7. A process cartridge according to claim 1 or 2, wherein said process means includes a developing member configured and positioned to develop the electrostatic latent image formed on said electrophotographic photosensitive drum, and said input electrical contact receives from the output contact a voltage for developing the electrostatic latent image.

8. A process cartridge detachably mountable to a main assembly of an electrophotographic image forming apparatus, wherein the main assembly of the electrophotographic image forming apparatus includes a voltage source, a voltage source circuit electrically connected with the voltage source, a cartridge mounting portion configured and positioned to detachably mount said process cartridge, a fixed engageable member, an output contact movable between an electrical connecting position and a retracted position which is retracted from the electrical connecting position and which is outside the cartridge mounting portion, the output contact electrically connected with the voltage source through the voltage source circuit, a displaceable member having a displaceable engaging portion configured and positioned to move the output contact, wherein the displaceable engaging portion is disposed downstream of the fixed engageable member, and at least a part of the displaceable engaging portion is overlapped with the fixed engageable member with respect to a direction in which said process cartridge is inserted, and an elastic function member configured and positioned to urge the displaceable member to urge the output contact toward the retracted position away from the electrical connecting position, said process cartridge including:

an electrophotographic photosensitive drum;

process means actable on said electrophotographic photosensitive drum;

a movable operation member movable relative to a cartridge frame, wherein after said process cartridge is mounted to the main assembly of the apparatus, said movable operation member is displaced by a driving force transmitted from the main assembly of the electrophotographic image forming apparatus to said process cartridge, so that said movable operation member is engaged with the displaceable member provided in the main assembly of the electrophotographic image forming apparatus to move the displaceable member, in interrelation with which the output contact is moved from the retracted position to the electrical connecting position against an elastic force of the elastic function member; and an input electrical contact configured and positioned to receive a voltage for enabling said process means by engagement with the output contact moved to the electrical connecting position.

9. A process cartridge according to claim 8, further comprising a driving force receiving portion configured and positioned to receive a driving force from the main assembly of the image forming apparatus when said process cartridge is mounted to the main assembly of the image forming apparatus, said driving force receiving portion being disposed at one end of said process cartridge with respect to a longitudinal direction of said electrophotographic photosensitive drum, and said movable operation member being disposed at the other end of said process cartridge with respect to the longitudinal direction.

10. A process cartridge according to claim 8 or 9, wherein said movable operation member is supported on the cartridge frame for rotation about a shaft relative to the cartridge frame, and said electrophotographic photosensitive drum is rotated by a driving force transmitted from the main assembly of the electrophotographic image forming apparatus to said process cartridge, wherein the driving force is transmitted to said movable operation member by rotation of said electrophotographic photosensitive drum to rotate said movable operation member relative to the cartridge frame.

11. A process cartridge according to claim 8 or 9, further comprising an elastic function member configured and positioned to apply an elastic force to said movable operation member, wherein said elastic force of said elastic function member of said process cartridge is contributable to rotation of said movable operation member.

12. A process cartridge according to claim 8 or 9, further comprising an elastic function member configured and positioned to apply an elastic force to said movable operation member, wherein said movable operation member is rotated by being pushed by a projection provided on said electrophotographic photosensitive drum which is rotated by the driving force, and wherein when said movable operation member is rotated beyond a balanced position, said movable operation member moves away from said projection, and said movable operation member starts rotating by the elastic force of said elastic function member of said process cartridge, thus moving the output contact from said retracted position to said electrical connecting position by movement of said movable operation member caused by the projection and said elastic function member of said process cartridge.

13. A process cartridge according to claim 8 or 9, wherein said process means includes a charging member configured and positioned to electrically charge said electrophotographic photosensitive drum, and said input electrical contact receives from the output contact the voltage for charging said electrophotographic photosensitive drum.

14. A process cartridge according to claim 8 or 9, wherein said process means includes a developing member configured and positioned to develop the electrostatic latent image formed on said electrophotographic photosensitive drum, and said input electrical contact receives from the output contact a voltage for developing the electrostatic latent image.

15. An electrophotographic image forming apparatus for forming an image on a recording material, to which a process cartridge is detachably mountable, said apparatus comprising:

(i) an output contact movable between an electrical connecting position and a retracted position retracted from the electrical connecting position;

(ii) a main assembly displaceable member configured and positioned to move the output contact;

(iii) a mounting portion configured and positioned to detachably mount the process cartridge, the process cartridge including an electrophotographic photosensitive drum, process means actable on the electrophotographic photosensitive drum, a movable operation member, wherein after the process cartridge is mounted to the main assembly of said apparatus, the movable operation member is displaced by a driving force transmitted from the main assembly of said electrophotographic image forming apparatus to the process cartridge, so that the movable operation member is engaged with said main assembly displaceable member provided in the main assembly of said electrophotographic image forming apparatus to move said main assembly displaceable member, in interrelation with which said output contact is moved from the retracted position to the electrical connecting position, and an input electrical contact configured and positioned to receive a voltage for enabling the process means by engagement with said output contact moved to the electrical connecting position, when the process cartridge is set in said mounting portion.

16. An electrophotographic image forming apparatus for forming an image on a recording material, to which a process cartridge is detachably mountable, said apparatus comprising:

(i) voltage source;

(ii) a voltage source circuit connected with said voltage source;

(iii) a fixed member fixed in said electrophotographic image forming apparatus;

(iv) an output contact movable between an electrical connecting position and a retracted position which is retracted from the electrical connecting position and which is outside a cartridge mounting portion, said output contact being electrically connected with said voltage source through said voltage source circuit; and (v) a displaceable member having a displaceable engaging portion configured and positioned to move said output contact, wherein said displaceable engaging portion is disposed downstream of said fixed member, and at least a part of said displaceable engaging portion is overlapped with said fixed member with respect to a direction in which the process cartridge is mounted; and (vi) a first elastic function member configured and positioned to elastically urge said displaceable member to urge said output contact toward the retracted position away from the electrical connecting position;

(vii) a mounting portion configured and positioned to detachably mount the process cartridge, the process cartridge including an electrophotographic photosensitive drum, process means actable on the electrophotographic photosensitive drum, a movable operation member movable relative to a cartridge frame, wherein after the process cartridge is mounted to the main assembly of said apparatus, the movable operation member is displaced by a driving force transmitted from the main assembly of said electrophotographic image forming apparatus to the process cartridge, so that the movable operation member is engaged with said displaceable member provided in the main assembly of said electrophotographic image forming apparatus to move said displaceable member, in interrelation with which said output contact is moved from the retracted position to the electrical connecting position against an elastic force of said first elastic function member, and an input electrical contact configured and positioned to receive a voltage for enabling the process means by engagement with said output contact moved to the electrical connecting position.

17. An apparatus according to claim 15 or 16, wherein the movable operation member is supported on the cartridge frame for rotation about a shaft relative to the cartridge frame, and the electrophotographic photosensitive drum is rotated by a driving force transmitted from the main assembly of said electrophotographic image forming apparatus to the process cartridge, wherein the driving force is transmitted to the movable operation member by rotation of the electrophotographic photosensitive drum to rotate the movable operation member relative to the cartridge frame.

18. An apparatus according to claim 15 or 16, further comprising a second elastic function member configured and positioned to apply an elastic force to the movable operation member, wherein the elastic force of said second elastic function is contributable to rotation of the movable operation member.

19. An apparatus according to claim 15 or 16, further comprising a second elastic function member configured and positioned to apply an elastic force to the movable operation member, wherein the movable operation member is rotated by being pushed by a projection provided on the electrophotographic photosensitive drum which is rotated by the driving force, and wherein when the movable operation member is rotated beyond a balanced position, the movable operation member moves away from the projection, and the movable operation member starts rotating by the elastic force of said second elastic function member, thus moving said output contact from said retracted position to said electrical connecting position by movement of the movable operation member caused by the projection and said elastic second function member.

20. An apparatus according to claim 15 or 16, wherein the process means includes a charging member configured and positioned to electrically charge the electrophotographic photosensitive drum, and the input electrical contact receives from said output contact the voltage for charging the electrophotographic photosensitive drum.

21. An apparatus according to claim 15 or 16, wherein the process means includes a developing member configured and positioned to develop the electrostatic latent image formed on the electrophotographic photosensitive drum, and the input electrical contact receives from said output contact a voltage for developing the electrostatic latent image.

22. A process cartridge according to claim 1 or 8, wherein said input electrical contact is contacted to the output contact, and then slides on the output contact.

* * * * *

UNITED STATES PATENT AND TRADEMARK OFFICE

CERTIFICATE OF CORRECTION

PATENT NO. : 7,228,086 B2
APPLICATION NO. : 11/007464
DATED : June 5, 2007
INVENTOR(S) : Hideshi Kawaguchi et al.

It is certified that error appears in the above-identified patent and that said Letters Patent is hereby corrected as shown below:

COLUMN 7
Line 5, “image” should read --image is--.

COLUMN 8
Line 5, “press” should read --pressed--.
Line 10, “Shows” should read --shows--.

COLUMN 10
Line 42, “arrow an” should read --arrow a--.

COLUMN 11
Line 3, “made” should be deleted.

COLUMN 12
Line 59, “rotation” should read --rotate--.

COLUMN 27
Line 34, “position” should read --positioned--.

Signed and Sealed this

Seventeenth Day of February, 2009

JOHN DOLL
*Acting Director of the United States Patent and Trademark Office*